US006529204B1

(12) United States Patent
Mikoshiba et al.

(10) Patent No.: US 6,529,204 B1
(45) **Date of Patent: *Mar. 4, 2003**

(54) METHOD OF AND APPARATUS FOR DISPLAYING HALFTONE IMAGES

(75) Inventors: Shigeo Mikoshiba, Tokyo (JP); Takahiro Yamaguchi, Tokyo (JP); Kosaku Toda, Kawasaki (JP); Tsutae Shinoda, Kawasaki (JP); Kyoji Kariya, Kawasaki (JP); Toshio Ueda, Kawasaki (JP)

(73) Assignees: Fujitsu Limited, Kawasaki (JP); Shigeo Mikoshiba, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/883,233

(22) Filed: Jun. 26, 1997

(30) Foreign Application Priority Data

Oct. 29, 1996 (JP) ..... 8-287077

(51) Int. Cl.[7] ..... G09G 5/10

(52) U.S. Cl. ..... 345/597; 345/474; 345/690; 345/691; 345/89; 345/63

(58) Field of Search ..... 345/147, 148, 345/89, 149, 63, 77, 432, 690, 691, 692, 693, 596–597, 474, 473; 358/455, 456; 382/168, 169, 274; 340/825.8

(56) References Cited

U.S. PATENT DOCUMENTS 5,495,287 A * 2/1996 Kasai et al. ..... 345/89
5,696,524 A * 12/1997 Hoshino et al. ..... 345/147
5,748,160 A * 5/1998 Shieh et al. ..... 345/147
5,748,163 A * 5/1998 Han ..... 345/89
5,757,343 A * 5/1998 Nagakubo ..... 345/147
5,767,828 A * 6/1998 McKnight ..... 345/89

(List continued on next page.)

FOREIGN PATENT DOCUMENTS

| | | |
|---|---|---|
| EP | 0 720 139 | 7/1996 |
| JP | 6-259034 | 9/1994 |
| JP | 7-271325 | 10/1995 |
| JP | 8-63120 | 3/1996 |

OTHER PUBLICATIONS

K. Toda et al., Euro Display '96, "An Equalising Pulse Technique for Improving the Grey Scale Capability of Plasma Displays", published Oct. 1, 1996, pp. 39–42.
Makino et al., "Improvement of Video Image Quality in AC–Plasma Display Panels by Suppressing the Unfavorable Coloration Effect with Sufficient Gray Shades Capability," *ASIA Display '95*, pp. 381–384.
*Patent Abstracts of Japan*, vol. 17, No. 498, Sep. 8, 1993 & JP 05 127612 A (Nippon Hoso Kyokai), May 25, 1993.
*Patent Abstracts of Japan*, vol. 96, No. 9, Sep. 30, 1996 & JP 08 12335 A (Fujitsu), May 17, 1996.

*Primary Examiner*—Lun-Yi Lao
(74) *Attorney, Agent, or Firm*—Staas & Halsey LLP

(57) ABSTRACT

A method of displaying a dynamic halftone image on a display panel made of pixels divides each frame of the image into subframes and turns on and off the subframes. The method includes the steps of finding a line of pixels that simultaneously display a specific intensity level in a frame and another specific intensity level in the next frame, counting the number of pixels in the line, selecting corrective pulses, which turn on/off corresponding subframes to enable/disable corresponding intensity levels, according to the counted number and a change in the specific intensity levels between the frames, and adjusting original display signals for the pixels in the line according to the corrective pulses, respectively. The method eliminates halftone disturbance and false color contours from the image even if the moving speed of the image on the display panel is high.

16 Claims, 58 Drawing Sheets

U.S. PATENT DOCUMENTS 5,767,836 A * 6/1998 Scheffer et al. ..... 345/147
5,781,176 A * 7/1998 Rey et al. ..... 345/147
5,784,040 A * 7/1998 Kobayashi et al. ..... 345/147
5,786,798 A * 7/1998 Kasai et al. ..... 345/147
5,790,096 A * 8/1998 Hill, Jr. ..... 345/147
5,796,379 A * 8/1998 Enomoto et al. ..... 345/147
5,805,136 A * 9/1998 Silverbrook et al. ..... 345/147
5,815,128 A * 9/1998 Hoshino et al. ..... 345/147
5,818,400 A * 10/1998 Nagan ..... 345/147
5,818,405 A * 10/1998 Eglit et al. ..... 345/147
5,818,419 A * 10/1998 Tajima et al. ..... 345/147
5,867,137 A * 2/1999 Sugiyama ..... 345/89
5,898,414 A * 4/1999 Awamoto et al. ..... 345/55
5,907,316 A * 5/1999 Mikoshiba et al. ..... 345/147
5,943,032 A * 8/1999 Nagaoka et al. ..... 345/63
6,008,786 A * 12/1999 Kimura et al. ..... 345/89

* cited by examiner v = 1 PIXEL/FRAME (3 SUBPIXELS/FRAME), LEFTWARD

EP

G 1 : 127-128-128 (+0)

G 2 : 127-191-128 (+63)

v = 3 PIXELS/FRAME (9 SUBPIXELS/FRAME),LEFTWARD

EP

G 1 : 127-128-128-128-128 (+0, +0, +0)
G 2 : 127-191-191-191-128 (+63, +63, +63)
G 3 : 127-255-191-128-128 (+127, +63, +0)

v = 4 PIXELS/FRAME (12 SUBPIXELS/FRAME),LEFTWARD

EP

G 1 : 127-128-128-128-128-128 (+0, +0, +0, +0)
G 2 : 127-191-191-191-191-128 (+63, +63, +63, +63)
G 3 : 127-255-255-128-128-128 (+127, +127, +0, +0)

v = 5 PIXELS/FRAME (15 SUBPIXELS/FRAME),LEFTWARD

| | | EP |
|---|---|---|
| G 1 : | 127-128-128-128-128-128-128 | (+0, +0, +0, +0, +0) |
| G 2 : | 127-191-191-191-191-191-128 | (+63, +63, +63, +63, +63) |
| G 3 : | 127-255-255-191-128-128-128 | (+127, +127, +63, +0, +0) |

——— : G1

------ : G2

—·— : G3 v = 1 PIXEL/FRAME, RIGHTWARD
EP
G 1 : 127-127-128
G 2 : 127-64-128 (-63)

v = 3 PIXELS/FRAME, RIGHTWARD

EP

G 1 : 127-127-127-127-128
G 2 : 127-64-64-64-128 (-63, -63, -63)
G 3 : 127-127-64-0-128 (-0, -63, -127)

v = 4 PIXELS/FRAME, RIGHTWARD

EP

G 1 : 127-127-127-127-127-128

G 2 : 127-64-64-64-64-128 (-63, -63, -63, -63)

G 3 : 127-127-127-0-0-128 (-0, -0, -127, -127)

v = 5 PIXELS/FRAME, RIGHTWARD

EP

G 1 : 127-127-127-127-127-127-128

G 2 : 127-64-64-64-64-64-128 (-63, -63, -63, -63, -63)

G 3 : 127-127-127-64-0-0-128 (-0, -0, -63, -127, -127)

——— : G1.gau

------ : G2.gau

—·— : G3.gau

ΔSi … IDEAL STIMULUS CORRECTION
ΔSm … MAXIMUM STIMULUS CORRECTION

METHOD OF AND APPARATUS FOR DISPLAYING HALFTONE IMAGES

BACKGROUND OF THE INVENTION

1. Field of the Invention

The present invention relates to a method of and an apparatus for displaying halftone images in frames each divided into subframes, and more particularly, to a method of and an apparatus for displaying halftone images on a gas discharge display panel without halftone disturbance or false color contours.

2. Description of the Related Art

Recently, in order to meet a demand for large thin display units, matrix display panels that display images based on digital signals have been developed. The matrix display panels include gas discharge panels, DMDs (digital micro-mirror devices), EL (electro luminescence) display panels, fluorescent display panels, and liquid crystal display panels. Among them, the gas discharge panels such as plasma display panels are considered to be most advantageous for direct-view large HDTV (high-quality television) displays because they are simple and easy to form as a large screen, emit light by themselves, provide high display quality, and achieve high-speed response.

A memory-type gas discharge panel displays a halftone image in frames, and the frames are generated at a frequency of, for example, 60 Hz, and each frame consists of N subframes to provide intensity levels $2^0$ to $2^{N-1}$. The subframes of each frame are turned on/off, and the human eye sees the sum of the intensity levels of the ON subframes as the intensity level of the frame due to the persistence characteristic of the human eye. The number of intensity levels realized in each frame with combinations of the subframes is $2^N$.

Note that, if frames that represent similar intensity levels with quite different combinations of ON subframes alternate, flicker will occur to deteriorate display quality. Further, although the subframes of each frame actually emit light from a single pixel, to the human eye it appears as if they emit light from different pixels when a dynamic image is displayed. In this case, an intensity level assigned to a given frame is not displayed as the sum of the subframes, thereby causing halftone disturbance.

By the way, in the related art, a method of, and an apparatus for, displaying halftone images by adding a corrective pulse that turns on or off a corresponding subframe to adjust an intensity level is proposed. This related art is advantageous in that it realizes a given intensity level on the human eye, and thus the halftone image is visible without disturbance if it is seen away from the display. Namely, the related art is effective to stabilize still and moving images. However, it is unsatisfactory on fast-moving images.

The prior and related arts, and their associated problems, will be described in detailed later with reference to the accompanying drawings.

SUMMARY OF THE INVENTION

It is an object of the present invention to provide a method of, and an apparatus for, correctly displaying fast-moving halftone images on a screen without halftone disturbance or false color contours.

According to the present invention, there is provided a method of displaying a dynamic halftone image on a display panel made of pixels by dividing each frame of the image into subframes and by turning on and off the subframes, comprising the steps of finding a line of pixels that simultaneously display a specific intensity level in a frame and another specific intensity level in the next frame; counting the number of pixels in the line; selecting corrective pulses, which turn on/off corresponding subframes to enable/disable corresponding intensity levels, according to the counted number and a change in the specific intensity levels between the frames; and adjusting original display signals for the pixels in the line according to the corrective pulses, respectively.

Further, according to the present invention, there is provided a method of displaying a dynamic halftone image on a display panel made of pixels by dividing each frame of the image into subframes and by turning on and off the subframes, comprising the steps of finding a line of pixels that simultaneously display a specific intensity level in a frame and another specific intensity level in the next frame; counting the number of pixels in the line; detecting the statuses of two adjacent pixels on each side of the line of pixels in the frames; selecting corrective pulses, which turn on/off, corresponding subframes to enable/disable corresponding intensity levels, according to the statuses of the adjacent pixels, the counted number, and a change in the specific intensity levels between the frames; and adjusting original display signals for the pixels in the line according to the corrective pulses, respectively.

In addition, according to the present invention, there is provided a method of displaying a dynamic halftone image on a display panel made of pixels by dividing each frame of the image into subframes and by turning on and off the subframes, comprising the steps of finding, in each of the vertical and horizontal directions, a line of pixels that simultaneously display a specific intensity level in a frame and another specific intensity level in the next frame; counting the number of pixels in each of the lines; selecting corrective pulses, which turn on/off corresponding subframes to enable/disable corresponding intensity levels, according to a smaller one of the counted numbers and a change in the specific intensity levels between the frames; and adjusting original display signals for the pixels of the smaller number according to the corrective pulses, respectively.

According to the present invention, there is also provided a method of displaying a dynamic halftone image on a display panel made of pixels by dividing each frame of the image into subframes and by turning on and off the subframes, comprising the steps of finding, in each of vertical and horizontal directions, a line of pixels that simultaneously display a specific intensity level in a frame and another specific intensity level in the next frame; counting the number of pixels in each of the lines; detecting the statuses of two adjacent pixels on each side of each of the lines in the frames; selecting corrective pulses, which turn on/off corresponding subframes to enable/disable corresponding intensity levels, according to a smaller one of the counted numbers with the two adjacent pixels having different statuses and a change in the specific intensity levels between the frames; and adjusting original display signals for the pixels of the smaller number according to the corrective pulses, respectively.

Further, according to the present invention, there is also provided a method of displaying a dynamic halftone image on a display panel made of pixels by dividing each frame of the image into subframes and by turning on and off the subframes, comprising the steps of finding, in each of vertical and horizontal directions, a line of pixels that simultaneously display a specific intensity level in a frame and another specific intensity level in the next frame; counting the number of pixels in each of the lines; detecting the statuses of two adjacent pixels on each side of each of the lines in the frames; selecting corrective pulses, which turn on/off corresponding subframes to enable/disable corresponding intensity levels, according to a smaller one of the counted numbers if the statuses of the two adjacent pixels of any one of the lines are equal to each other, and according to a change in the specific intensity levels between the frames; and adjusting original display signals for the pixels of the smaller number according to the corrective pulses, respectively.

In addition, according to the present invention, there is also provided a method of displaying a dynamic halftone image on a display panel made of pixels by dividing each frame of the image into subframes and by turning on and off the subframes, comprising the steps of finding, in each of the vertical and horizontal directions, a line of pixels that simultaneously display a specific intensity level in a frame and another specific intensity level in the next frame; counting the number of pixels in each of the lines; detecting the statuses of two adjacent pixels on each side of each of the lines in the frames; selecting corrective pulses, which turn on/off corresponding subframes to enable/disable corresponding intensity levels, according to one of the counted numbers with the two adjacent pixels having different statuses and a change in the specific intensity levels between the frames; and adjusting original display signals for the pixels in the line with the two adjacent pixels having different statuses according to the corrective pulses, respectively.

The original display signals may be adjusted according to the corrective pulses only when the two adjacent pixels of the line in question have different statuses. The corrective pulses may be zeroed when the two adjacent pixels of the line in question are equal to each other. At least one of the original display signals may be adjusted according to the corrective pulses when the two adjacent pixels of the line in question are equal to each other.

According to the present invention, there is provided a method of displaying a dynamic halftone image on a display panel made of pixels by dividing each frame of the image into subframes and by turning on and off the subframes, comprising the steps of finding a line of pixels that simultaneously display a specific intensity level in a frame and another specific intensity level in the next frame; selecting identical or different corrective pulses, which turn on/off corresponding subframes to enable/disable corresponding intensity levels, according to the line of pixels; and adjusting original display signals for the pixels in the line according to the corrective pulses, respectively.

Further, according to the present invention, there is provided a method of displaying a dynamic halftone image on a display panel made of pixels by dividing each frame of the image into subframes and by turning on and off the subframes, comprising the steps of finding a line of pixels that simultaneously display a specific intensity level in a frame and another specific intensity level in the next frame; preparing corrective pulses corresponding to sequentially increasing or decreasing intensity levels according to the line of pixels; and adjusting original display signals for the pixels in the line according to the corrective pulses, respectively.

In addition, according to the present invention, there is provided a method of displaying a dynamic halftone image on a display panel made of pixels by dividing each frame of the image into subframes and by turning on and off the subframes, comprising the steps of finding a line of n pixels that simultaneously display a specific intensity level in a frame and another specific intensity level in the next frame; calculating the sum ΔS of stimulus (stimuli) on the retina to be produced with a corrective pulse, which will be applied to one of the n pixels, as follows:

$$B_1T \leqq B_2T + \Delta S \leqq B_3T, \text{ or}$$

$$B_1T \geqq B_2T + \Delta S \geqq B_3T$$

where T is a period in which the intensity level of the n pixels changes from one to another, $B_1$ is an average of stimulus (stimuli) on the retina due to one of the n pixels before the change, $B_2$ is an average of stimulus on the retina due to the same during the change, and $B_3$ is an average of stimulus on the retina due to the same after the change; selecting identical or different corrective pulses, which turn on/off corresponding subframes to enable/disable corresponding intensity levels, so that the total sum of stimulus on the retina to be produced with the corrective pulses is substantially equal to nΔS; and adjusting original display signals for the n pixels according to the corrective pulses, respectively.

Further, according to the present invention, there is provided a method of displaying a dynamic halftone image on a display panel made of pixels by dividing each frame of the image into subframes and by turning on and off the subframes, comprising the steps of finding a line of n pixels that simultaneously display a specific intensity level in a frame and another specific intensity level in the next frame; calculating the sum ΔS of stimulus on the retina to be produced with an corrective pulse, which will be applied to one of the n pixels, as follows:

$$\text{if } B_2 \leqq (B_1+B_3)/2 \text{ then } 0 \leqq \Delta S \leqq (B_1+B_3-2B_2)T$$

$$\text{if } B_2 \geqq (B_1+B_3)/2 \text{ then } 0 \geqq \Delta S \geqq (B_1+B_3-2B_2)T$$

where T is a period in which the intensity level of the n pixels changes from one to another, $B_1$ is an average of stimulus on the retina due to one of the n pixels before the change, $B_2$ is an average of stimulus on the retina due to the same during the change, and $B_3$ is an average of stimulus on the retina due to the same after the change; selecting identical or different corrective pulses, which turn on/off corresponding subframes to enable/disable corresponding intensity levels, so that the total sum of stimulus on the retina to be produced with the corrective pulses is substantially equal to nΔS; and adjusting original display signals for the n pixels according to the corrective pulses, respectively.

According to the present invention, there is also provided a method of displaying a dynamic halftone image on a display panel made of pixels by dividing each frame of the image into subframes and by turning on and off the subframes, comprising the steps of finding a plurality of pixels that simultaneously display an intensity level in a frame and another intensity level in the next frame; comparing the intensity levels with each other; selecting weighted corrective pulses, which turn on/off corresponding subframes to enable/disable corresponding intensity levels, according to the number of the found pixels and a change in the intensity levels between the frames; and adjusting original display signals for the found pixels according to the corrective pulses, respectively.

Each of the pixels may consist of three subpixels for emitting three primary colors of red, green, and blue, respectively, the subpixels being combined to display a color.

According to the present invention, there is provided a display apparatus for displaying a dynamic halftone image on a display panel made of pixels by dividing each frame of the image into subframes and by turning on and off the subframes, comprising a finding unit for finding a line of pixels that simultaneously display a specific intensity level in a frame and another specific intensity level in the next frame; a counting unit for counting the number of pixels in the line; a selecting unit for selecting corrective pulses, which turn on/off corresponding subframes to enable/disable corresponding intensity levels, according to the counted number and a change in the specific intensity levels between the frames; and an adjusting unit for adjusting original display signals for the pixels in the line according to the corrective pulses, respectively.

Further, according to the present invention, there is provided a display apparatus for displaying a dynamic halftone image on a display panel made of pixels by dividing each frame of the image into subframes and by turning on and off the subframes, comprising a finding unit for finding, in each of vertical and horizontal directions, a line of pixels that simultaneously display a specific intensity level in a frame and another specific intensity level in the next frame; a first counting unit for counting the number of pixels in the horizontal line; a second counting unit for counting the number of pixels in the vertical line; a detecting unit for detecting the statuses of two adjacent pixels on each side of each of the horizontal and vertical lines in the frames; a first selecting unit for selecting one of the horizontal and vertical lines according to the counted numbers and the statuses of the adjacent pixels; a second selecting unit for selecting corrective pulses, which turn on/off corresponding subframes to enable/disable corresponding intensity levels, according to the number of pixels in the selected line and the statuses of the two adjacent pixels of the selected line; and an adjusting unit for adjusting original display signals for the pixels in the selected line according to the corrective pulses, respectively.

The original display signals may be adjusted according to the corrective pulses only when the two adjacent pixels of the line in question have different statuses. The corrective pulses may be zeroed when the two adjacent pixels of the line in question are equal to each other. At least one of the original display signals may be adjusted according to the corrective pulses when the two adjacent pixels of the line in question are equal to each other.

In addition, according to the present invention, there is provided a display apparatus for displaying a dynamic halftone image on a display panel made of pixels by dividing each frame of the image into subframes and by turning on and off the subframes, comprising a finding unit for finding a plurality of pixels that simultaneously display an intensity level in a frame and another intensity level in the next frame; a comparing unit for comparing the intensity level with each other; a selecting unit for selecting weighted corrective pulses, which turn on/off corresponding subframes to enable/disable corresponding intensity levels, according to the number of the found pixels, the statuses of adjacent pixels on each side of the found pixels in the frames, and a change in the intensity levels between the frames; and an adjusting unit for adjusting original display signals for the found pixels according to the corrective pulses, respectively.

Each of the pixels may consist of three subpixels for emitting three primary colors of red, green, and blue, respectively, the subpixels being combined to display a color.

According to the present invention, there is also provided a medium for storing a computer program for displaying a dynamic halftone image on a display panel made of pixels by dividing each frame of the image into subframes and by turning on and off the subframes, the program comprising the steps of finding a line of pixels that simultaneously display a specific intensity level in a frame and another specific intensity level in the next frame; counting the number of pixels in the line; selecting corrective pulses, which turn on/off corresponding subframes to enable/disable corresponding intensity levels, according to the counted number and a change in the specific intensity levels between the frames; and adjusting original display signals for the pixels in the line according to the corrective pulses, respectively.

Further, according to the present invention, there is also provided a medium for storing a computer program for displaying a dynamic halftone image on a display panel made of pixels by dividing each frame of the image into subframes and by turning on and off the subframes, the program comprising the steps of finding a line of pixels that simultaneously display a specific intensity level in a frame and another specific intensity level in the next frame; counting the number of pixels in the line; detecting the statuses of two adjacent pixels on each side of the line of pixels in the frames; selecting corrective pulses, which turn on/off corresponding subframes to enable/disable corresponding intensity levels, according to the statuses of the adjacent pixels, the counted number, and a change in the specific intensity levels between the frames; and adjusting original display signals for the pixels in the line according to the corrective pulses, respectively.

In addition, according to the present invention, there is also provided a medium for storing a computer program for displaying a dynamic halftone image on a display panel made of pixels by dividing each frame of the image into subframes and by turning on and off the subframes, the program comprising the steps of finding, in each of vertical and horizontal directions, a line of pixels that simultaneously display a specific intensity level in a frame and another specific intensity level in the next frame; counting the number of pixels in each of the lines; selecting corrective pulses, which turn on/off corresponding subframes to enable/disable corresponding intensity levels, according to a smaller one of the counted numbers and a change in the specific intensity levels between the frames; and adjusting original display signals for the pixels of the smaller number according to the corrective pulses, respectively.

Furthermore, according to the present invention, there is also provided a medium for storing a computer program for displaying a dynamic halftone image on a display panel made of pixels by dividing each frame of the image into subframes and by turning on and off the subframes, the program comprising the steps of finding, in each of the vertical and horizontal directions, a line of pixels that simultaneously display a specific intensity level in a frame and another specific intensity level in the next frame; counting the number of pixels in each of the lines; detecting the statuses of two adjacent pixels on each side of each of the lines in the frames; selecting corrective pulses, which turn on/off corresponding subframes to enable/disable corresponding intensity levels, according to a smaller one of the counted numbers with the two adjacent pixels having different statuses and a change in the specific intensity levels between the frames; and adjusting original display signals for the pixels of the smaller number according to the corrective pulses, respectively.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

For a better understanding of the preferred embodiments of the present invention, the problem in the prior art will be explained with reference to FIGS. 1 to 22.

A memory-type gas discharge panel displays a halftone image in frames. The frames are generated at a frequency of, for example, 60 Hz, and each frame consists of N subframes SF0 to SF (N−1) to provide intensity levels $2^0$ to $2^{N-1}$, respectively. The subframes of each frame are turned on/off, and the human eye sees the sum of the intensity levels of the ON subframes as the intensity level of the frame due to the persistence characteristic of the human eye. The number of intensity levels realized in each frame with combinations of the subframes is $2^N$.

Figure 1:
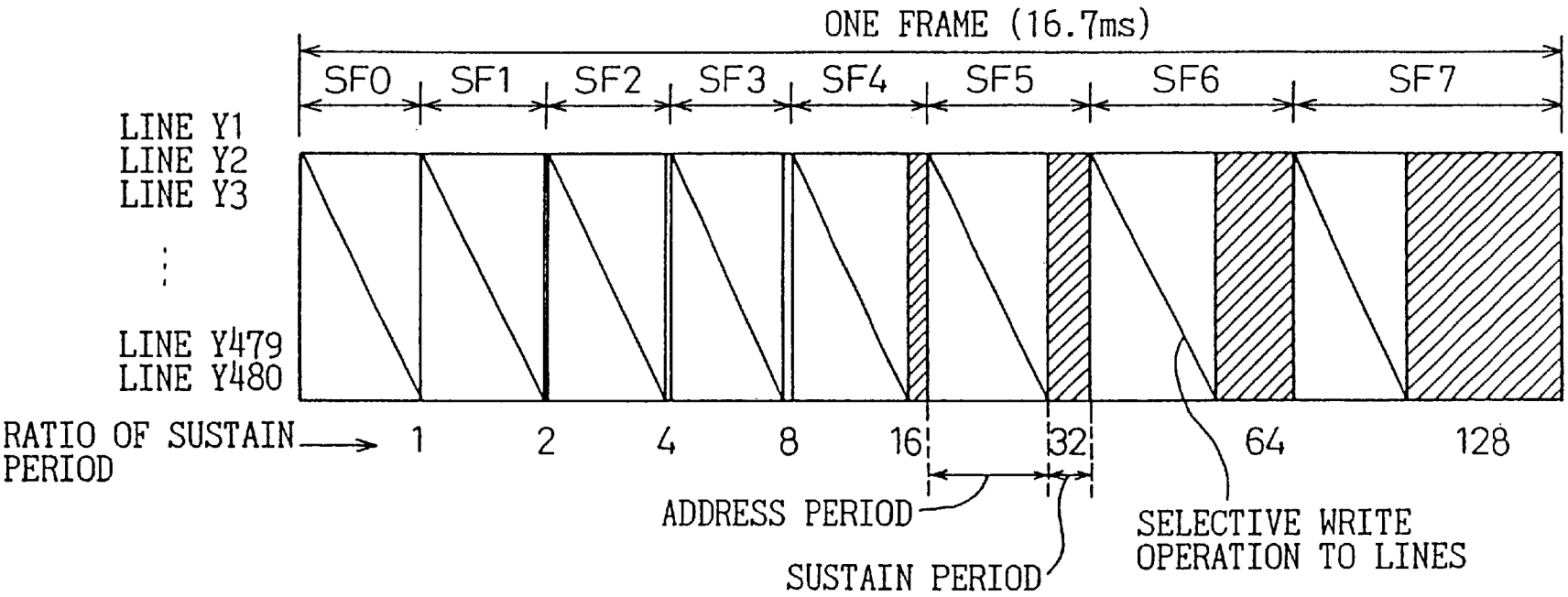
Fig.1 PRIOR ART
FIG. 1 shows a frame consisting of eight subframes.

FIG. 1 shows a frame consisting of eight subframes SF0 to SF7. The subframe SF0 represents a lowest intensity level and corresponds to a least significant bit b0 in display data. The subframe SF7 represents a highest intensity level and corresponds to a most significant bit b7 in the display data. The eight subframes SF0 to SF7 are combined in various ways to display 256 intensity levels ($2^N=2^8=256$).

If frames that represent similar intensity levels with quite different combinations of ON subframes alternate, flicker will occur to deteriorate display quality.

Figure 2:
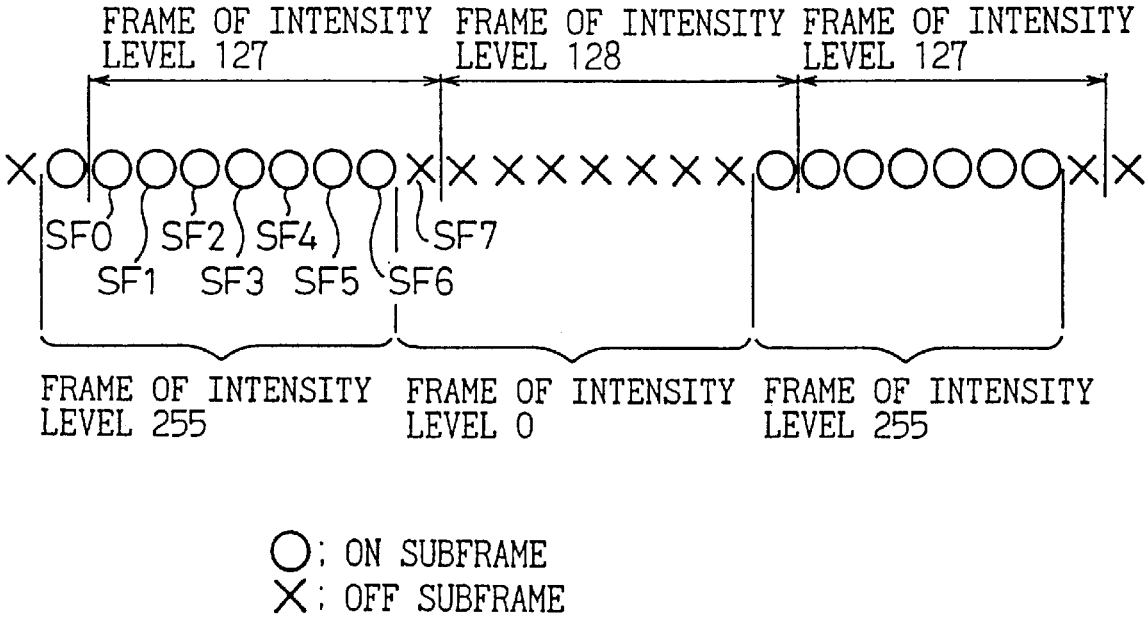
Fig.2 PRIOR ART
FIG. 2 shows the ON/OFF states of subframes in two frames to display intensity levels 127 and 128.

FIG. 2 shows the ON/OFF states of subframes in frames to display intensity levels 127 and 128. The frame to display intensity level 127 turns on the subframes SF0 to SF6 and off the subframe SF7. The frame to display intensity level 128 turns off the subframes SF0 to SF6 and on the subframe SF7.

When these frames alternate, there will be a frame period containing only OFF subframes and a frame period containing only ON subframes.

These ON and OFF frame periods will cause flicker if they are alternated. This phenomenon frequently occurs due to conversion errors or noise when converting an analog image involving smoothly changing intensity levels into a digital image. The conversion errors or noise are amplified into flicker to deteriorate display quality.

To suppress flicker, Japanese Unexamined Patent Publication (Kokai) No. 3-145691 arranges the subframes of each frame in order of SF0, SF2, SF4, SF6, SF7, SF5, SF3, and SF1.

Flicker occurs when frames alternately display similar intensity levels with quite different combinations of subframes. The flicker becomes more visible as intensity levels increase. To solve this problem, Japanese Unexamined Patent Publication (Kokai) No. 4-127194 halves the highest intensity level subframe and inserts a lower intensity subframe between them.

Japanese Unexamined Patent Publication (Kokai) No. 5-127612 describes that dividing a frame into subframes sometimes causes rough, low-quality dynamic images, and proposes an improved frame dividing technique.

This technique employs a unit for doubling a frame frequency if a given frame frequency is less than 70 Hz. Each frame under the doubled frame frequency has at least one normal-bit subframe including a highest-intensity-level subframe and at least one under-bit subframe. The technique displays a static image with every two frames representing an intensity level, and a dynamic image with every frame representing an intensity level. This technique creates display data for the doubled frames according to input display data.

Figure 3:
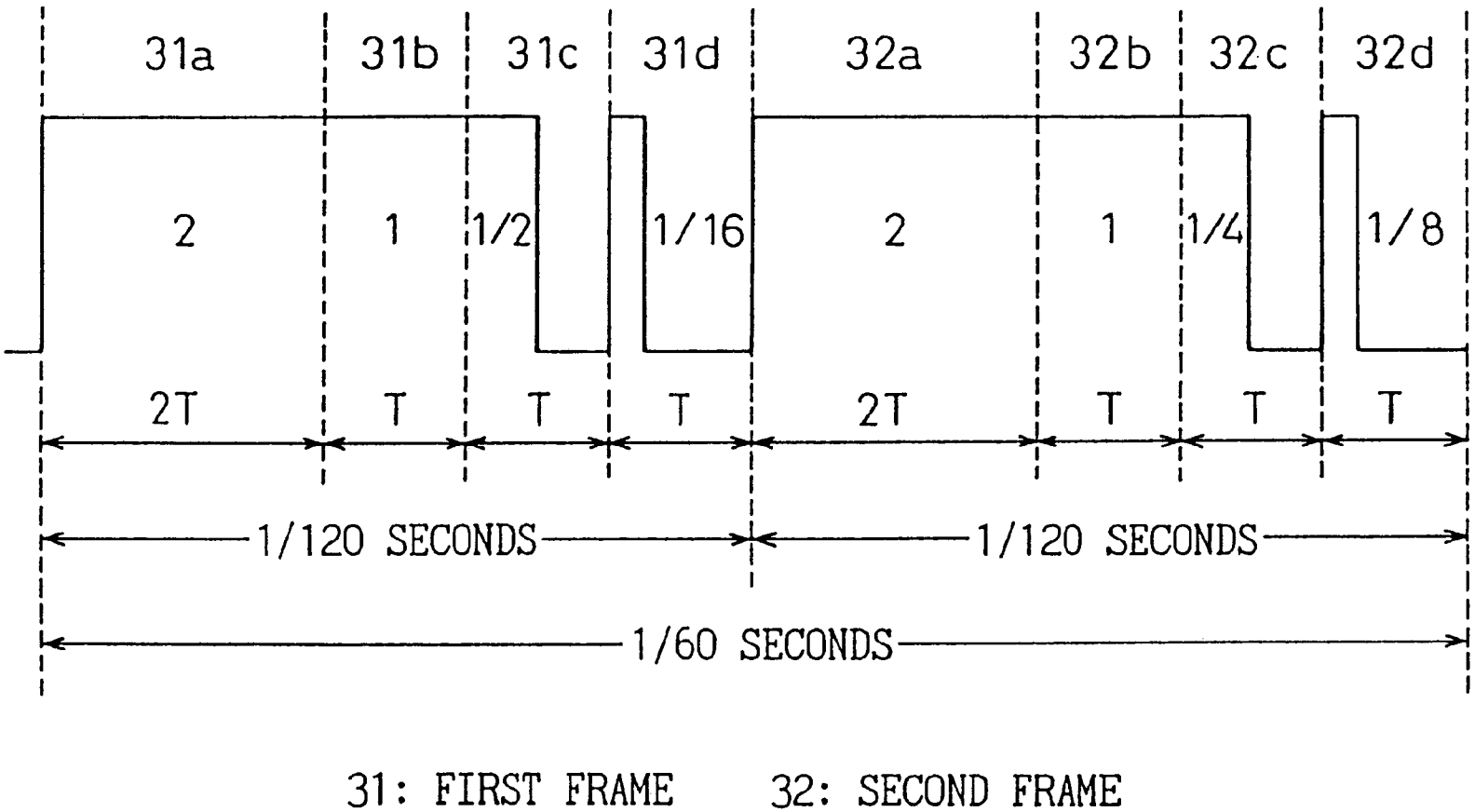
Fig. 3 PRIOR ART
FIG. 3 shows a first frame to display intensity level 31 and a second frame to display intensity level 32 among frequency-doubled frames according to a prior art.

FIG. 3 shows a first frame displaying intensity level 31 and a second frame displaying intensity level 32 among the frequency-doubled frames. In the first and second frames, subframes 31*a* and 32*a* provide an identical intensity level, and subframes 31*b* and 32*b* provide another identical intensity level. These subframes are normal-bit subframes. The other subframes are under-bit subframes.

This technique may cause no halftone disturbance when displaying a static image or a slow-speed dynamic image. However, it causes halftone disturbance when displaying a fast-moving dynamic image. The halftone disturbance will be explained with reference to FIGS. 4 to 7 in which each frame consists of six subframes that are arranged in order of SF5, SF4, SF3, SF2, SF1, and SF0.

Figure 4:
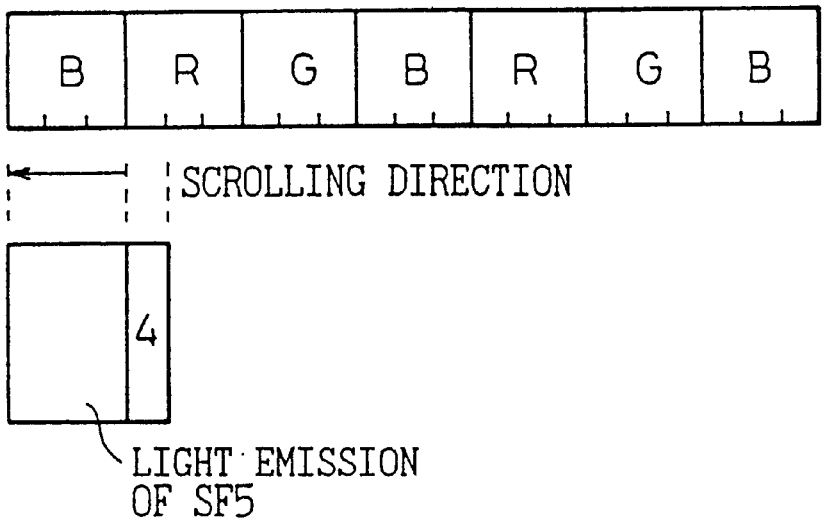
Fig.4 PRIOR ART
FIG. 4 shows an example of halftone disturbance according to the prior art.
Figure 5:
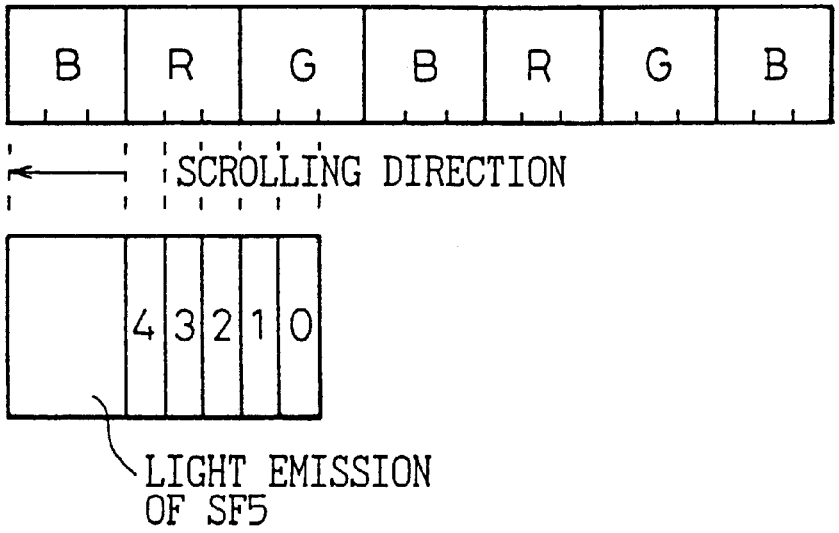
Fig.5 PRIOR ART
FIG. 5 shows another example of halftone disturbance according to the prior art.
Figure 6:
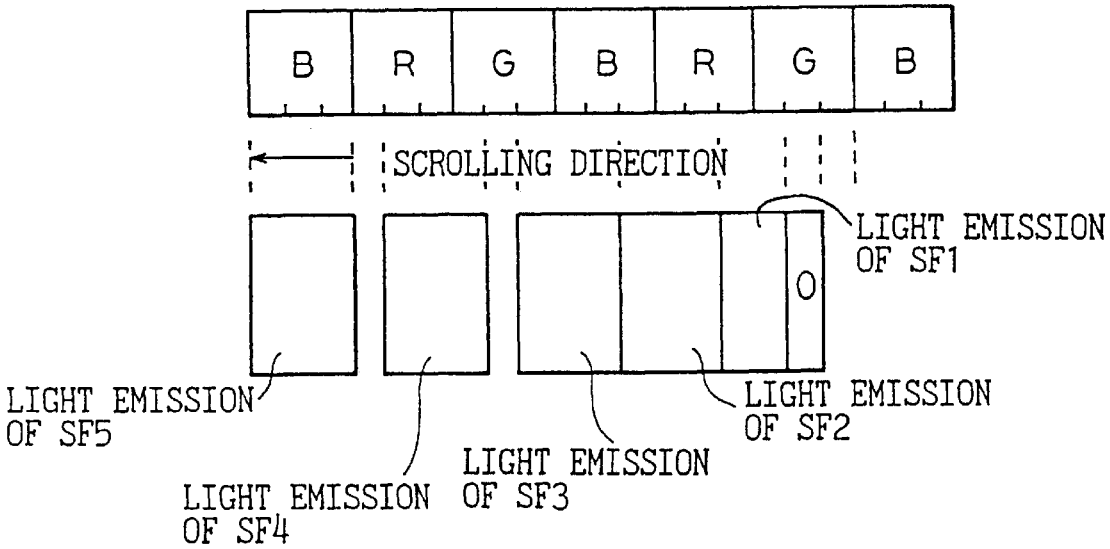
Fig.6 PRIOR ART
FIG. 6 shows still another example of halftone disturbance according to the prior art.
Figure 7:
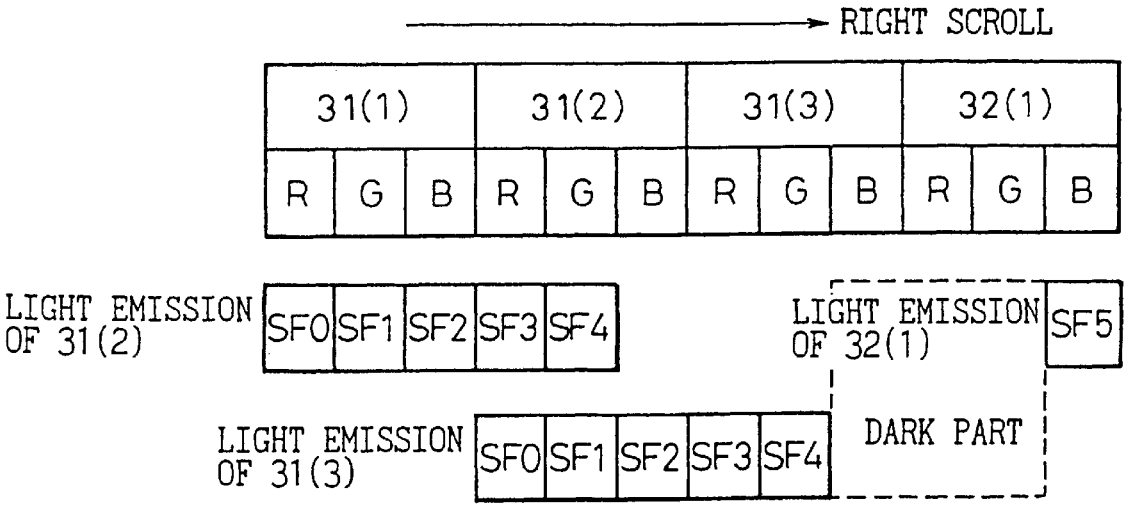
Fig.7 PRIOR ART
FIG. 7 shows a dark part appearing between intensity levels 31 and 32 during a right scroll.

FIGS. 4 to 6 show different types of halftone disturbance according to a prior art and FIG. 7 shows a dark part formed between intensity levels 31 and 32 during a right scroll.

A vertical blue line is displayed with the subframe SF5 being turned on, and the blue line is scrolled from the right to the left. When the blue line is scrolled at a speed of a pixel per frame, the human eye sees as if it is smoothly moving even over red and green subpixels that emit no light actually. Here, each pixel consists of a red subpixel, a green subpixel, and a blue subpixel. The smooth movement is visible even when the blue line is moved at a speed of several pixels per frame. This phenomenon of the human eye seeing a smooth movement is called an "apparent motion" or "β motion" in psychology.

In FIG. 4, the vertical blue line is displayed with the subframes SF5 and SF4 being turned on and is scrolled from the right to the left at a speed of a pixel per frame. In this case, the human eye sees as if the subframes SF5 and SF4 are spatially separated from each other. Although the subframe SF5 is turned on in a blue subpixel, the human eye sees as if it is moving over red and green subpixels.

When the subframe SF4 is turned on, in the same blue subpixel, a write period of about 2 msec after the subframe SF5, it appears to the human eye as if the subframe SF4 is following the subframe SF5 in the scrolling direction. If all subframes are turned on and scrolled as shown in FIG. 5, it appears to the human eye as if they are spatially separated from one another.

FIG. 6 shows a vertical blue line displayed with the subframes SF5 to SF0 being turned on and scrolled from the right to the left at a speed of two pixels per frame. Due to the extended intervals of two pixels, the human eye sees faster movements of the subframes. When the subframe SF4 is turned on about 2 msec after the subframe SF5, the subframe SF5 is ahead of SF4 on the human eye. Namely, the human eye sees the subframes spreading for a distance corresponding to a frame period.

Although the subframes of each frame actually emit light in a single pixel, it appears to the human eye as if they emit light in different pixels when a dynamic image is displayed. In this case, an intensity level assigned to a given frame is not displayed as the sum of the subframes, thereby causing halftone disturbance.

Figure 8:
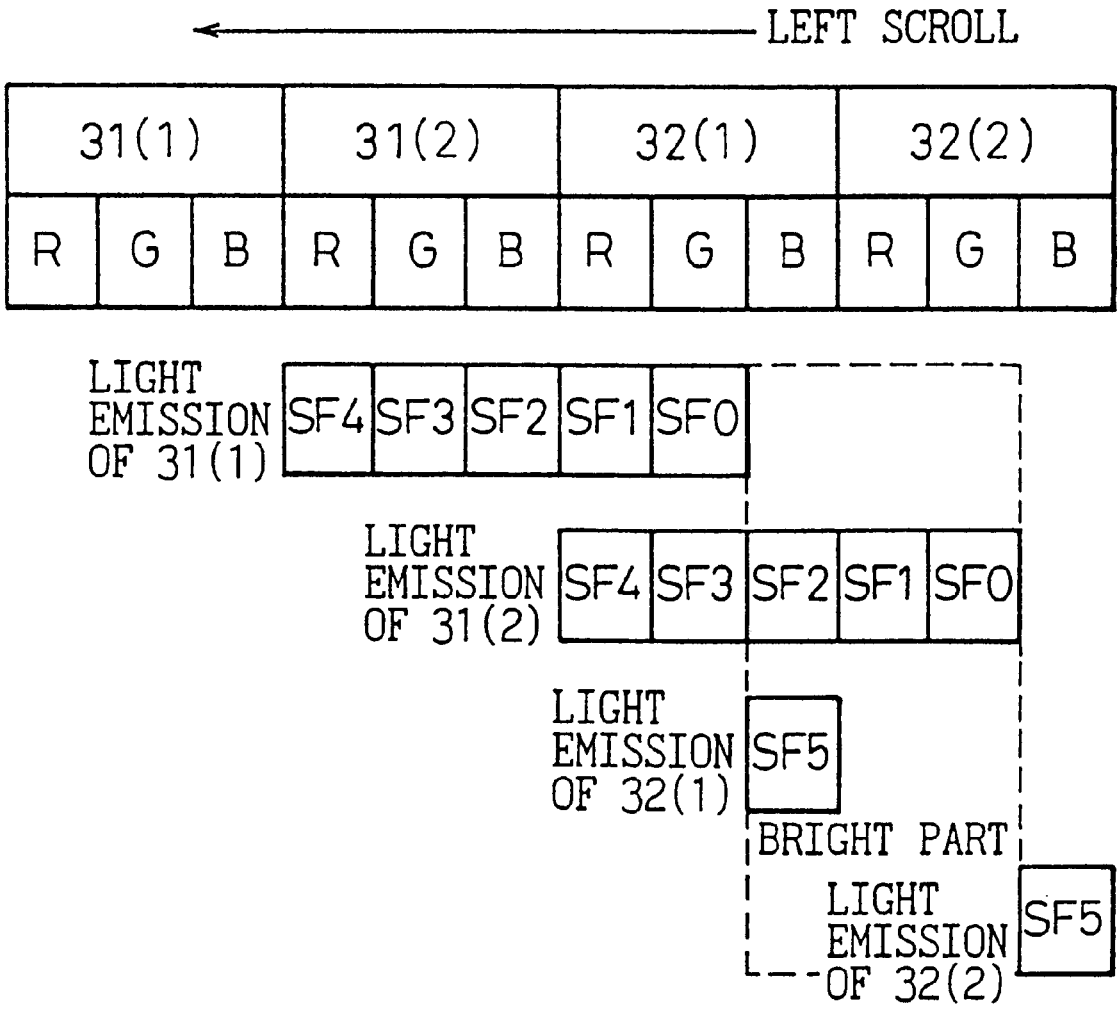
Fig. 8 PRIOR ART
FIG. 8 shows a bright part appearing between intensity levels 31 and 32 during a left scroll.
Figure 9:
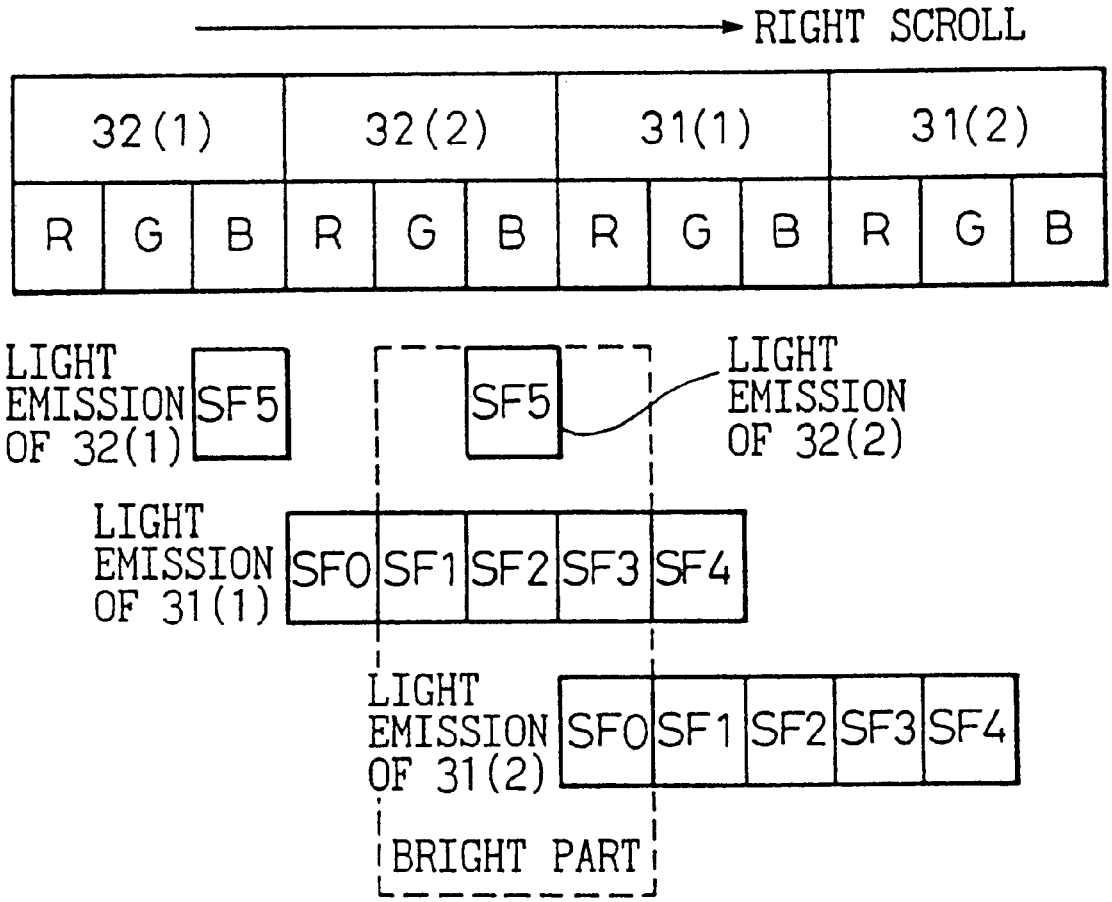
Fig.9 PRIOR ART
FIG. 9 shows a bright part appearing between intensity levels 32 and 31 during a right scroll.

FIGS. 7 to 9 show dark and bright parts that appear between specific intensity levels in a single-color halftone image that is being scrolled.

In the figures, each frame consists of six subframes SF5 to SF0 that are arranged in descending order of the intensity levels thereof. A blue halftone image is displayed with the intensity level thereof gradually increasing from the left to the right and is scrolled to the right. A dark part appears between specific intensity levels that involve quite different numbers of ON subframes.

Such dark part is produced between, for example, intensity levels 31 and 32, 15 and 16, or 7 and 8. In FIG. 7, the image is moved at a speed of two pixels per frame, and a dark part appears between intensity level 31, which is realized by turning on the subframes SF4 to SF0, and intensity level 32, which is realized by turning on the subframe SF5 only.

The dark part occurs because the subframes are spatially separated from one another in the human eye. The dark part of FIG. 7 extends for one pixel composed of red (R), green (G), and blue (B) subpixels.

FIG. 8 shows the same image as that of FIG. 7 but scrolled to the left. In this case, a bright part is observed between intensity levels 31 and 32.

FIG. 9 shows an image involving opposite intensity levels to those of FIG. 7. The image is scrolled to the right like FIG. 7. In this case, a bright part appears between intensity levels 31 and 32.

When displaying a dynamic image with single color or with the same subframes being turned on in each subpixel of a given pixel, the image may involve a dark or bright part. When displaying a dynamic image with different subframes being turned on in the subpixels of a given pixel, the image may involve false color contours.

The false color contours appearing on a dynamic image displayed according to the prior art will be explained with reference to FIGS. 10A to 12C. In the figures, each frame consists of subframes SF0 to SF7 with the subframe SF0 providing a lowest intensity level and the subframe SF7 providing a highest intensity level.

Figure 10A:
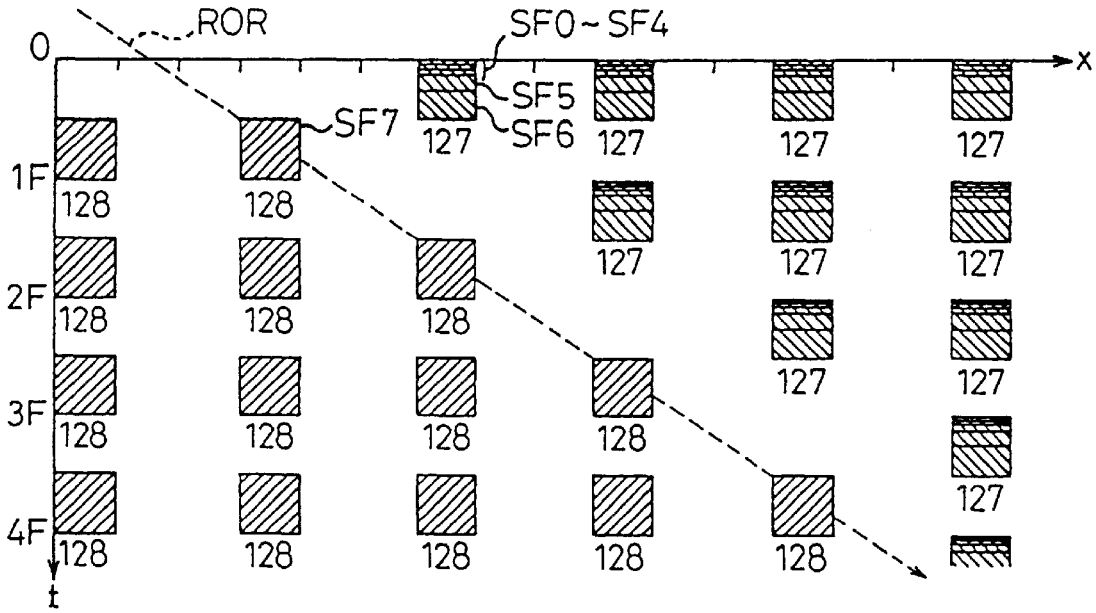
Fig.10A PRIOR ART
FIGS. 10A and 10B show a halftone image under scrolling.
Figure 10B:
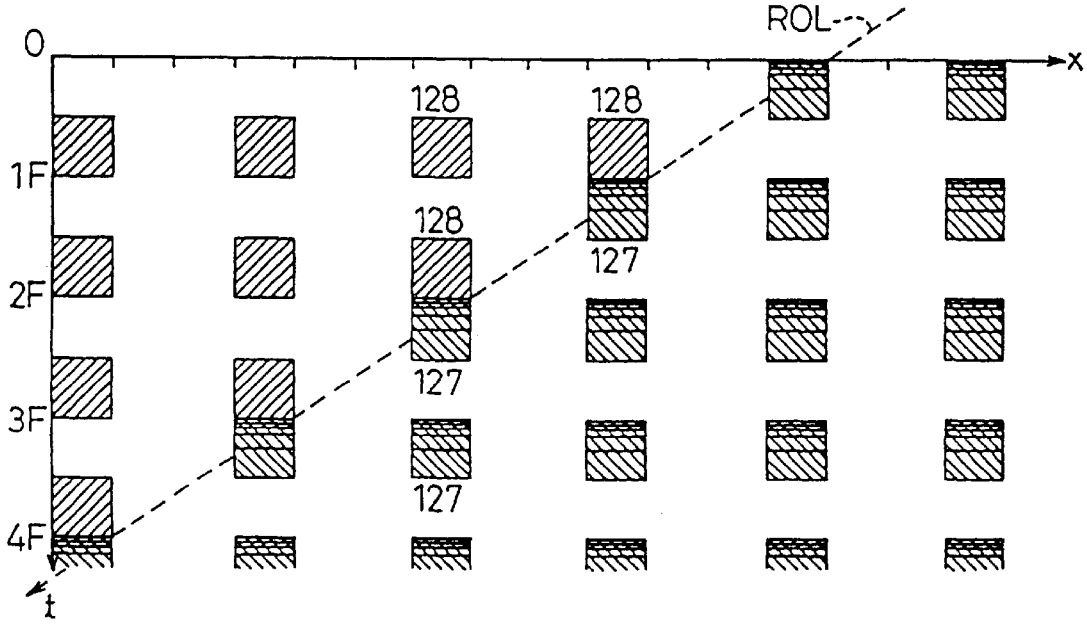
Fig.10B PRIOR ART

FIG. 10A shows a dynamic image scrolling from the left to the right at a speed of a pixel per frame, and FIG. 10B shows a dynamic image scrolling from the right to the left at a speed of a pixel per frame. In FIGS. 10A and 10B, an ordinate represents time t, and an abscissa represents spatial positions x. Reference marks 1F to 4F represent frames.

Figure 11A:
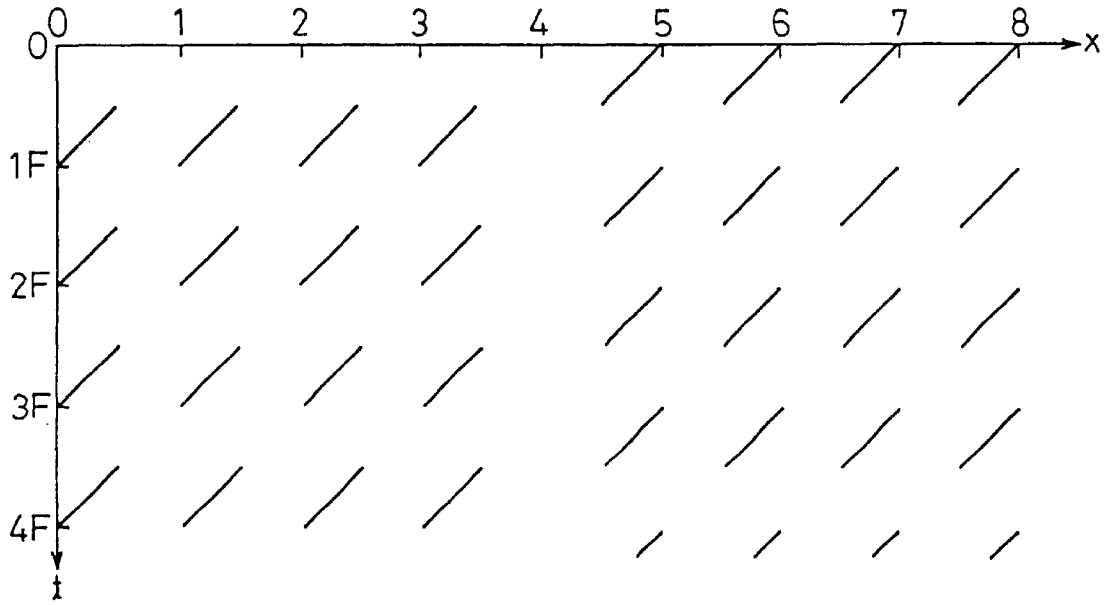
Fig.11A PRIOR ART
FIGS. 11A to 11C show a problem occurring in the halftone image of FIG. 10A.
Figure 11B:
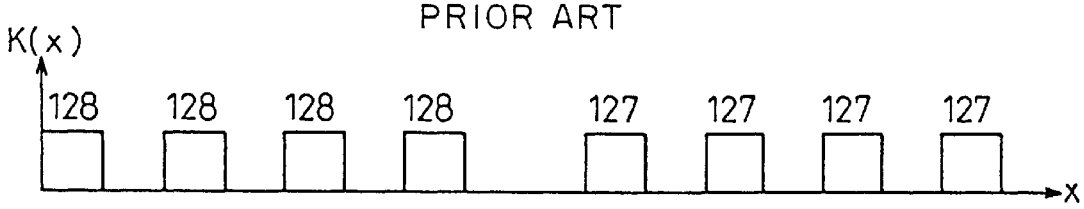
Fig.11B PRIOR ART
Figure 11C:
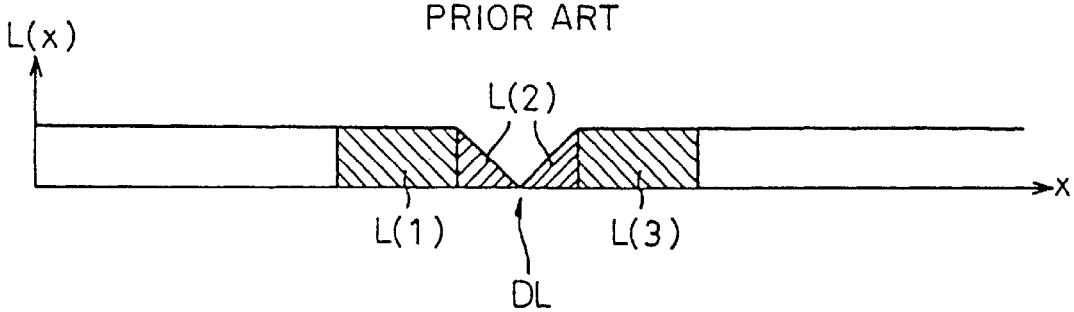
Fig.11C PRIOR ART
Figure 12A:
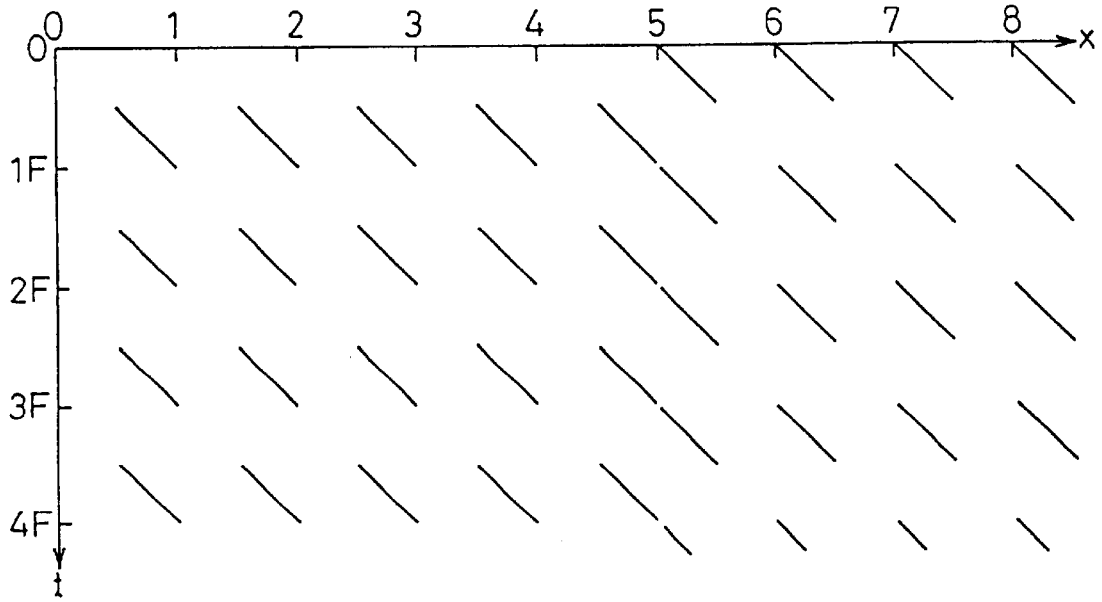
Fig.12A PRIOR ART
FIGS. 12A to 12C show a problem occurring in the halftone image of FIG. 10B.
Figure 12B:
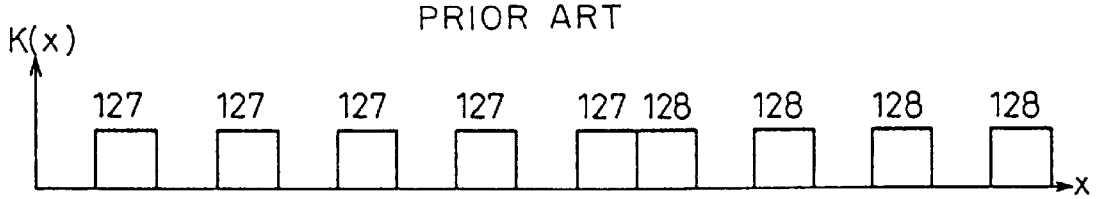
Fig.12B PRIOR ART
Figure 12C:
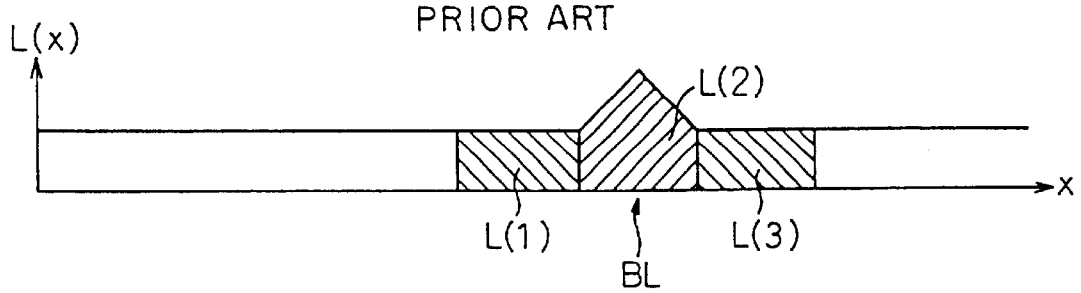
Fig.12C PRIOR ART

FIGS. 11A to 11C correspond to FIG. 10A and show a problem occurring when the image is moved from the left to the right. FIGS. 12A to 12C correspond to FIG. 10B and show a problem occurring when the image is moved from the right to the left.

The image of FIG. 10A includes consecutive pixels that display intensity levels 128 and 127. The image is moved from the left to the right at a speed of a pixel per frame. Due to the apparent motion, a coordinate origin on the retina of the human eye moves along a dotted line ROR. The image of FIG. 10A is observed as shown in FIG. 11A if coordinates on the retina are fixed.

The image of FIG. 10B includes consecutive pixels that display intensity levels 128 and 127. The image is moved from the right to the left at a speed of a pixel per frame. A coordinate origin on the retina moves along a dotted line ROL. The image of FIG. 10B is observed as shown in FIG. 12A if coordinates on the retina are fixed.

Intensity level 127 is realized by turning on the subframes SF0 to SF6 and off the subframe SF7. Intensity level 128 is realized by turning off the subframes SF0 to SF6 and on the subframe SF7. For the sake of simplicity, each pixel has no area in FIGS. 11A and 12A.

When the image having intensity levels 128 and 127 is scrolled from the left to the right as shown in FIG. 10A, intensity levels K(x) at positions x on the retina have a gap between intensity levels 128 and 127 as shown in FIG. 11B. At this position, stimulus L(x) on the retina drops to form a valley as shown in FIG. 11C.

Integrated stimuli for x=2.5 to 3.5, x=3.5 to 4.5, and x=4.5 to 5.5 are L(1), L(2), and L(3), respectively, and are expressed as follows:

$$L(1) \approx L(3) >> L(2)$$

Due to this, a dark line DL appears between the pixels that display intensity levels 128 and 127. This dark line DL is halftone disturbance.

Stimulus L(x) on the retina is expressed as follows:

$$L(x) = \int_{\lambda-0.5}^{\lambda+0.5} K(x)\,dx$$

where λ is an optional integer. Although the range of integration of the above expression is from λ−0.5 to λ+0.5, the range is optional and is preferably set to where halftone disturbance occurs.

When the image having intensity levels 128 and 127 is scrolled from the right to the left as shown in FIG. 10B, intensity levels K(x) at positions x on the retina ar continuous as shown in FIG. 12B, and stimulus L(x) on the retina shosw a peak between intensity levels 128 and 127 as shown in FIG. 12C.

Integrated stimuli for x=2.5 to 3.5, x=3.5 to 4.5, and x=4.5 to 5.5 are L(1), L(2), and L(3), respectively, and are expressed as follows:

$$L(1)=L(3)<<L(2)$$

Due to this, a bright line BL appears between intensity levels 128 and 127.

If an image is displayed with green subpixels displaying intensity levels 128 and 127, respectively and a red subpixel displaying intensity level 64 and if the image is moved from the right to the left, a dark line appears between the green subpixels. At this time, the red subpixel keeps intensity level 64 because it has no intensity level boundary. The human eye combines these subpixels and sees a red color in the green dark line, to thereby cause a false contour.

This phenomenon frequently occurs on an image displayed with a flesh color with smoothly changing intensity levels. For example, red and green false contours appear along a flesh-colored cheek when a person displayed on a screen looks back.

To solve this problem, the inventors of the present invention has proposed in Japanese Patent Application No. 8-198916 a method of and an apparatus for displaying halftone images by adding a corrective pulse that turns on or off a corresponding subframe to adjust an intensity level.

FIGS. 13A to 13I explain the method proposed in this prior art.

Figure 13A:
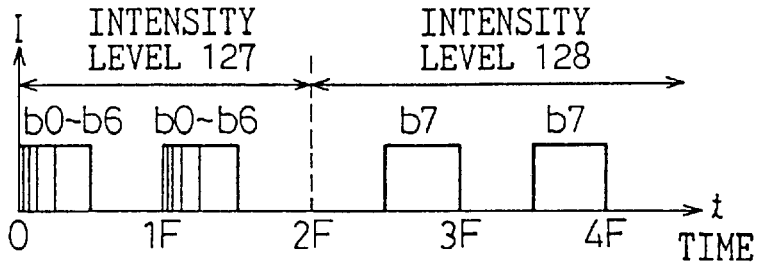
Fig.13A PRIOR ART
FIGS. 13A to 13I show a method of displaying a halftone image according to a prior art.

FIG. 13A shows the emission intensity I(t) of a pixel that displays intensiy level 127 and then 128. An abscissa represents time. Frames 1F and 2F display intensity level 127, and frames 3F and 4F display intensity level 128.

Figure 13B:
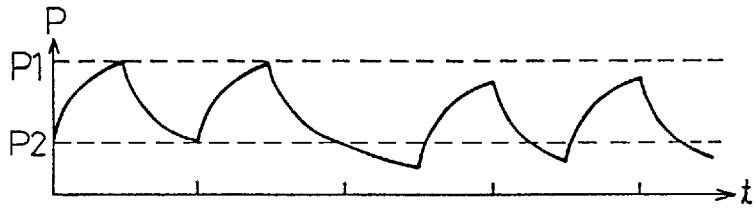
Fig.13B PRIOR ART

FIG. 13B shows stimulus P(t) on the retina of the human eye in response to the emission intensity I(t). The stimulus P(t) periodically changes between P1 and P2 while the pixel is displaying intensity level 127. At the start of the frame 3F to display intensity level 128, the stimulus drops below P2. When some frames that follow the frame 3F continuously display intensity level 128, the stimulus again oscillates between P1 and P2.

Figure 13C:
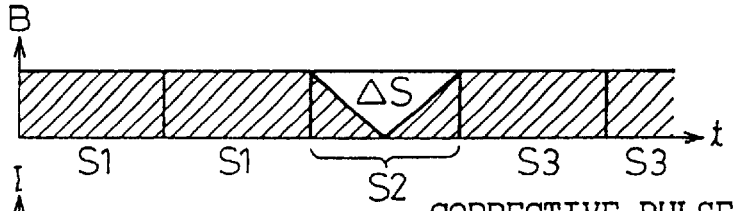
Fig.13C PRIOR ART

The temporary drop in the stimulus P on the retina causes halftone distrubance. FIG. 13C shows visual intensity B(t) that is an integral of the stimulus P(t) for an afterimage time. If S1<S2<S3, no disturbance is observed in the halftone image. The example of FIG. 13C does not satisfy this condition. As a result, a dark part is observed between intensity levels 127 and 128. If ΔS is added to S2 to realize S1<S2+ΔS<S3, no disturbance is observed in the halftone image.

Figure 13D:
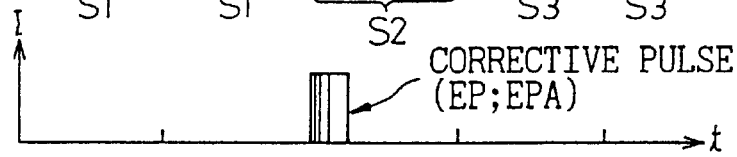
Fig.13D PRIOR ART
Figure 13E:
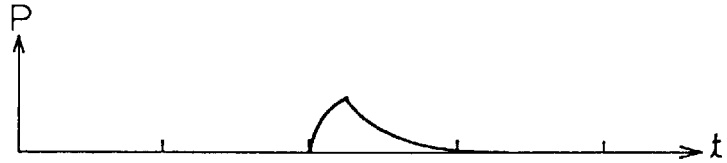
Fig.13E PRIOR ART
Figure 13F:
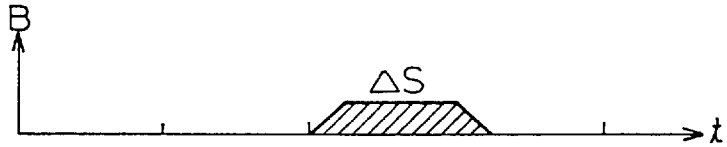
Fig.13F PRIOR ART
Figure 13G:
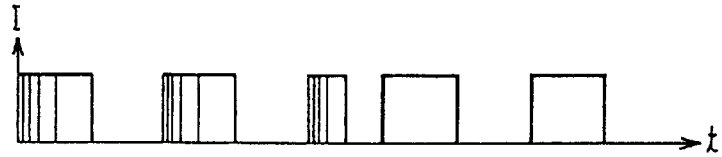
Fig.13G PRIOR ART
Figure 13H:
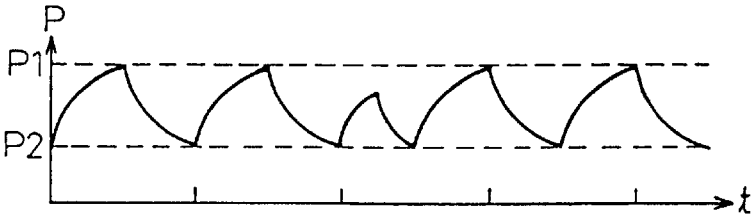
Fig.13H PRIOR ART
Figure 13I:
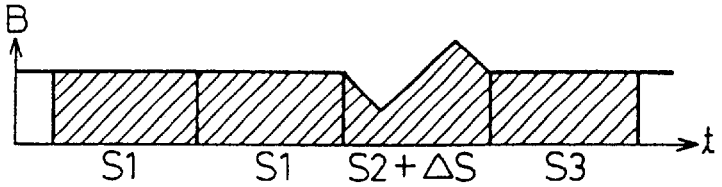
Fig.13I PRIOR ART

Accordingly, the related art applies a corrective pulse (equilizing pulse) EP as shown in FIG. 13D. FIG. 13E shows stimulus P(t) on the retina due to the corrective pulse EP that turns on a corresponding subframe. FIG. 13F shows visual intensity B(t) due to the corrective pulse EP. FIGS. 13G, 13H, and 13I show emission intensity I(t), stimulus P(t) on the retina, and visual intensity B(t), respectively, due to the corrective pulse EP.

It is apparent from a comparison between FIGS. 13C and 13I that the corrective pulse EP reduces disturbance in the visual intensity. The corrective pulse EP may be negative (EPS) to reduce the intensity level.

Figure 14:
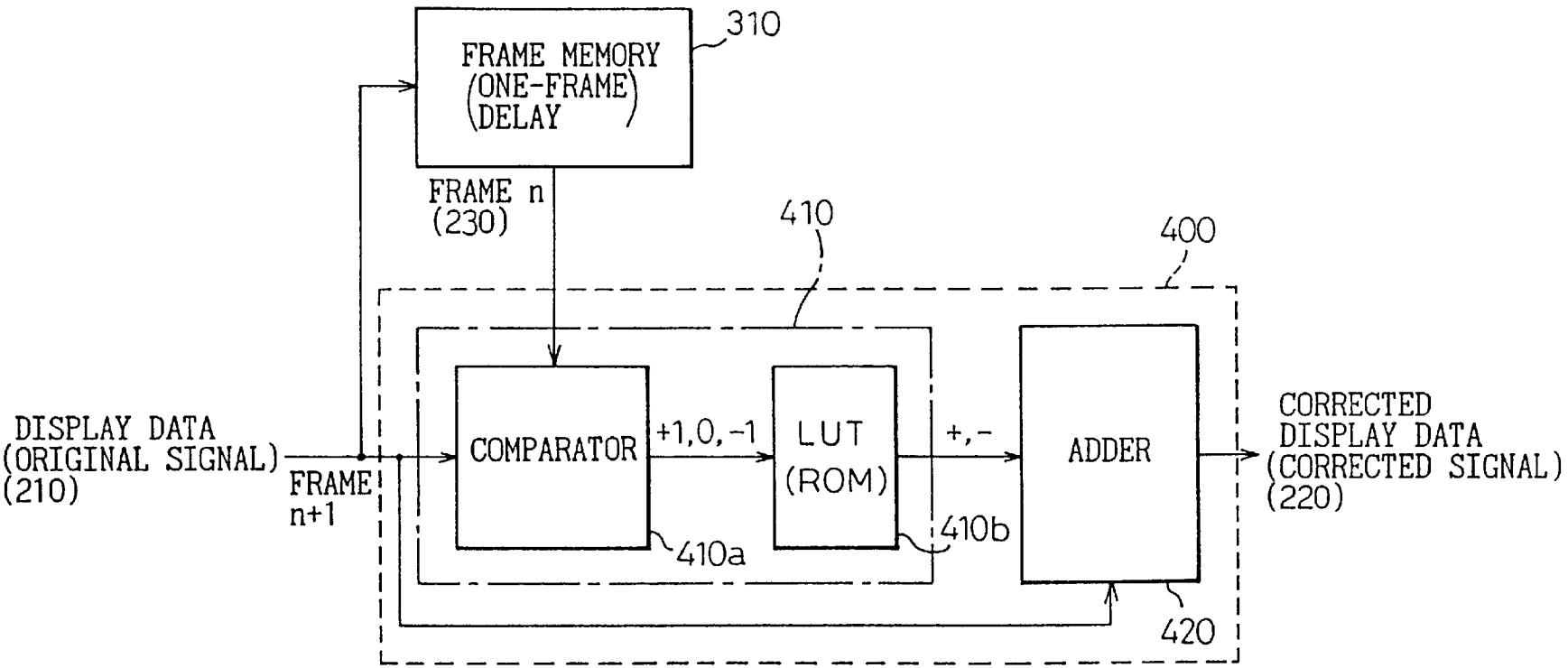
Fig.14 PRIOR ART
FIG. 14 shows a circuit for inserting a corrective pulse for adjusting an intensity level according to the prior art.

FIG. 14 shows a circuit for inserting a corrective pulse for adjusting an intensity level according to the prior art. The circuit has a frame memory 310 and an addition circuit 400. The frame memory provides a delay of a vertical synchronous period. The addition circuit 400 has a tester 410 and an adder 420.

The tester 410 has a comparator 410*a* and a lookup table 410*b*, which may be a ROM. The comparator 410*a* compares each bit in a frame n with a corresponding bit in the next frame n+1. The comparator 410*a* provides +1 for any bit that shows a change from ON to OFF, −1 for any bit that shows a change from OFF to ON, and 0 for any bit that is unchanged.

The lookup table 410*b* provides a corrective pulse in response to the output of the comparator 410*a*. This corrective pulse may be positive, negative, or nil.

The adder 420 adds the corrective pulse to original data 210 and provides corrected display data 220.

The related art is advantageous in that it realizes a given intensity level on the human eye. In FIG. 13I, the total of S2+ΔS is nearly equal to S1 or S3 although there is a temporal fluctuation therein. Accordingly, the halftone image is visible without disturbance if it is seen away from the display.

The related art is effective to stabilize still and moving images. However, it is unsatisfactory on fast-moving images.

Figure 15:
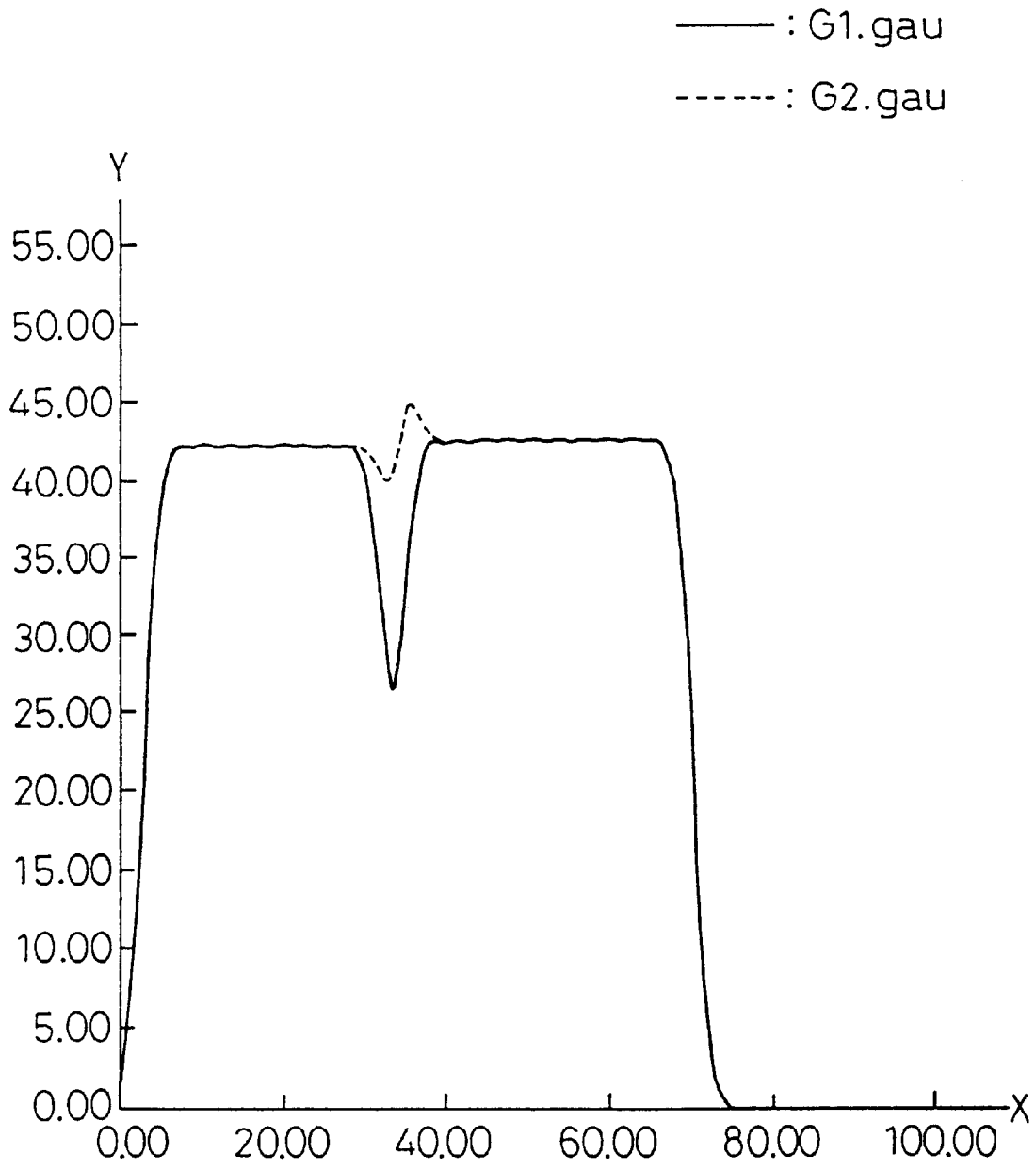
Fig.15 PRIOR ART
FIG. 15 shows simulation results of moving an image leftward at 1 pixel per frame with and without a correction based on the prior art.
Figure 16:
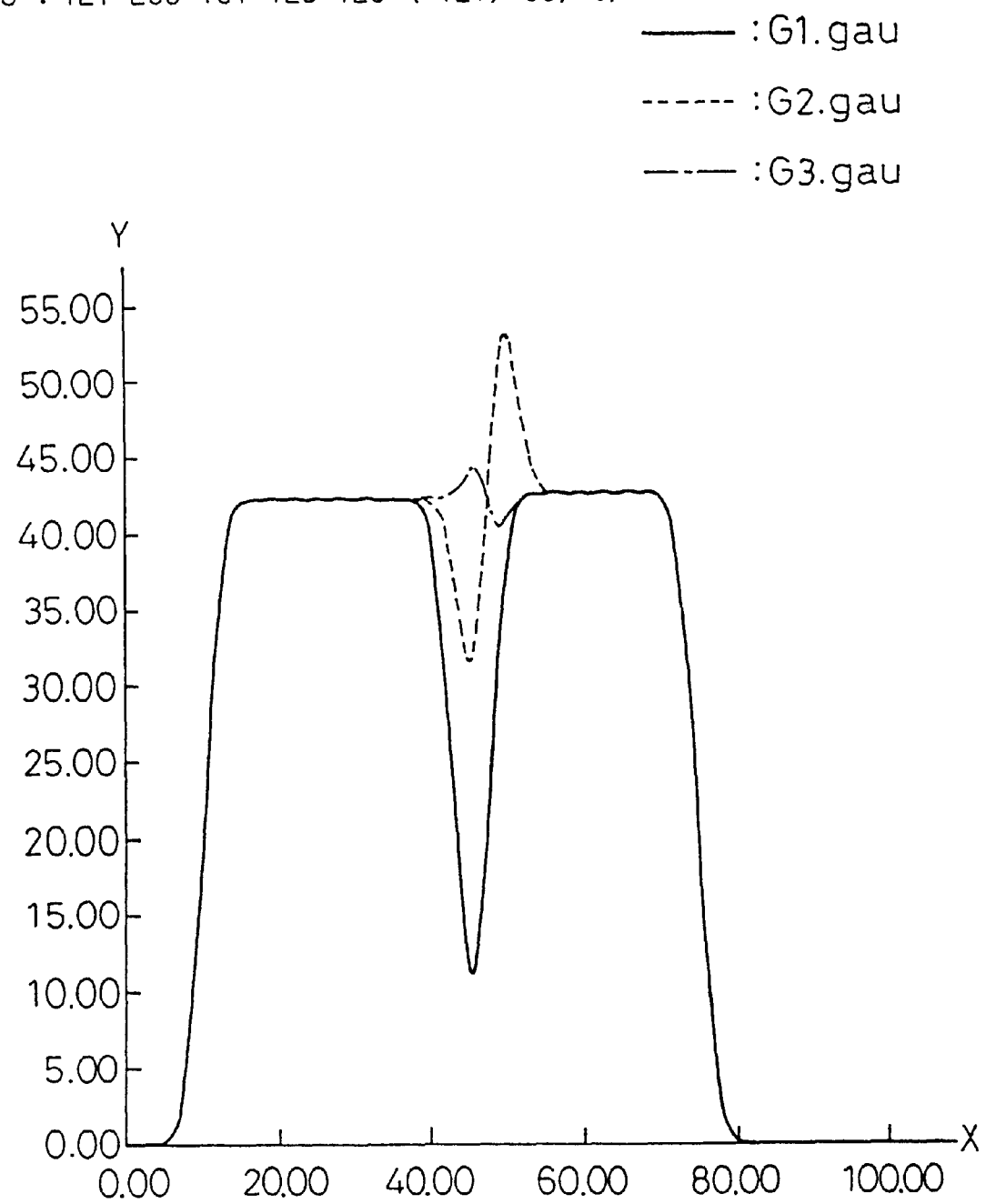
FIG. 16 shows simulation results of moving an image leftward at 3 pixels per frame with and without corrections based on the related art and the present invention.
Figure 17:
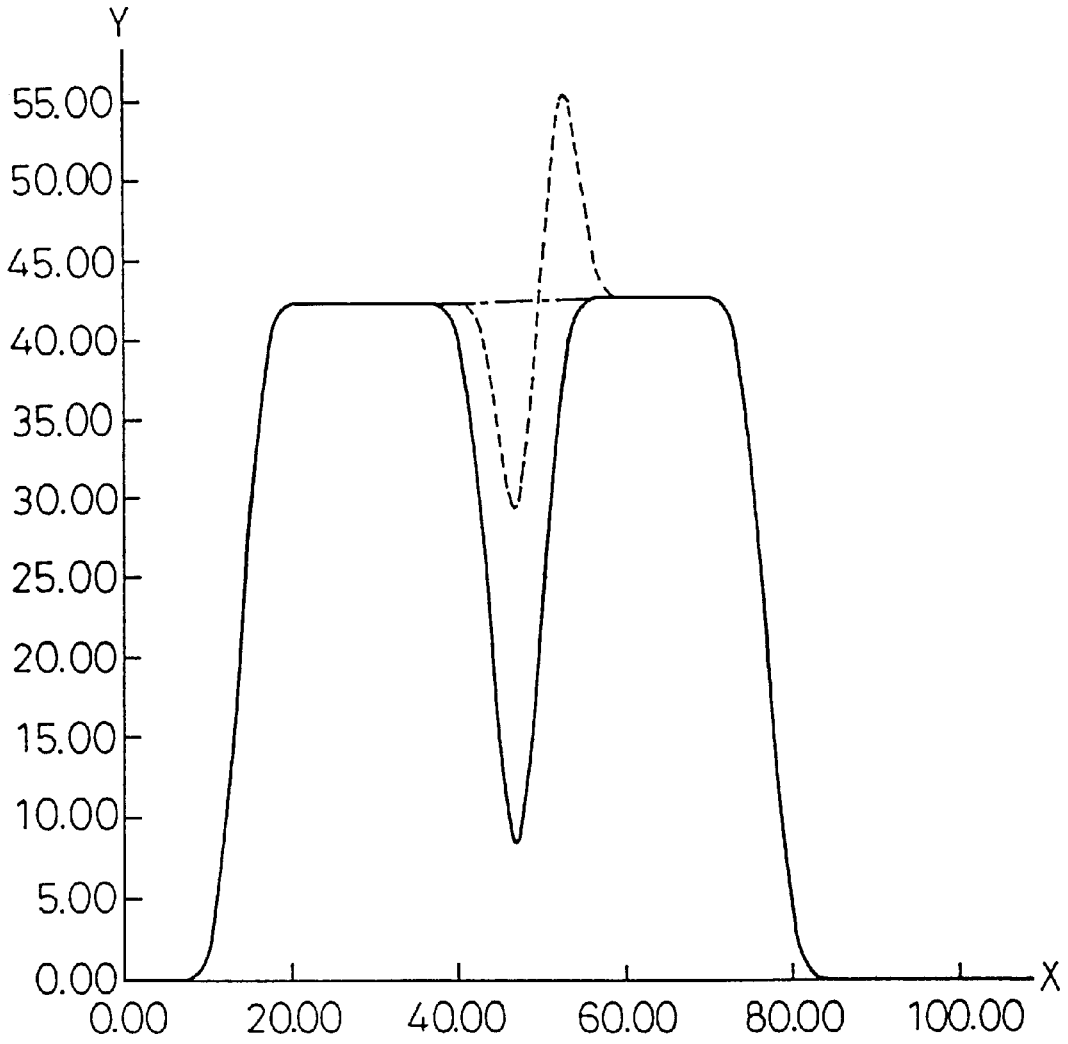
FIG. 17 shows simulation results of moving an image leftward at 4 pixels per frame with and without corrections based on the related art and the present invention.
Figure 18:
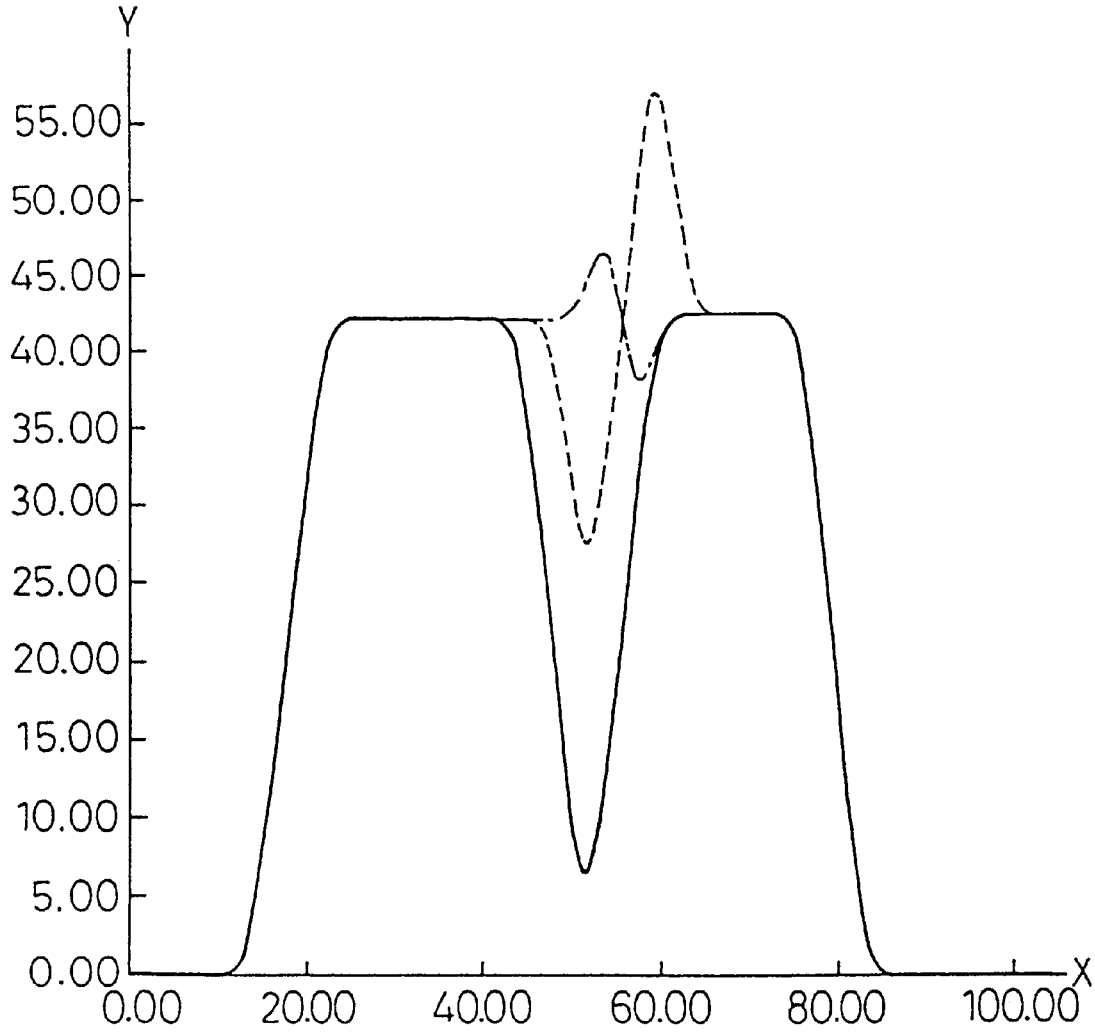
FIG. 18 shows simulation results of moving an image leftward at 5 pixels per frame with and without corrections based on the related art and the present invention.
Figure 19:
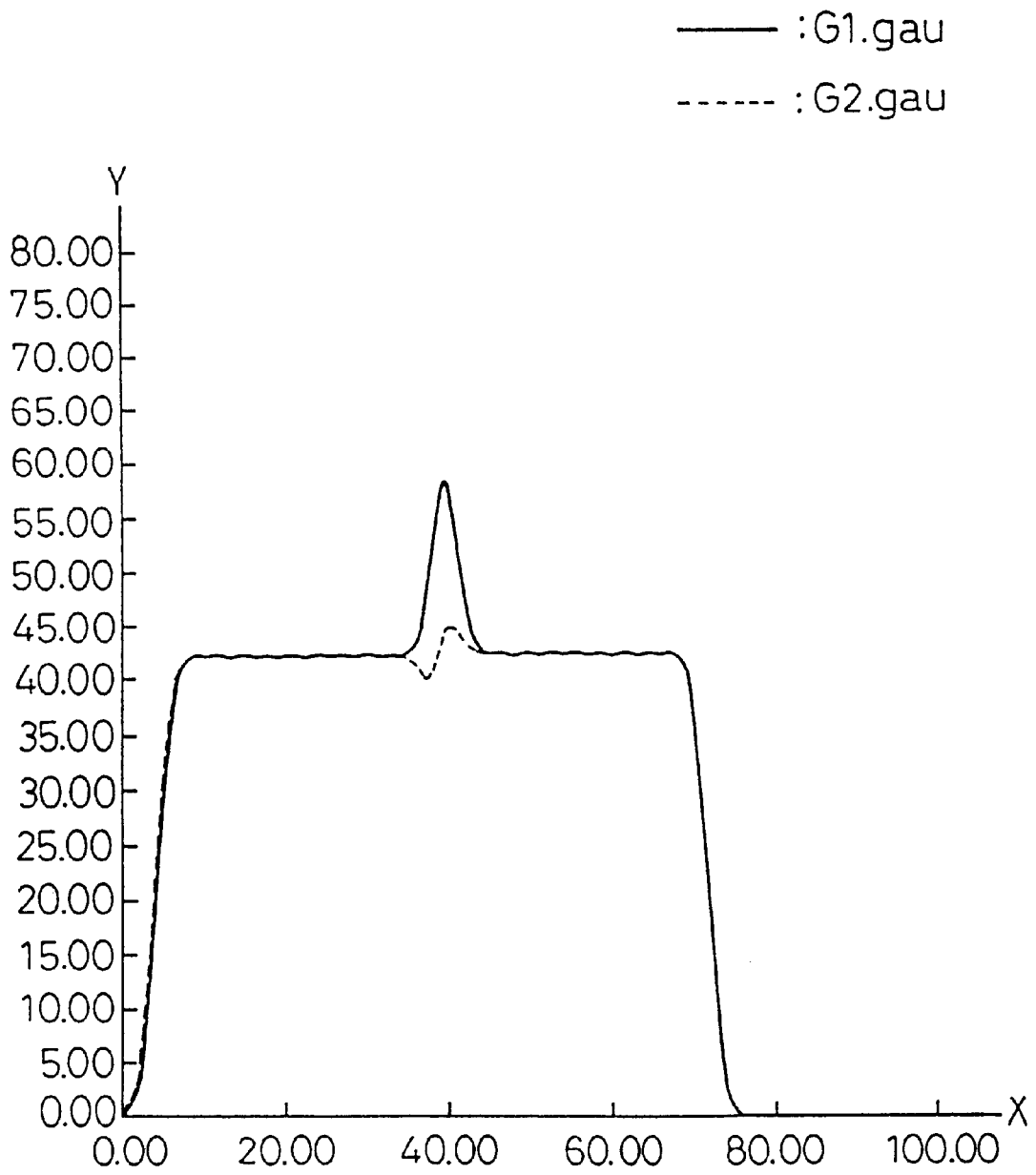
Fig.19 PRIOR ART
FIG. 19 shows simulation results of moving an image rightward at 1 pixel per frame with and without a correction based on the prior art.
Figure 20:
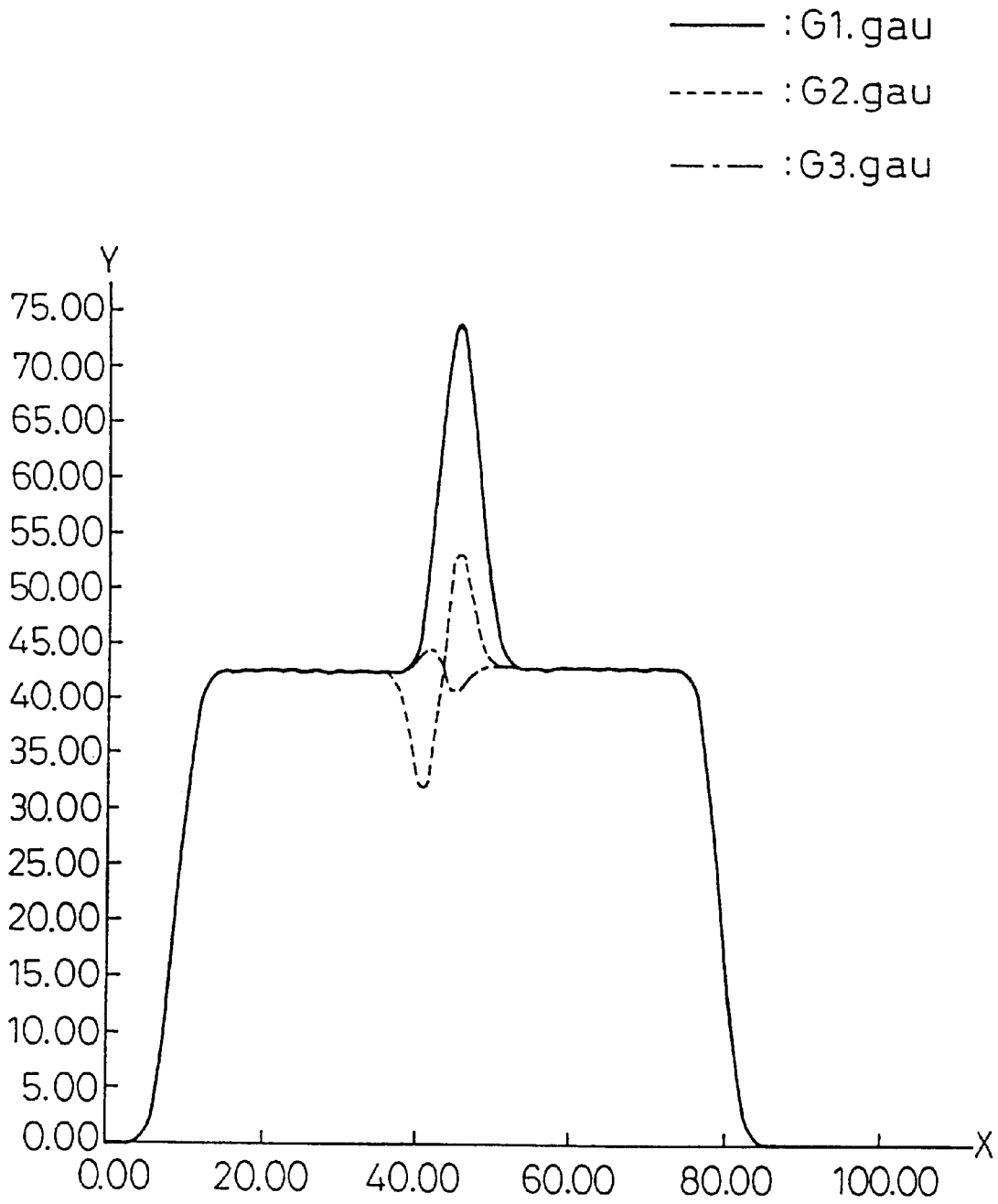
FIG. 20 shows simulation results of moving an image rightward at 3 pixels per frame with and without corrections based on the related art and the present invention.
Figure 21:
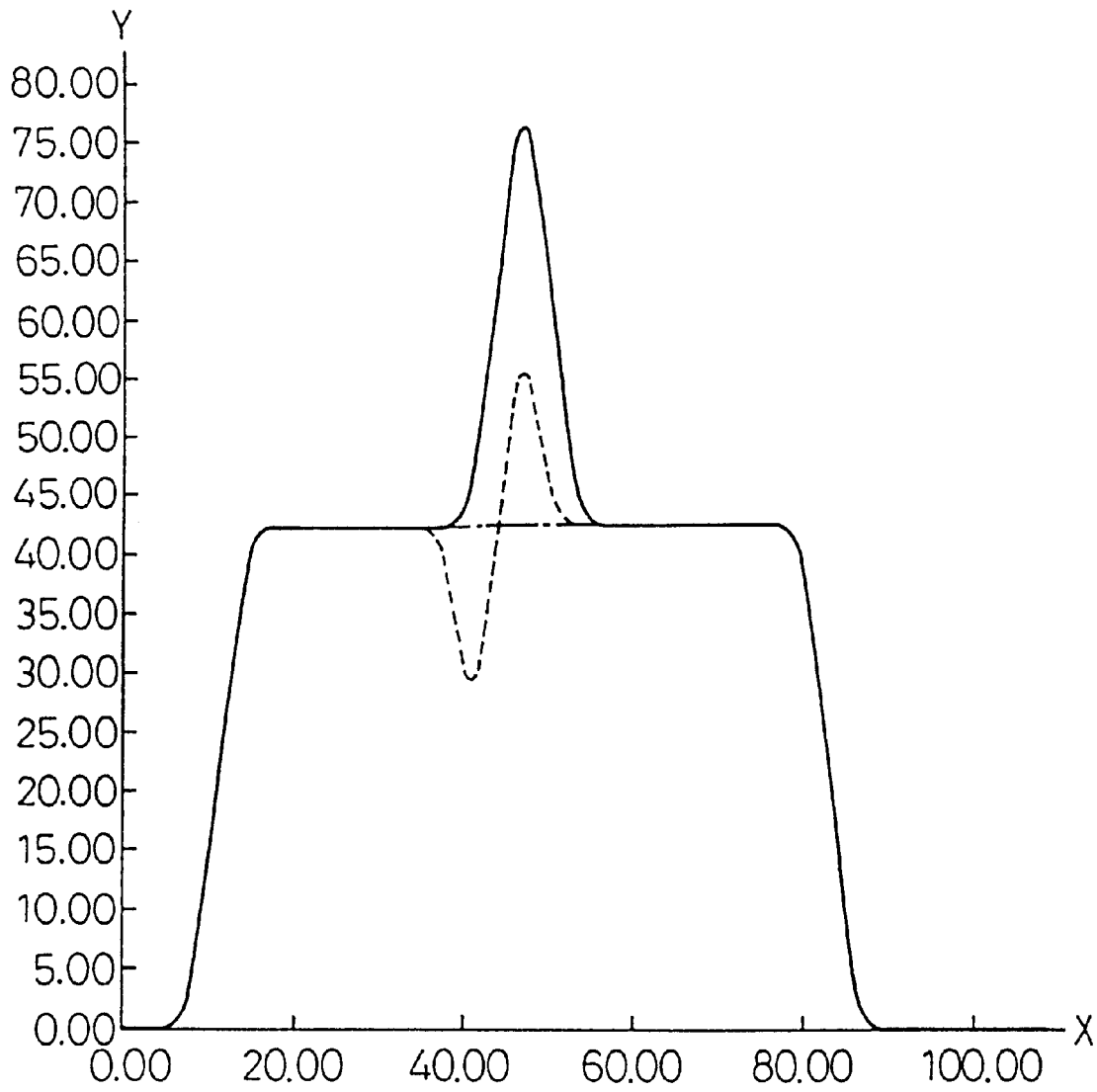
FIG. 21 shows simulation results of moving an image rightward at 4 pixels per frame with and without corrections based on the related art and the present invention.
Figure 22:
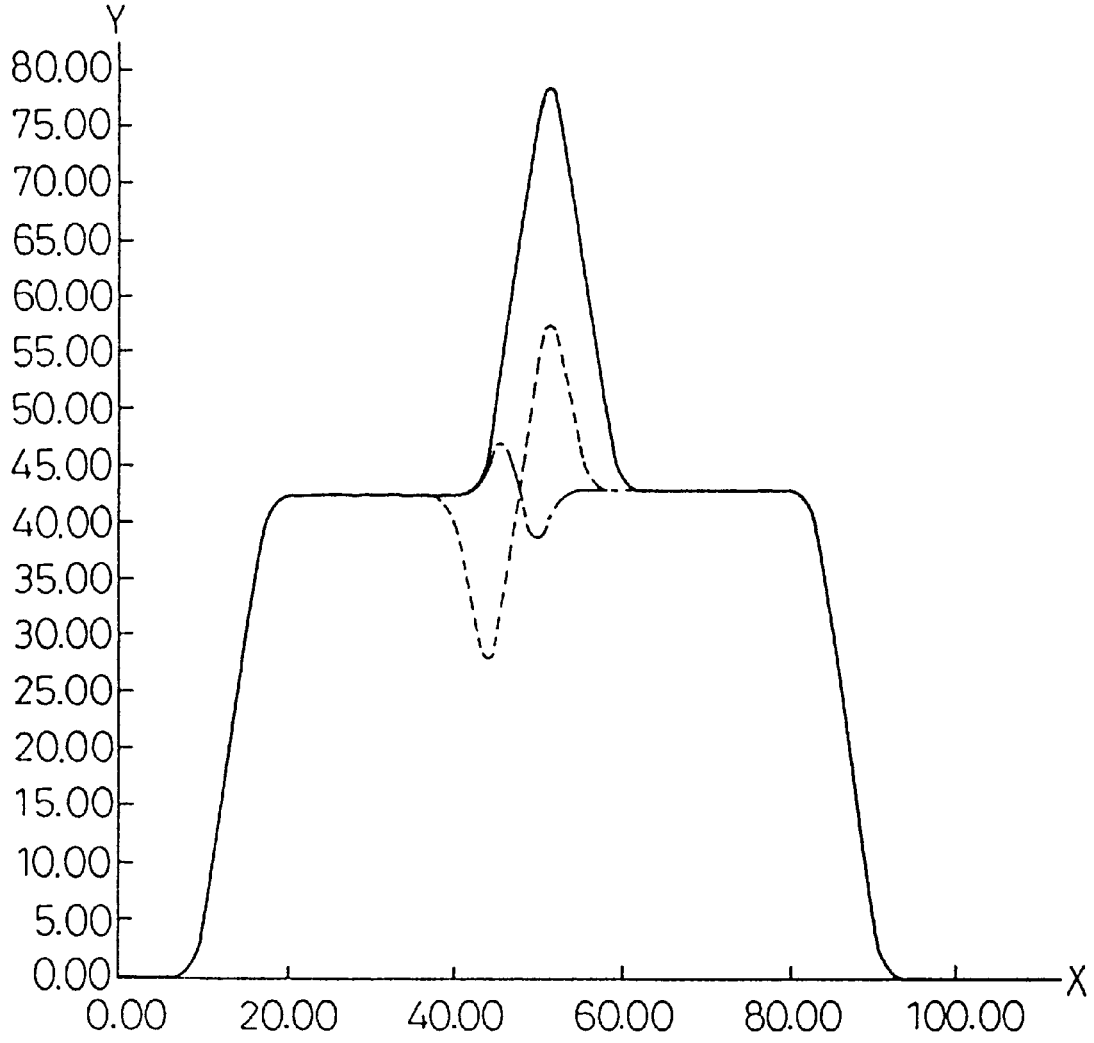
FIG. 22 shows simulation results of moving an image rightward at 5 pixels per frame with and without corrections based on the related art and the present invention.

FIGS. 15 to 22 show results of stimulations of moving an image on a screen at different speeds. FIGS. 15 and 19 move the image leftward and rightward at a pixel pre frame, FIGS. 16 and 20 at 3 pixels per frame, FIGS. 17 and 21 at 4 pixels per frame, and FIGS. 18 and 22 at 5 pixels per frame. In each simulation, a left half of the displayed image has intensity level 127, and a right half thereof has intensity level 128. In each simulation, a continuous line is without a corrective pulse, and a dotted line is with a corrective pulse according to the related art. An ordinate represents intensity and an abscissa positions on the retina. A dot-dash line is with a corrective pulse according to the present invention.

In FIGS. 15 and 19, the image is moved at a slow speed of a pixel per frame. Each pixel consists of three subpixels. In this case, a positive or negative corrective pulse according to the related art is sufficient to prevent halftone disturbance. If no corrective pulse is applied, negative disturbance of FIG. 15 or positive disturbance of FIG. 19 will occur. The corrective pulses cancel these disturbances.

As shown in FIGS. 16 to 20 and 18 to 22, the higher the moving speed, the worse the halftone disturbance. In particular in FIGS. 16 and 22, the image moving at 5 pixels per frame is the worst.

Next, preferred embodiments of the present invention will be explained with reference to FIGS. 23A to 60B.

Figure 23A:
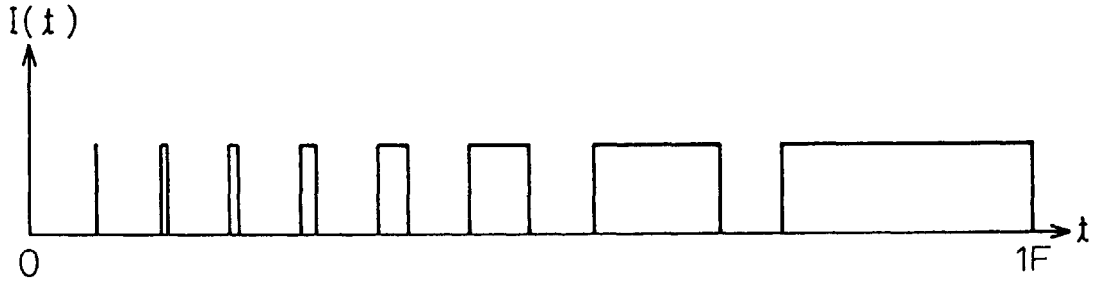
FIG. 23A shows a technique of displaying an image with separate addressing and sustain periods.
Figure 23B:
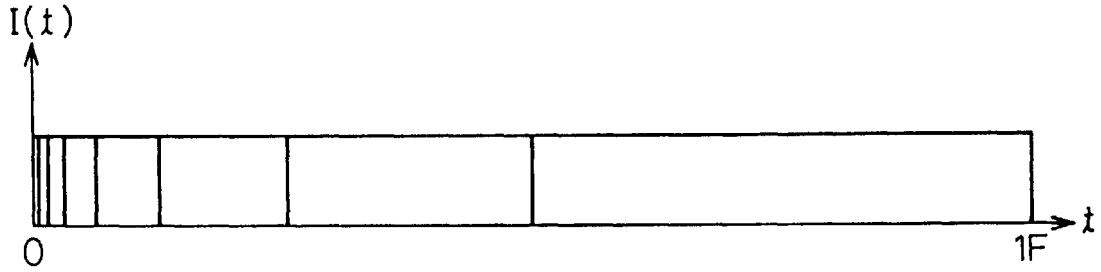
FIG. 23B shows a technique of displaying an image with distributed addressing and sustain periods.

FIG. 23A corresponds to FIG. 1 and shows a technique of displaying an image with separate addressing and sustain periods. FIG. 23B shows a techinque of displaying an image with distributed addressing and sustain periods. These techniques divide a frame into subframes, and the present invention is applicable to any one of the techniques.

Figure 24:
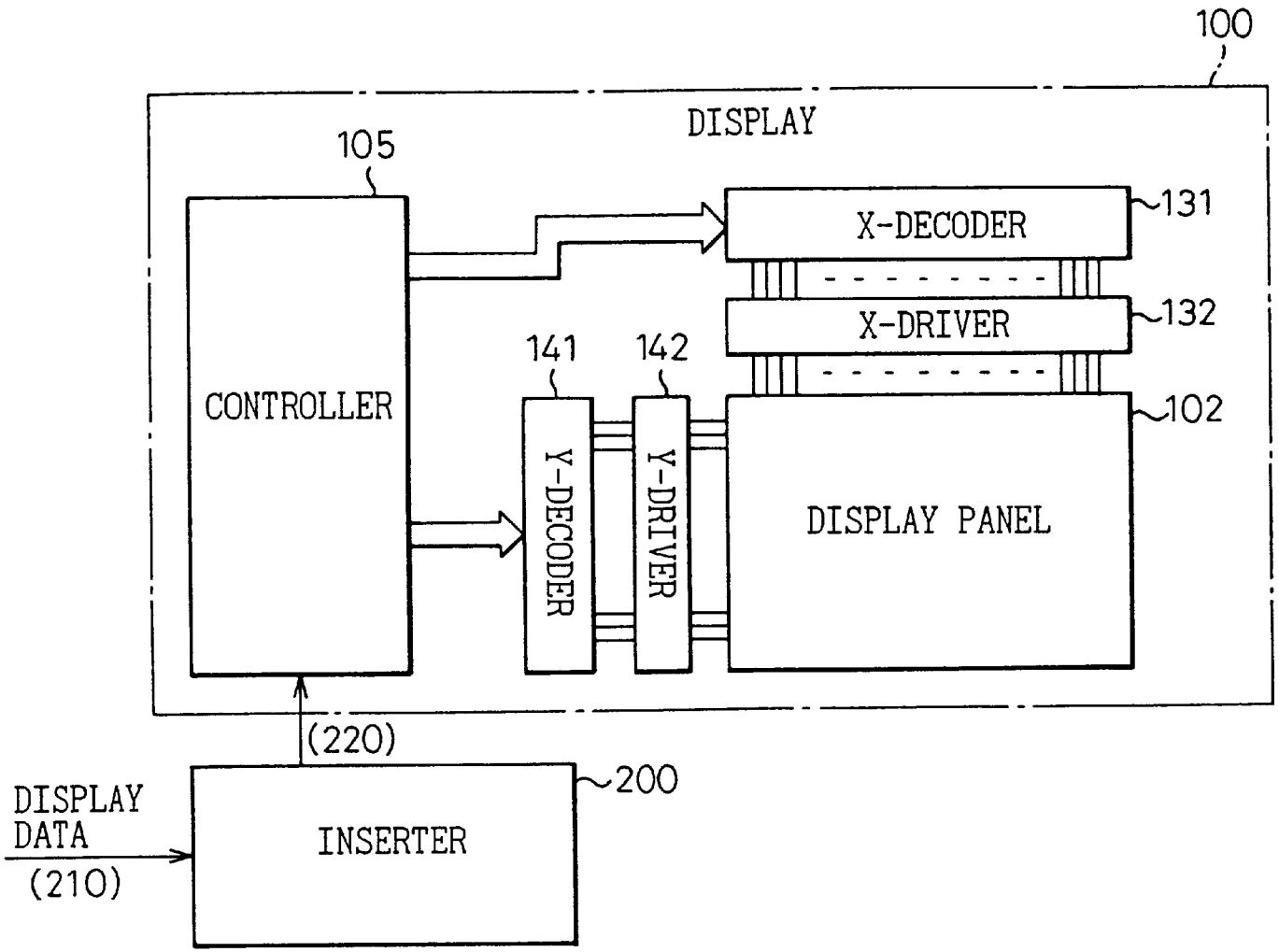
FIG. 24 shows a display according to the present invention.

FIG. 24 shows a display according to the present invention. The display 100 is connected to an inserter 200 for inserting a corrective pulse for adjusting an intensity level.

The display 100 has a display panel 102, and x-decoder 131, an x-driver 132, a y-decoder 141, a y-driver 142, and a controller 105 for controlling the x- and y-drivers 131 and 141.

A frame of an image is divided into subframes and is displayed on the display panel 102. Each subframe is made of an addressing period and a sustain period. The display 100 may be a plasma display, a DMD (digital micromirror device), an EL (electro luminescence) panel, or any other display that divides a frame into subframes.

The inserter 200 is characteristic to the present invention. The inserter 200 adds a corrective pulse for adjusting an intensity level to original display data 210 and provides the display 100 with corrected display data 220.

The present invention maintains the total intensity level achieved by corrective pulses applied to pixels and individually weights the corrective pulses to average the intensity levels of the pixels. The present invention minimizes halftone disturbance without changing brightness.

FIGS.25 to 28B show a method of displaying a halftone image according to an embodiment of the present invention. The embodiment adds weighted positive corrective pulses to original display data. The embodiment divides each frame of an image into eight subframes SF0 to SF7.

Figure 25:
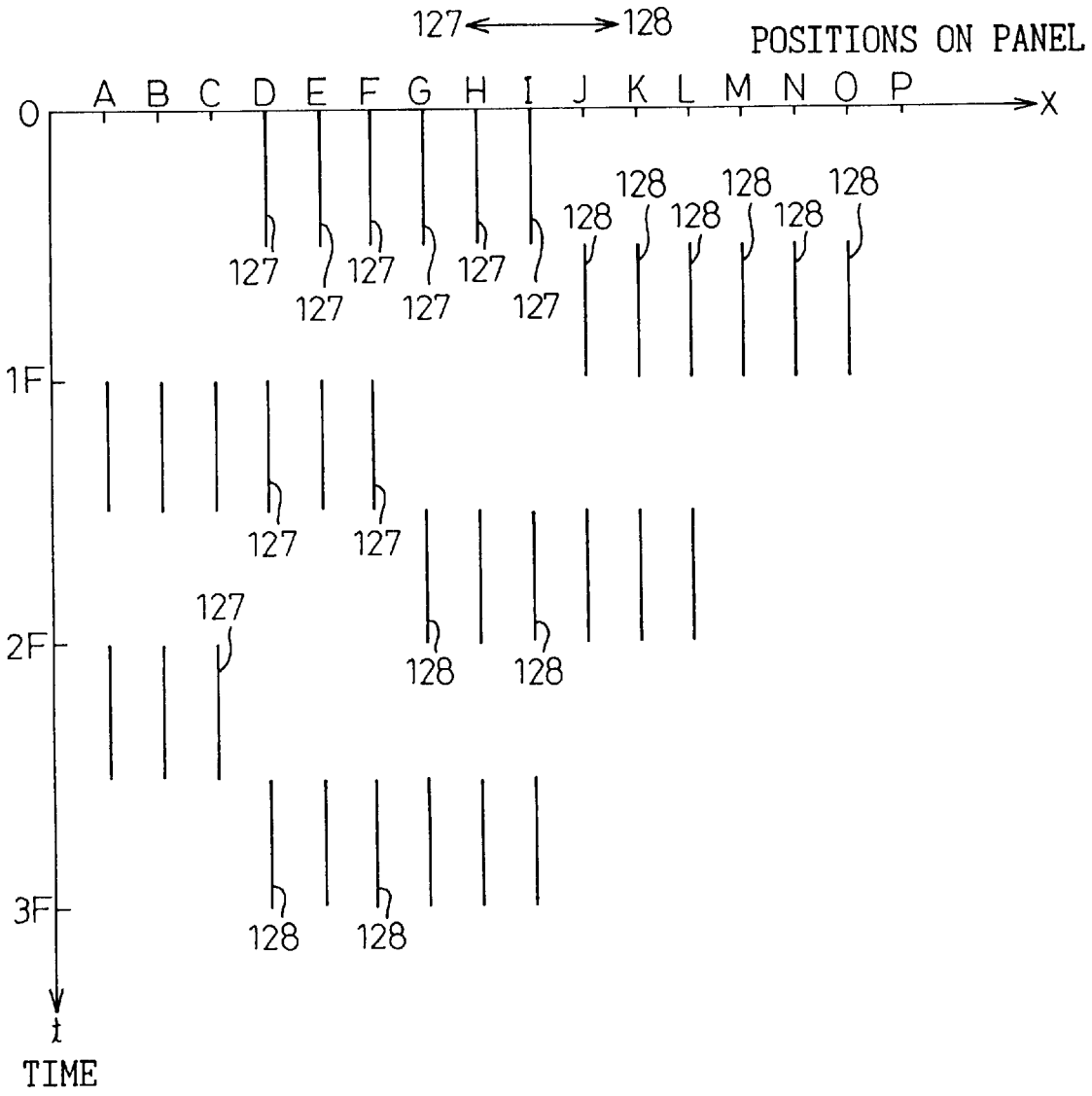
FIG. 25 shows a halftone image on a display panel.

In FIG. 25, an image is moved to the left at a speed of 3 pixels per frame. An ordinate represents time t and frames, 1F, 2F, 3F, and so on, and an abscissa represents horizontal positions of pixels A, B, C, and so on, on the display panel. For the sake of simplicity, the display panel is monochrome. In the case of a color display, each pixel consists of red, green, and blue subpixels. The area of each pixel is sufficiently small. Each vertical line in FIG. 25 indicates the light emission state of a pixel.

In the first frame (0≦t<1F), pixels A to C and P are OFF, pixels D to I display intensity level 127, and pixels J to O display intensity level 128. In the first hald of the first frame, the pixels D to I emit light, and in the second half of the first frame, the pixels J to O emit light. In the second frame (1F≦t<2F), the pixels A to F display intensity level 127, and the pixels G to L display intensity level 128. In the first half of the second frame, the pixels A to F emit light, and in the second half of the second frame, the pixels G to L emit light. These light emission operations are repeated.

If every horizontal line displays the pattern of FIG. 25, a viewer will see vertical stripes on the screen. The left half of each stripe consists of six pixels of intensity level 127, and the right half thereof consists of six pixels of intensity level 128. The stripes move to the left at three pixels per frame. Although the stripes are displayed intermittently, the human eyes sees that the stripes are smoothly moveing, and the center of the retina follows the stripes.

Figure 26A:
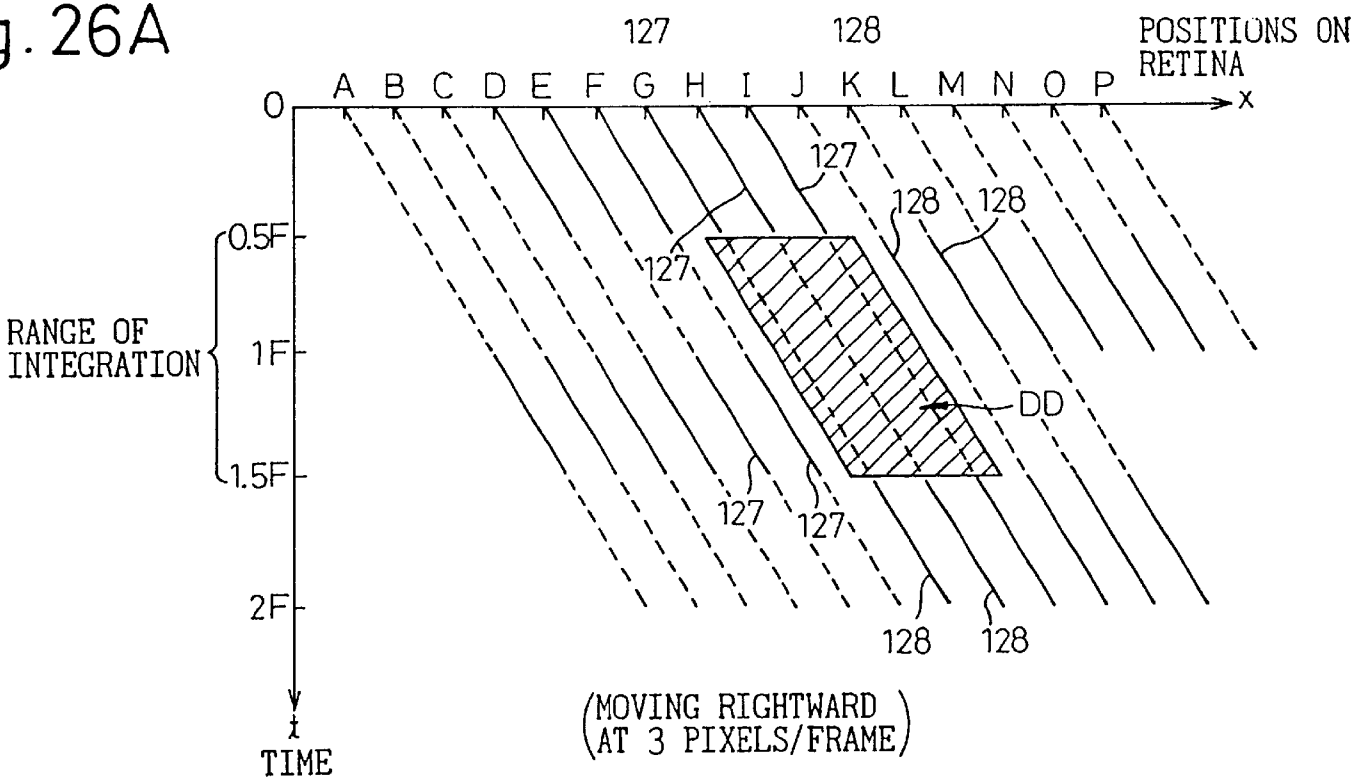
FIGS. 26A and 26B show the image of FIG. 25 projected on the retina of a human eye without correction.

FIG. 26A shows retina positions x on an abscissa. When the image moves to the left, the eye follows it. Accordingly, pixels projected on the retina move to the right. In FIG. 26A, each pixel projected on the retina moves along an oblique line. Intensity level 127 is on the left side, and intensity level 128 is on the right side. The pixels A to P projected on the retina at time t=0 move to the right as time passes.

Figure 26B:
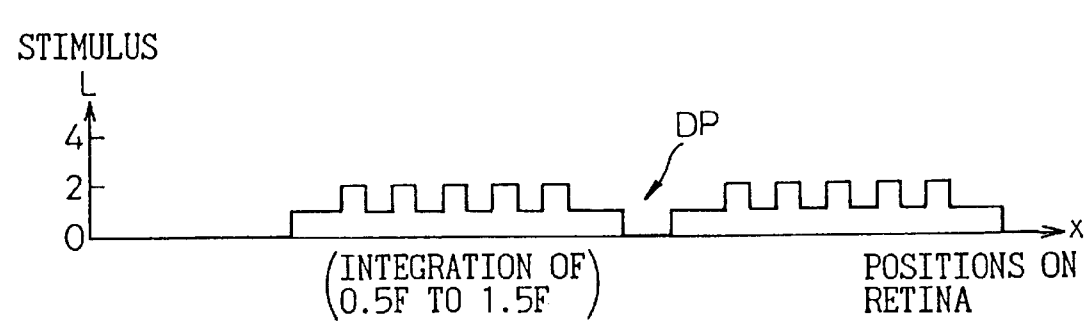

FIG. 26B shows stimulus on the retina. the stimulus is calculated by integrating light emission for a frame period of 0.5F to 1.5F. The same is applied to FIGS. 27A to 28B.

In FIG. 26B, a dark part DP appears between intensity levels 127 and 128. In the period, the pixels G, H, and I change from 127 to 128 in intensity level between the first and second frames, to produce a frame period DD that emits no light. This is the dark part DP.

Figure 27A:
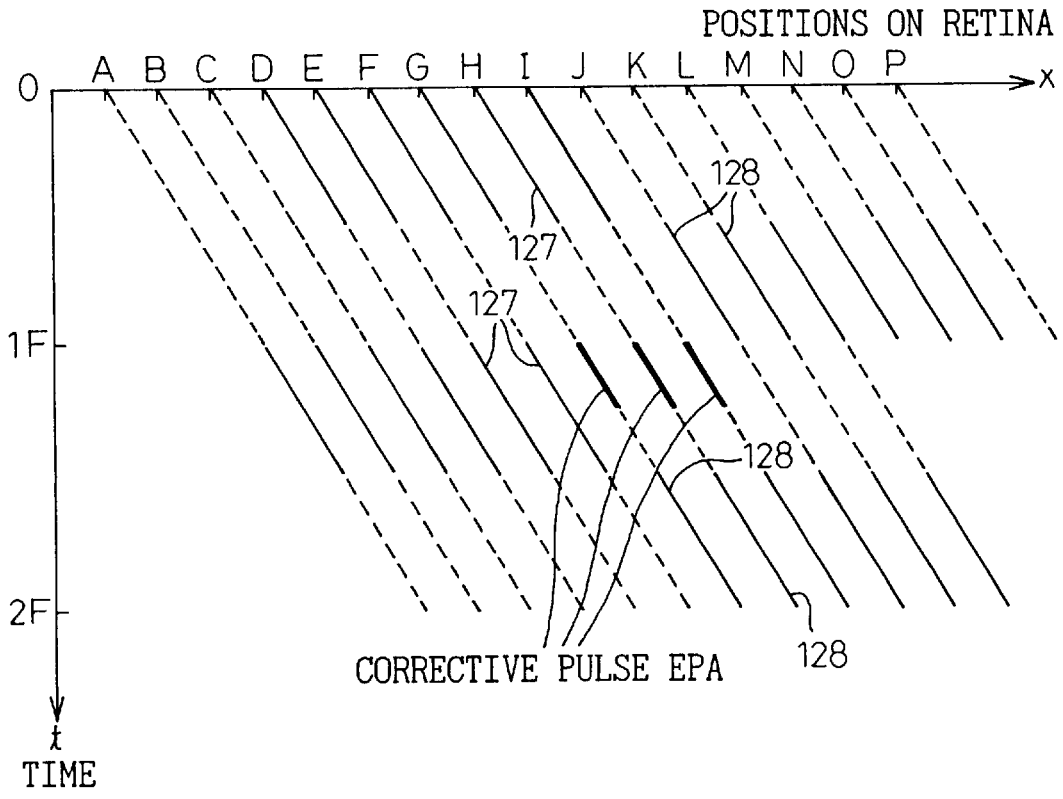
FIGS. 27A and 27B show the image of FIG. 25 projected on the retina and corrected according to the related art.

Accordingly, corrective pulses must be applied to the pixels G, H, and I. FIG. 27A shows the related art, which applies a corrective pulse EPA to each of the pixels G, H, and I. The corrective pulse EPA may correspond to intensity level 63.

Figure 27B:
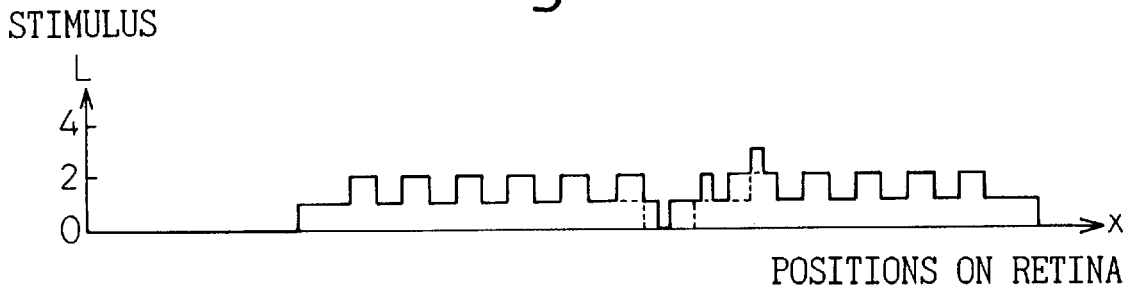

FIG. 27B shows an improvement in the stimulus on the retina due to the corrective pulse EPA on the pixels G, H, and I. Comparison of FIGS. 26B and 27B tells the effect of the related art. A dark part in intensity level 127 and a bright part in intensity level 128 cancel each other to make disturbance negligible if the image is seen away from the display panel.

However, if the image is seen closely, the dark and bright parts will be recognized. If the image is moved at a higer speed, of 4 or 5 pixels per frame, the dark and bright parts will be more conspicuous as shown in the simulations of FIGS. 15 to 18.

Figure 28A:
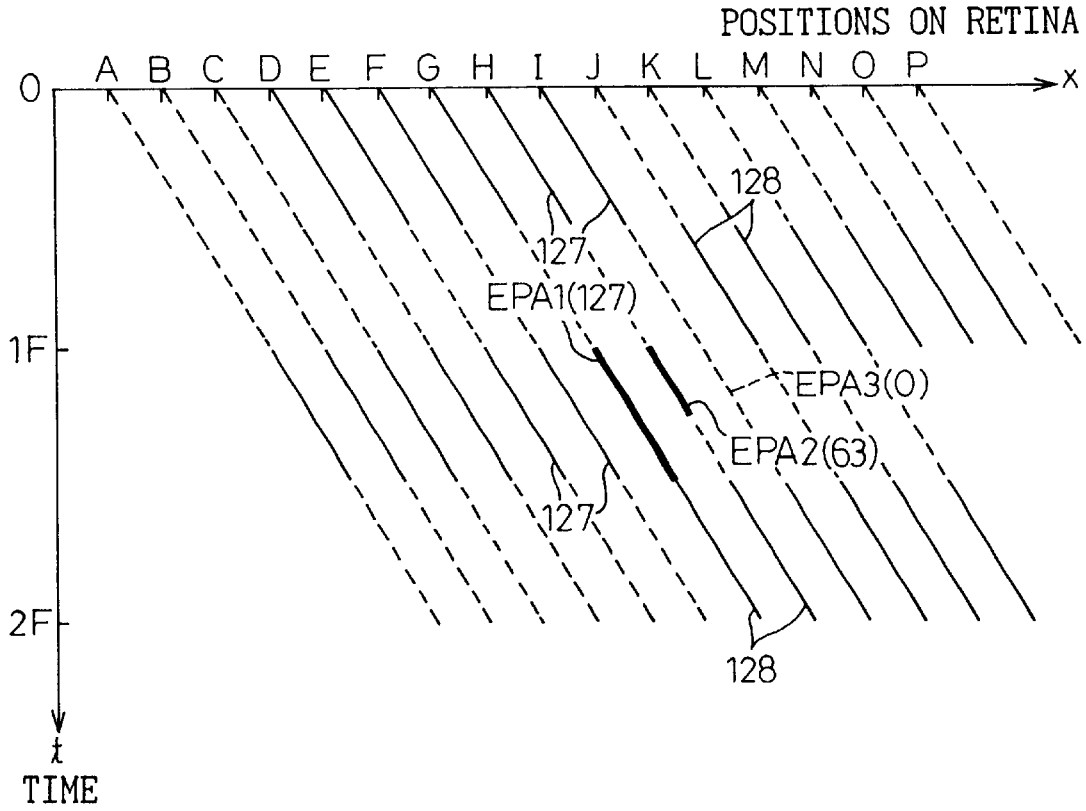
FIGS. 28A and 28B show the image of FIG. 25 projected on the retina and corrected according to the present invention.
Figure 28B:
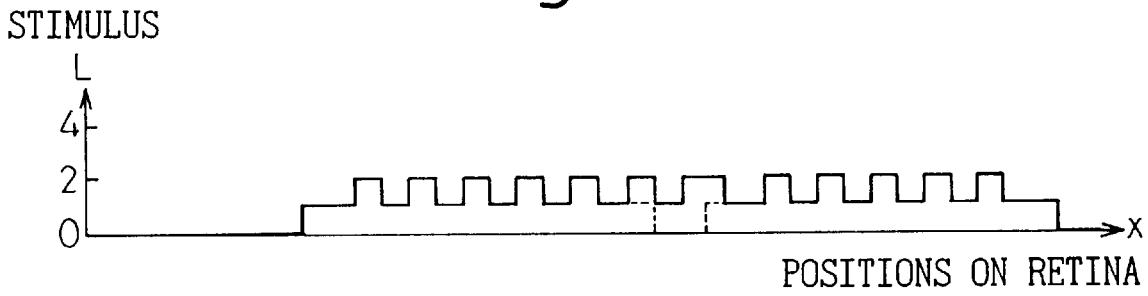

FIGS. 28A and 28B show an example of the present invention employing weighted positive corrective pulses.

In FIGS. 28A, a corrective pulse EPA1 corresponding to intensity level 127 is applied to the pixel G, a corrective pulse EPA2 corresponding to intensity level 63 to the pixel H, and a corrective pulse EPA3 corresponding to intensity level 0 to the pixel I. The total intensity level of the corrective pulses is EPA1+EPA2+EPA3=127+63+0=190. This is substantially equal to the total intensity level of the corrective pulses of the related art of 3×EPA=3×63=189.

A comparison between FIGS. 27B and 28B apparently shows the effectiveness of the present invention.

Figure 29:
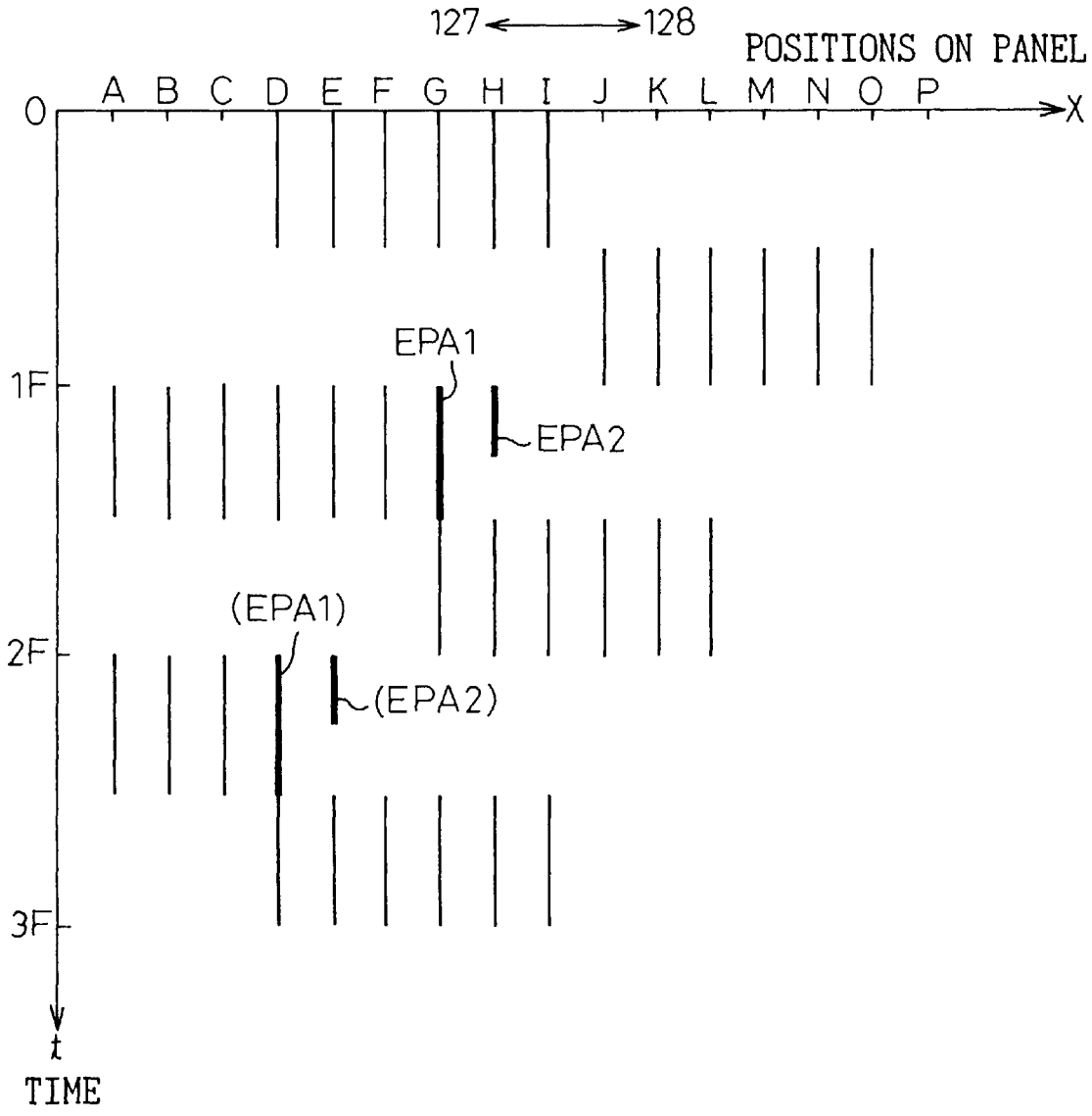
FIG. 29 shows the image of FIG. 25 corrected according to the present invention.
Figure 30:
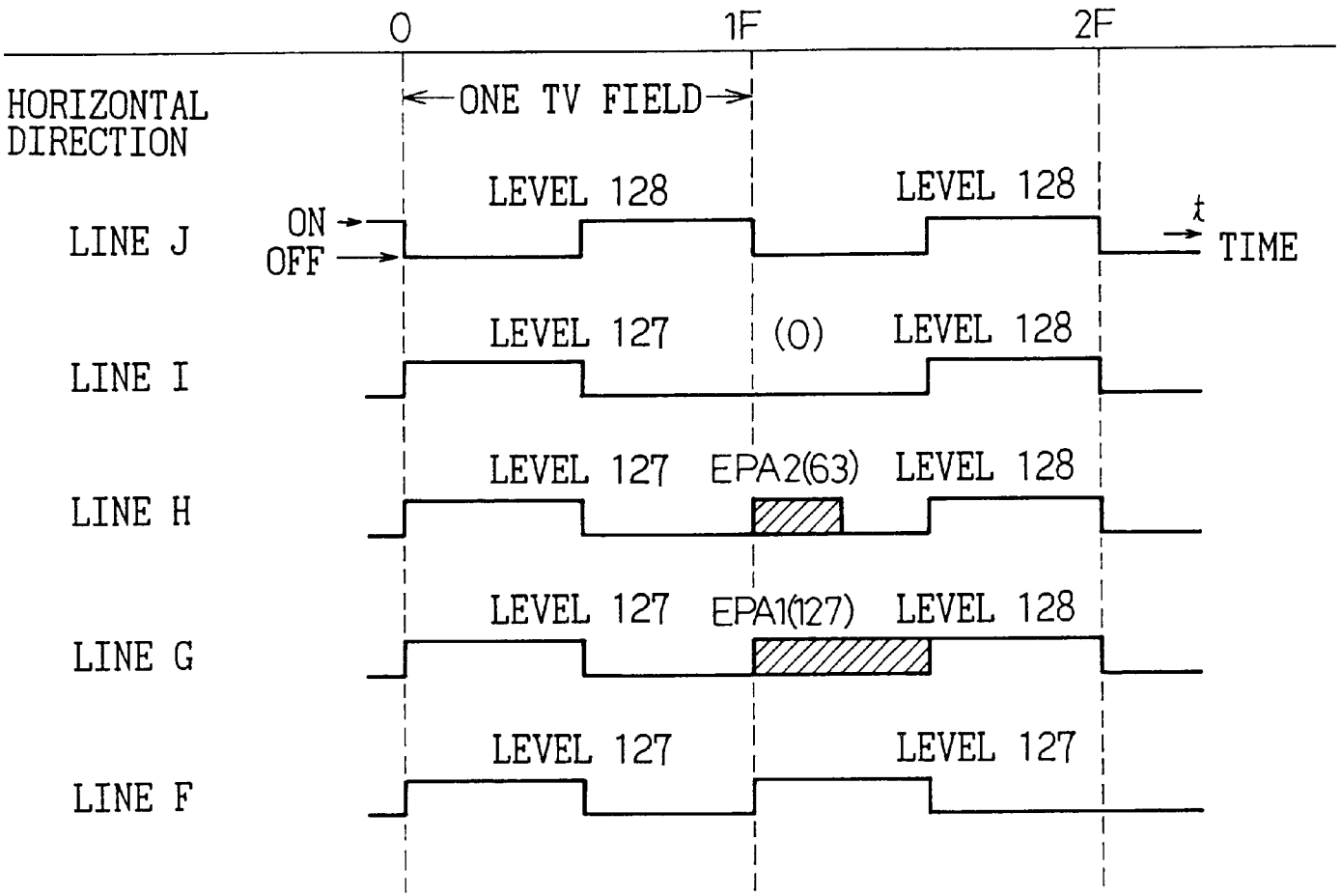
FIG. 30 shows waveforms to realize the light emission patterns of FIG. 29.

FIG. 29 shows the corrective pulses of FIGS. 28A and 28B overlaid on the image shown in FIG. 25. FIG. 30 shows waveforms to realize the light emission of FIG. 29.

The corrective pulse EPA1 realizes intensity level 127 by turning on the subframes SF0 to SF6 and is applied to the pixel G when the intensity level thereof changes from 127 to 128. The corrective pulse EPA2 realizes intensity level 63 by turning on the subframes SF0 to SF5 and is applied to the pixel H when the intensity level thereof changes from 127 to 128. These corrective pulses EPA1 and EPA2 are hatched in FIG. 30. The corrective pulse EPA3 corresponding to intensity level 0 is applied to the pixel I when the intensity level thereof changes from 127 to 128. The corrective pulse EPA3 actually does nothing to the pixel I. In this way, the present invention prevenst disturbance in the halftone image.

Figure 31:
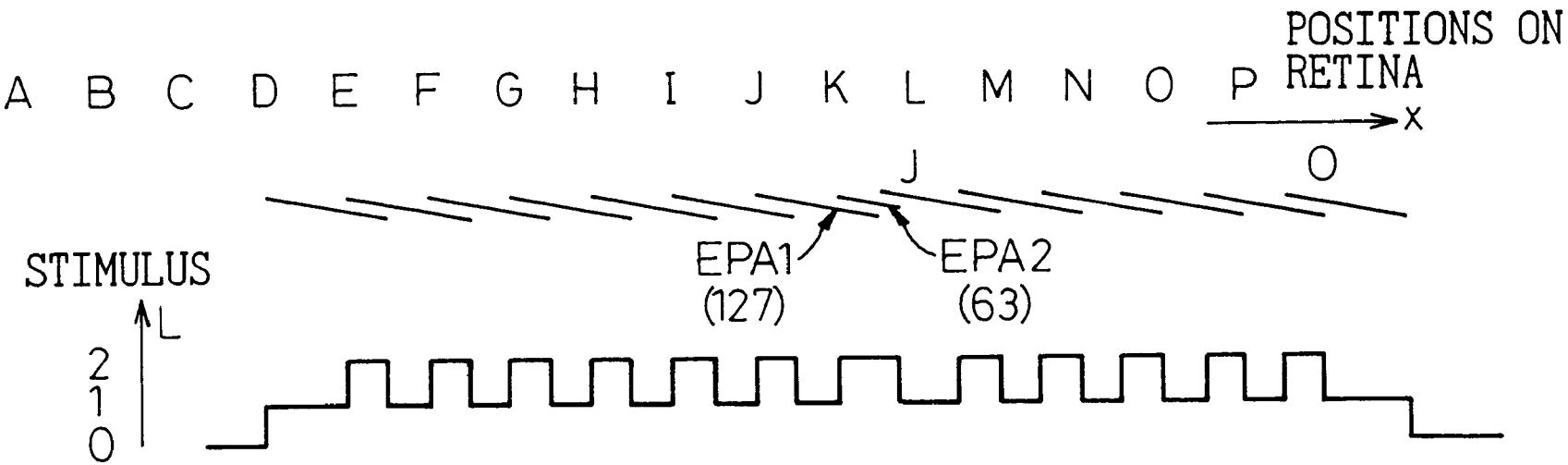
FIG. 31 shows the patterns of FIG. 28A vertically compressed between 0.5 F and 1.5 F.

FIG. 31 shows vertically compressed patterns between 0.5F to 1.5F of FIGS. 28A and 28B. This frame corresponds to any one of frames shown in FIGS. 40A to 44.

Figure 32A:
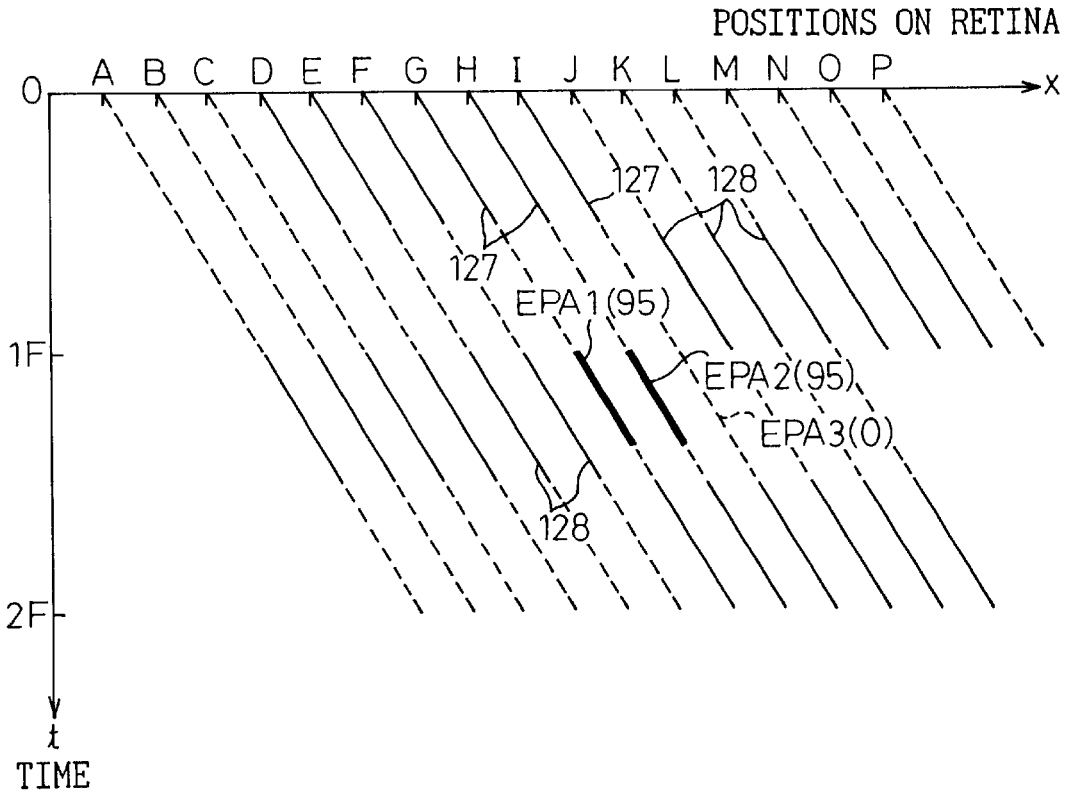
FIGS. 32A and 32B show the image of FIG. 25 projected on the retina and corrected according to the present invention.
Figure 32B:
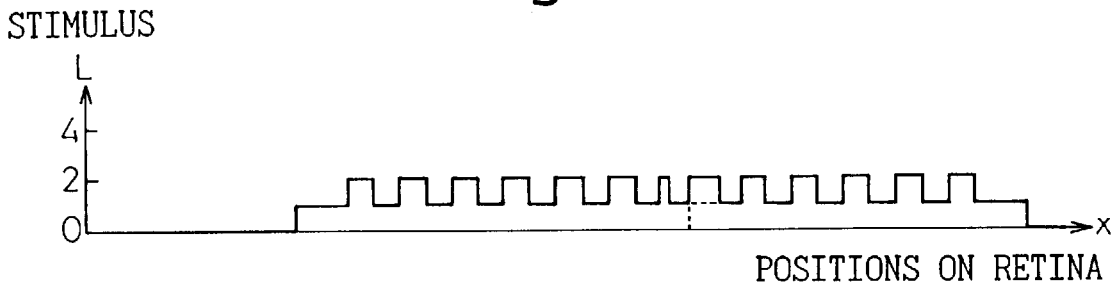

FIGS. 32A and 32B show weighted corrective pulses according to a modification of the present invention.

FIG. 32A, corrective pulses EPA1, EPA2, and EPA3 correspond to intensity levels 95, 95, and 0, respectively, and are applied to the pixels G, H, and I, respectively. The total intensity level of the corrective pulses is EPA1+EPA2+EPA3=95+95+0=190, which is equal to that of FIGS. 28A and 28B.

Figure 33:
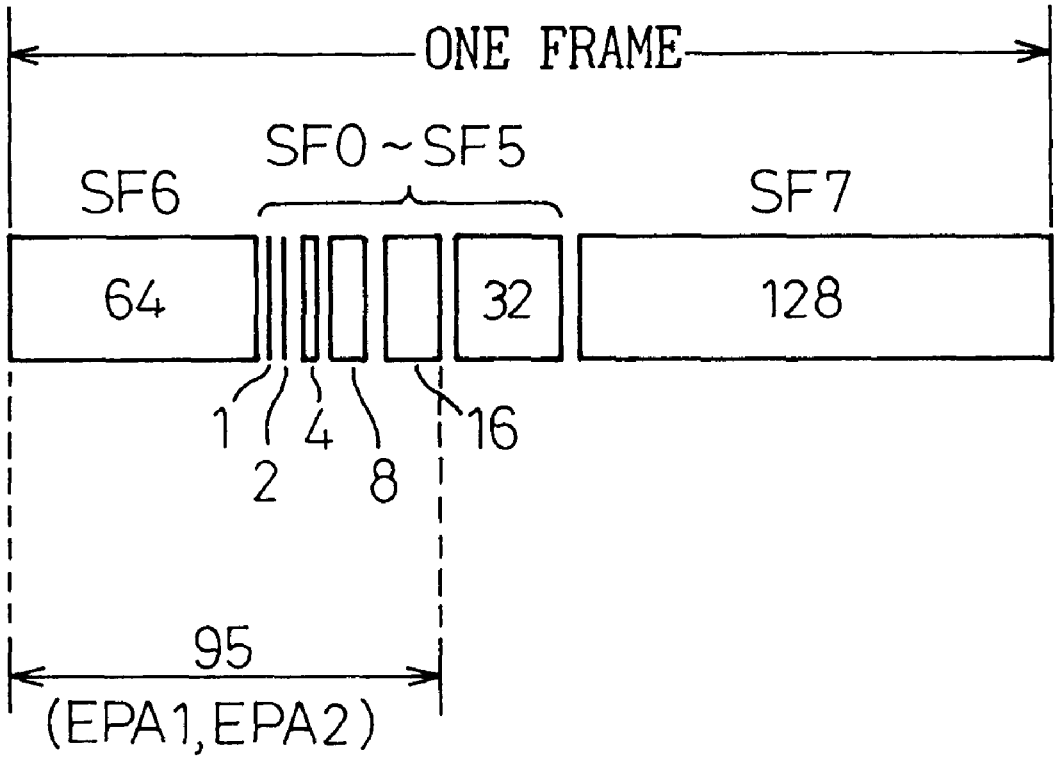
FIG. 33 shows rearranged subframes according to the present invention.

It is apparent from a comparison between FIGS. 32B and 27B that the modification effectively averages the stimulus on the retina. To apply the corrective pulses EPA1 and EPA2 of FIGS. 32A and 32B, the subframes SF0 to SF7 must be rearranged as shown in FIG. 33.

Namely, the subframes are arranged in order of SF6, SF0 to SF5, and SF7. Accordingly, the intensity level 95 of each of the corrective pulses EPA1 and EPA2 is realized by turning on the subframes SF5 and SF0 to SF4. In this way, the subframes may be rearranged according to intensity levels achieved with weighted corrective pulses, which are selected according to the given halftones and an image moving speed.

FIGS. 34A to 37B show a method of displaying a halftone image according to another embodiment of the present invention. This embodiment employs weighted negative corrective pulses. FIGS. 34A to 36B corresponds to FIGS. 26A to 28B, and FIGS. 37A and 37B corresponds to FIGS. 32A and 32B.

In FIGS. 34A to 37B, the halftone image is moving to the left at 3 pixels per frame. An ordinate represents time t and frames 1F, 2F, 3F, and the like, and an abscissa represents positions x on the retina of the human eye.

In the first frame (p≦t<1F), pixles A to C and P are OFF, pixels D to I display intensity level 228, and pixels j of O display intensity level 127. In the first half of the frame 1F, the pixels J to O are ON, and in the second half thereof, the pixels D to I are ON. In the second frame (F≦t<2F), the pixels A to F display intensity level 128, and the pixels G to L display intensity level 127. Accordingly, in the first half of the second frame 2F, the pixels G to L are ON, and in the second half thereof, the pixels A to F are ON. These are repeated. If every horizontal line on the display panel displays the pattern of FIG. 34A, the eye will see stripes. The left half of each stripe consists of six pixels displaying intensity level 128, and the right half thereof consists of six pixels displaying intensity level 127. The stripes move to the left at 3 pixels per frame. Although the pixels are turned on discretely in terms of time, the human eye sees that the stripes ar moving smoothly, and the center of the retina follows the stripes. When the stripes move to the left, the eye follows them, and therefore, the pixels projected on the retina move to the right.

Figure 34A:
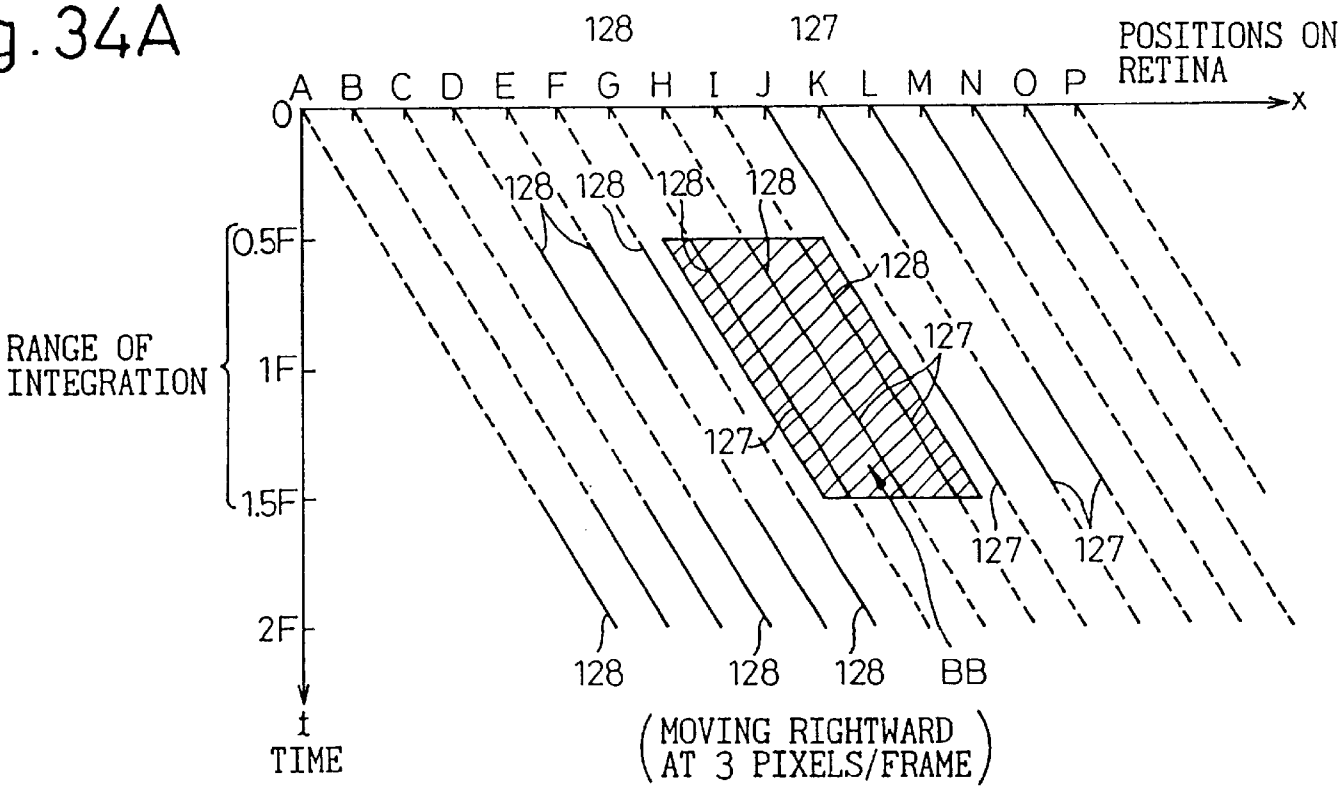
FIGS. 34A and 34B show an image on the retina without correction.

As shown in FIG. 34A, the pixels G, H, and I display intensity level 128 in the first frame 1F and then intensity level 127 in the second frame 2F. This means that the pixels G, H, and I are continuously ON in a frame period from 0.5F to 1.5F.

Figure 34B:
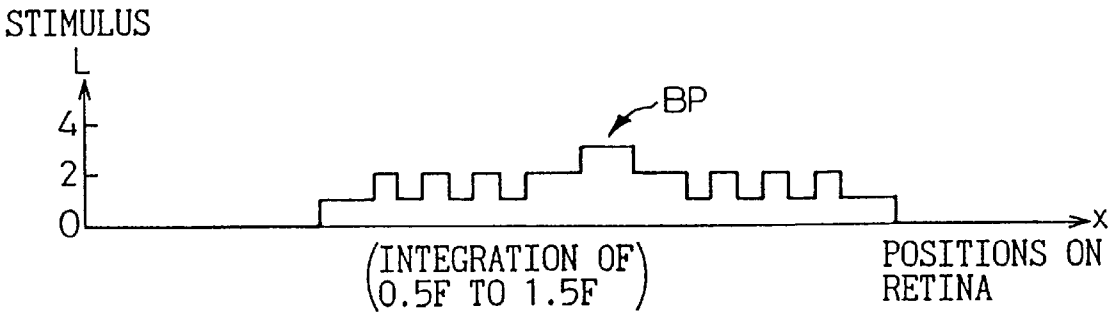

FIG. 34B shows stimulus on the retina integrated for a frame period of 0.5F to 1.5F. The same is applied to FIGS. 35A to 37B.

A bright part BP appears between intensity levels 128 and 127. When the pixels G, H, and I change their intensity level from 128 to 127 between the frames 1F and 2F, the bright part BP is produced for a frame period. To cancel the bright part BP, it is necessary to apply negative corrective pulses, contrary to the positive corrective pulses of FIGS. 27A and 26B.

Figure 35A:
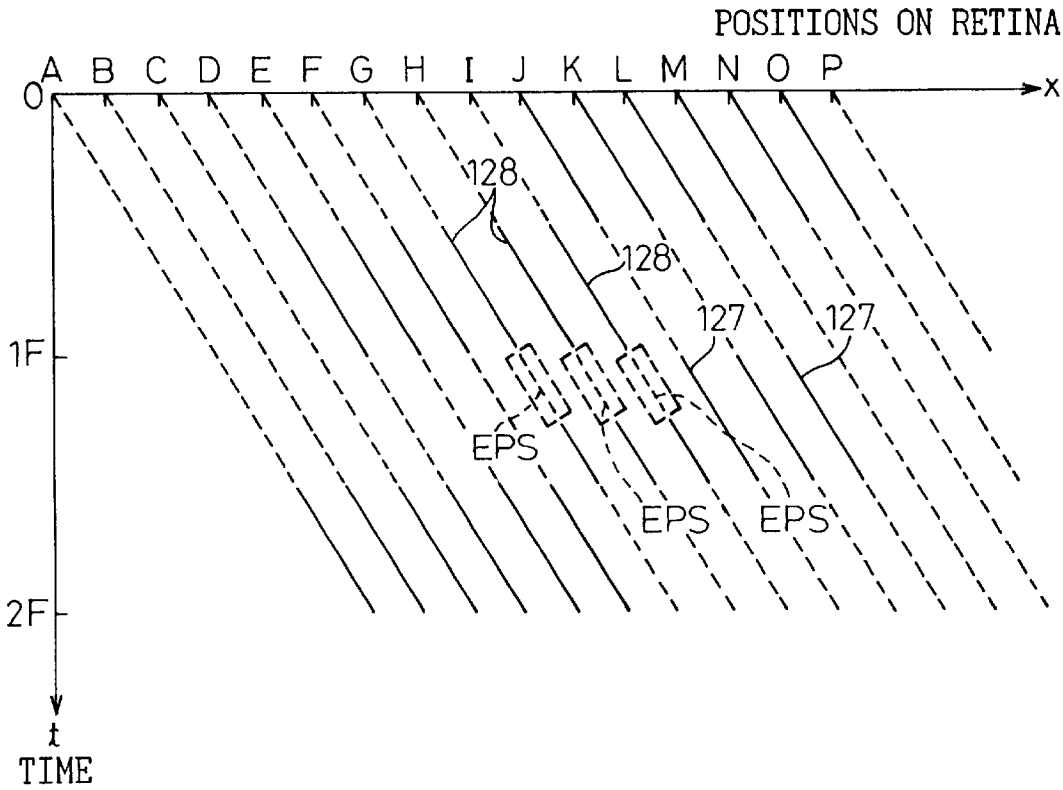
FIGS. 35A and 35B show the image of FIGS. 34A and 34B corrected according to the related art.

FIG. 35A shows the related art of Japanese Patent Application No. 8-198916, which applies a negative corrective pulse EPS to each of the pixels G, H, and I. The corrective pulse EPS corresponds to intensity level 63.

Figure 35B:
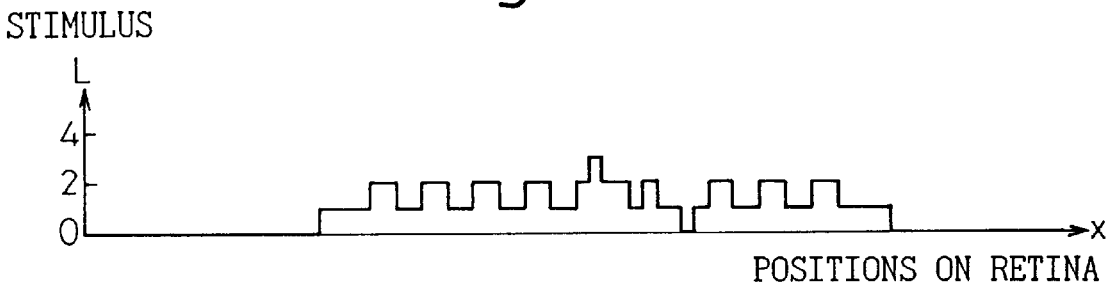

It is apparent from a comparison between FIGS. 34B and 35B that the corrective pulses average the stimulus on the retina.

However, a fluctuation in the stimulus on the retina becomes larger as the moving speed of the image increases to 4 or 5 pixels per frame as shown in the simulations of FIGS. 15 to 22. FIGS. 15 to 18 show an image having a left half of intensity level 127 and a right half of intensity level 128 moving to the left, FIGS. 19 to 22 show the same image moving to the right, and FIGS. 19 to 22 show an image having a left half of intensity level 128 and a right half of intensity level 127 moving to the left.

Figure 36A:
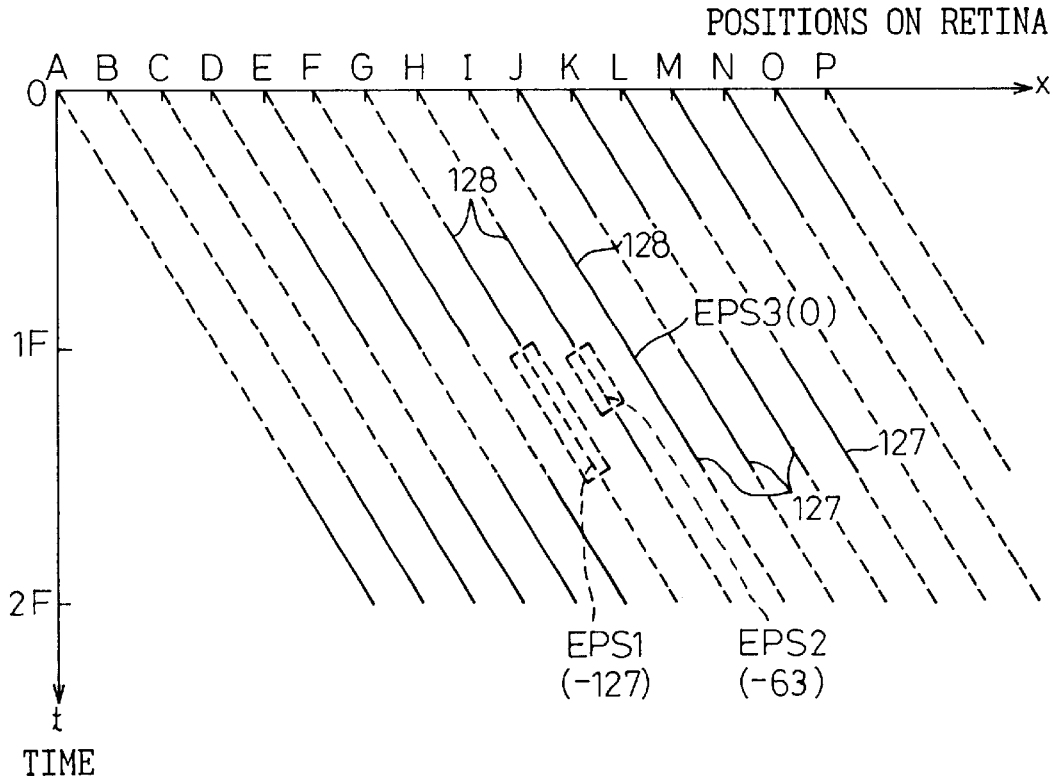
FIGS. 36A to 37B show the image of FIGS. 34A and 34B corrected according to the present invention.
Figure 36B:
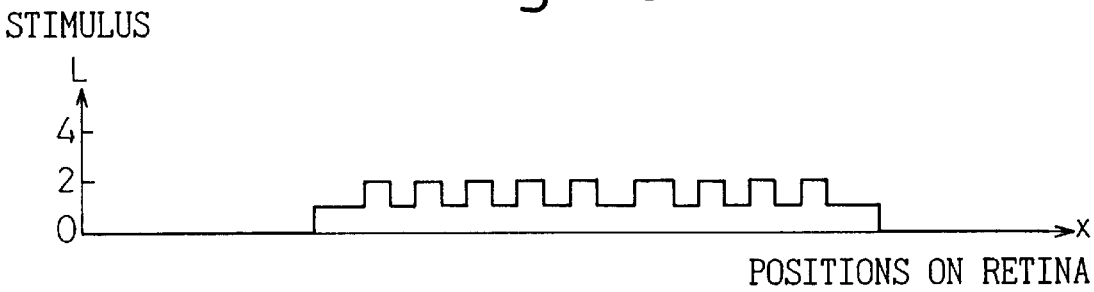

FIGS. 36A and 36B show an example of the present invention employing weighted negative corrective pulses.

In FIG. 36A, a corrective pulse EPS1 corresponding to intensity level −127 is applied to the pixel G, a corrective pulse EPS2 corresponding to intensity level −63 to the pixel H, and a corrective pulse EPS3 corresponding to intensity level 0 to the pixel I. The total intensity level of the corrective pulses is EPS1+EPS2+EPS3=−127+−63+0=−190, which is substantially equal to that of the related art of FIGS. 35A and 35B of 3×EPS=−63×3=−189.

It is apparent from a comparison between FIGS. 35B and 36B that the present invention further averages the stimulus on the retina.

Figure 37A:
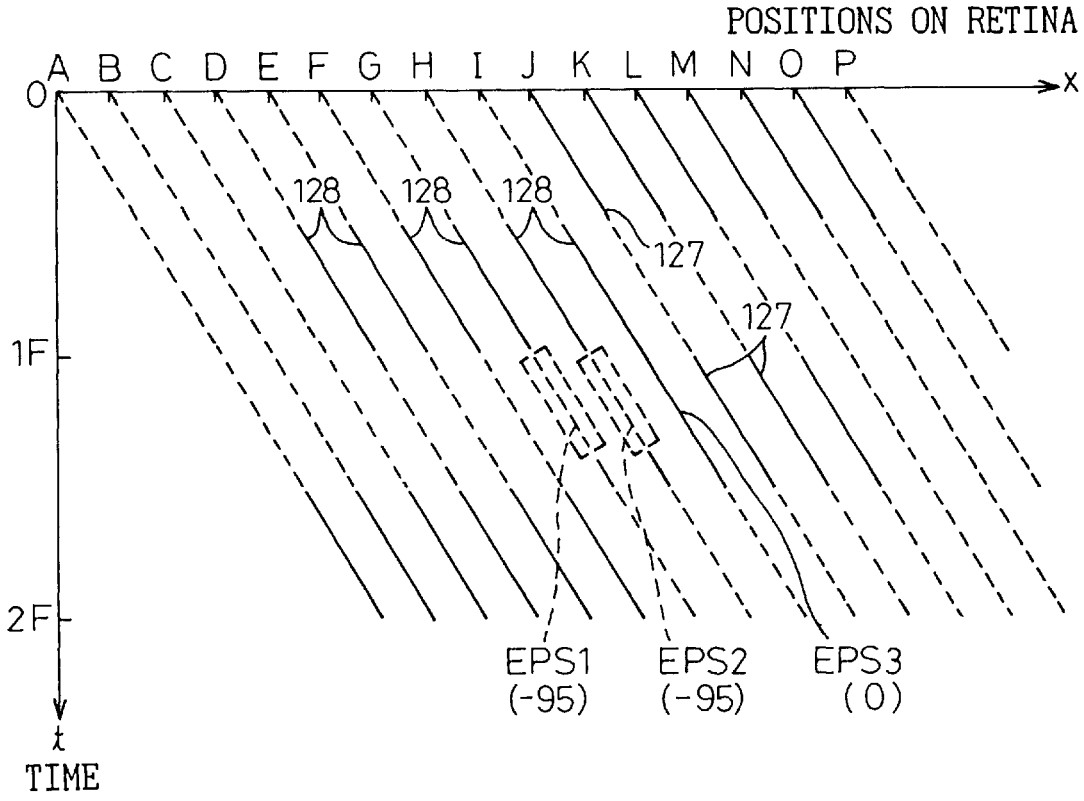
Figure 37B:
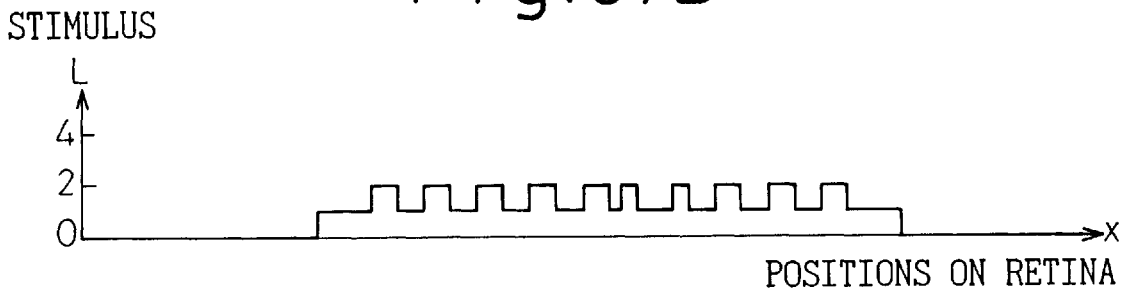

FIGS. 37A and 37B show a modification of the embodiment of FIGS. 36A and 36B. This embodiment applies corrective pulses EPS1, EPS2, and EPS3 corresponding to intensity levels −95, −95, and 0, respectively to the pixels G, H, and I, respectively. The total intensity level of the corrective pulses is EPS1+EPS2+EPS3=−95+−95+0=−190.

It is apparent from a comparison between FIGS. 35B and 37B that the modification properly averages the stimulus on the retina.

A method of providing weighted corrective pulses to display a halftone image that is moving at an optional speed will be explained.

When displaying a horizontally moving stripe having intensity levels 127 and 128, each pixel takes any one of four cases listed in Table 1:

TABLE 1

| Case | Move | Intensity levels | Disturbance | Corrective pulses | Weighting adjacent to |
|---|---|---|---|---|---|
| C11 | Left | 127–128 | Dark | +127, +63, 0 | 127 |
| C12 | Right | 127–128 | Bright | 0, −63, −127 | 128 |
| C13 | Left | 128–127 | Bright | −127, −63, 0 | 128 |
| C14 | Right | 128–127 | Dark | 0, +63, +127 | 127 |

In case C11, the stripe moves to the left at 3 pixels per frame. The left half of the stripe has intensity level 127 and the right half thereof has intensity level 128. If the human eye follows the moving stripe, a dark part will appear between the intensity levels. To suppress the disturbance, corrective pulses EPA1, EPA2, and EPA3 (FIGS. 28A and 28B) corresponding to intensity levels +127, +63, and 0 are applied to the pixels that display intensity level 128 so that the pixel beside a pixel of intensity level 127 may receive the corrective pulse EPA1, the second nearest pixel to the intensity-level-127 pixel may receive the corrective pulse EPA2, and the third nearest pixel to the intensity-level-127 pixel may receive the corrective pulse EPA3.

In the case C13, the stripe image moves to the left at 3 pixels per frame. The left half of the stripe has intensity level 128 and the right half thereof has intensity level 127. If the human eye follows the stripe, a brigt part appears between the intensity levels. To suppress the disturbance, corrective pulses EPS1, EPS2, and EPS3 (FIGS. 36A and 36B) corresponding to intensity levels −127, −63, and 0 are applied to pixels that display intensity level 127 so that the pixel beside a pixel of intensity level 128 may receive the corrective pulse EPA1, the second nearest pixel to the intensity-level-128 pixel may receive the corrective pulse EPA2, and the third nearest pixel to the intensity-level-128 pixel ma receive the corrective pulse EPA3. The cases C12 and C14 will be understood from the cases C13 and C11.

The case C11 to C14 of Table 1 can be expressed as shown in Table 2:

TABLE 2

| Case | Intensity change | Disturbance | Sign of pulses | Weighting adjacent to |
|---|---|---|---|---|
| C21 | 127→128 | Dark | Positive | 127 |
| C22 | 128→127 | Bright | Negative | 128 |

In the case C21, the intensity level of pixels changes from 127 to 128 to produce a dark part between the intensity levels. To suppress the disturbance, positive corrective pulses EPA1, EPA2, and EPA3 are used. The absolute values of the corrective pulses are, for example, 0, 63, and 127. The corrective pulse having the largest absolute value is applied to a pixel of intensity level 128 beside a pixel whose intensity level is unchanged at 127.

In the case C22, the intensity level of pixels changes from 128 to 127 to produce a bright part between the intensity levels. To suppress the disturbance, positive corrective pulses EPS1, EPS2, and EPS3 are used. The absolute values of the corrective pulses are 0, 63, and 127. The corrective pulse having the largest absolute value is applied to a pixel of intensity level 127 beside a pixel whose intensity level is unchanged at 128.

As is apparent in Table 2, the absolute values of weighted corrective pulses are irrelevant to a moving direction when the image is moving horizontally.

In the example of FIG. 25, the image is moved at 3 pixels per frame, and the consecutive three pixels G, H, and I simultaneously change their intensity level from 127 to 128. Accordingly, the three weighted corrective pulses EPA1, EPA2, and EPA3 are applied to the pixels G, H, and I. If the image is moved at n pixels per frame, n corrective pulses will be applied to n pixels.

If the image is moved at a non-integer speed, a nearest integer is used. For example, if the image is moved at 3.5 pixels per frame, the image is moved by 3 pixels in the first frame, by 4 pixels in the second frame, and by 3 pixels in the third frame, so that the image is moved at an average speed of 3.5 pixels per frame. A television signal sampling technique automatically carries out such averaging.

Table 3 shows weighted corrective pulses for different horizontal speeds ranging from 1 to 7 pixels per frame.

TABLE 3

| | Identical pixels | Corrective pulses | Symbol |
|---|---|---|---|
| | 1 | ±63 | 1 |
| | | ±63 | 1 |
| | 2 | ±127, 0 | 2/0 |
| | | ±63, ±63 | 1/1 |
| | | 301 | |
| | | ±127, ±63, 0 | 2/1/0 |
| 300 → | 3 | | |
| | | ±95, ±95, 0 | 1.5/1.5/0 |
| | | 302 | |
| 304 → | 4 | ±127, ±127, 0, 0 | 2/2/0/0 |
| | | ±127, ±63, ±63, 0 | 2/1/1/0 |
| | 5 | ±127, ±127, ±63, 0, 0 | 2/2/1/0/0 |
| | | ±127, ±95, ±95, 0, 0 | 2/1.5/1.5/0/0 |

TABLE 3-continued

| | Identical pixels | Corrective pulses | Symbol |
|---|---|---|---|
| 303 → | 6 | ±127, ±127, ±127, 0, 0, 0 | 2/2/2/0/0/0 |
| | | ±127, ±127, ±63, ±63, 0, 0 | 2/2/1/1/0/0 |
| | 7 | ±127, ±127, ±127, ±63, 0, 0, 0 | 2/2/2/1/0/0/0 |
| | | ±127, ±127, ±95, ±95, 0, 0, 0 | 2/2/1.5/1.5/0/0/0 |

In FIGS. 28A and 28B, three consecutive pixels display the same intensity level. This corresponds to "300" in Table 3. If the intensity level of the pixels changes from 127 to 128, three positive corrective pulses (+127, +63, 0; 2/1/0) are selected and applied to the pixels G, H, and I. If the intensity level of the three pixels changes from 128 to 127 as shown in FIGS. 36A and 36B, three negative corrective pulses (−127, −63, 0) are selected and applied to the pixels G, H, and I. In Table 3, the symbols represent corrective pulses. The symbol "2" corresponds to a corrective pulse of intensity level 127, the symbol "1.5" corresponds to a corrective pulse of intensity level 95, the symbol "1" corresponds to a corrective pulse of intensity level 63, and the symbol "0" corresponds to a corrective pulse of intensity level 0.

A pulse set "302" in Table 3 is a modification of a pulse set "301." If the intensity level of the pixels G, H, and I changes from 127 to 128, positive corrective pulses (+95, +95, 0; 1.5/1.5/0) are selected and applied to the pixels as shown in FIGS. 32A and 32B. If the intensity level of the pixels changs from 128 to 127, negative corrective pulses (−95, −95, 0) are selected and applied to the pixels as shown in FIGS. 37A and 37B. When the image is moved at any one of speeds of 4 to 7 pixels per frame, corrective pulses are selected in Table 3 and are applied to corresponding pixels, to reduce disturbance. The weight of each corrective pulse is not uniquely determined. An optimum weight must be selected in consideration of subframes, etc., as explained with reference to FIG. 33.

In this way, the present invention removes false contours from an image moving on a display panel, thereby improving the quality of the image. The influence of the corrective pulses on a still image will be examined.

The present invention applies weighted corrective pulses to pixels even when displaying a full-screen halftone still image involving gradually changing intensity levels. It is preferable, however, to apply unweighted corrective pulses to the pixels if the target is a still image because there is no movement on the retina with respect to the still image.

The present invention inserts weighted corrective pulses to both still and moving images only momentarily when the intensity level of the image changes around a specific value. The positions of pixels to which the corrective pulses are applied move on the retina, and therefore, there will be no problem. False contours are visible when they appear at fixed positions on the retina. If they move on the retina, they are not visible. Accordingly, the weighted corrective pulses cause no problem on the still image.

Figure 38A:
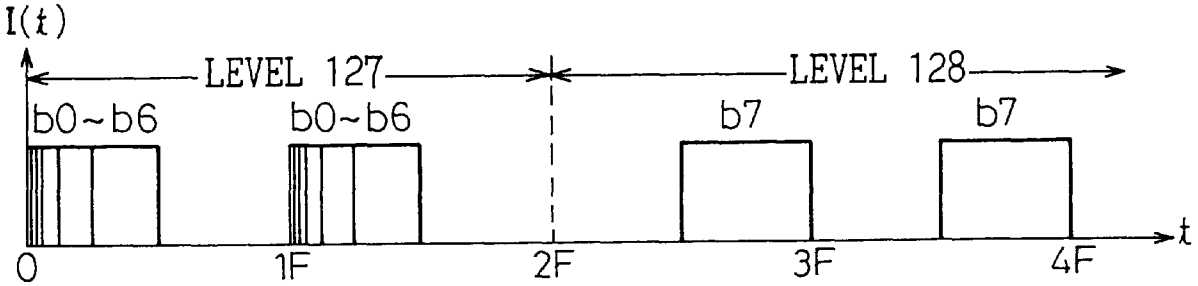
FIGS. 38A to 38C explain a corrective pulse applied to original display data according to the present invention.
Figure 38B:
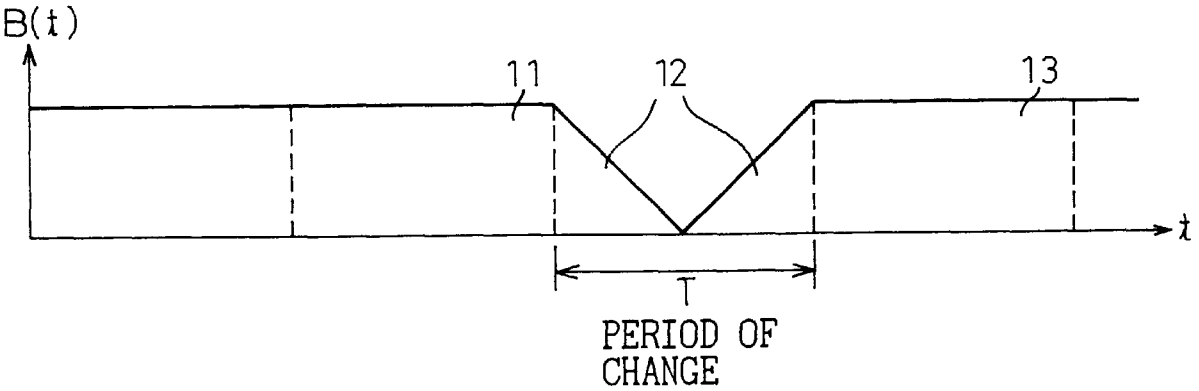
Figure 38C:
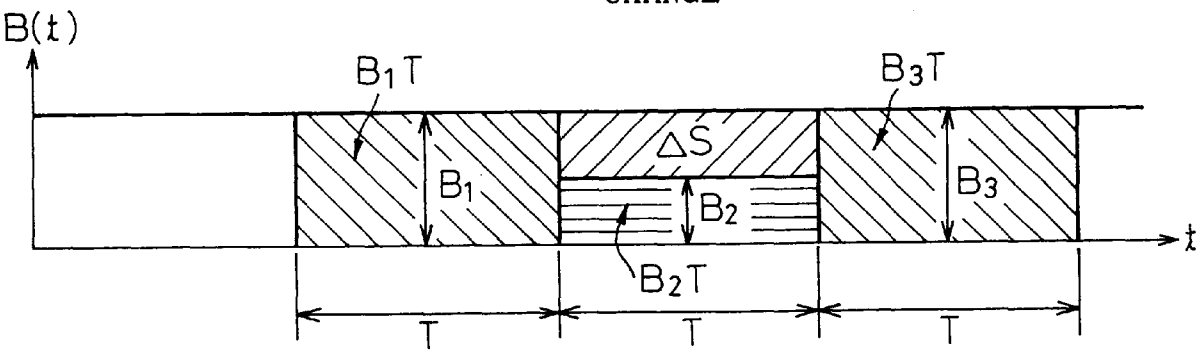
Figure 39:
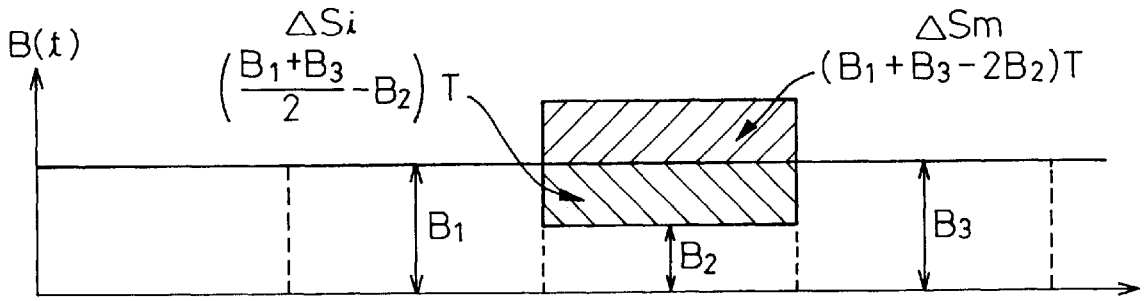
FIG. 39 explains a corrective pulse according to the present invention.

FIGS. 38A to 39 explain corrective pusles applied to original display data according to the present invention, in which FIGS. 38A to 38C show an ideal corrective pusle, and FIG. 39 shows an allowable range of a corrective pulse. An image on the display is moved at a speed V, which is equal to or larger than 2 pixels per frame. Namely, at least two pixels each involving an intensity level change of FIG. 38A horizontally exist. FIG. 38A corresponds to FIG. 13A, and FIG. 38B corresponds to FIG. 13C. In FIG. 38B, an area 11 shows intensity level 127 with bits b0 to b6 being ON, an area 13 shows intensity level 128 with a bit b7 being ON, and an area 12 shows a change in intensity level from 127 to 128.

FIG. 38C shows averages $B_1$, $B_2$, and $B_3$ calculated by dividing the stimuli B(t) of the areas 11, 12, and 13 of FIG. 38B by a frame period T. The stimulus ΔS on the retina due to a corrective pulse must satisfy any one of the following expressions:

$$B_1T \leqq B_2T+\Delta S \leqq B_3T \quad (1)$$

$$B_1T \leqq B_2T+\Delta S \geqq B_3T \quad (2)$$

The expression (1) is ideal when the intensity level increases, and the expression (2) is ideal when the intensity level decreases.

The related art of FIGS. 27A, 27B, 35A, and 35B applies an identical corrective pulse to each of target pixels (G, H, I). On the other hand, the present invention applies weighted corrective pulses corresponding to, for example, intensity levels 127, 63, and 0 to the target pixels (G, H, I), respectively.

The total intensity level of corrective pulses applied to a target area is fixed according to the preset invention. Namely, the total intensity level of the weighted corrective pulses is equal to that of the related art FIGS. 27A and 27B.

When there are n pixels to which corrective pulses must be applied according to the present invention, the sum of stimulus due to the corrective pulses is nΔS. This, however, is not always equal to a calculated value. If the total is nearly equal to the calculated one, the effect of the present invention is secured. The total intensity level of corrective pulses may be adjusted according to an arrangement of subframes, to suppress disturbance more effectively.

The stimulus sum ΔS on the retina due to the corrective pulses may vary within the range of 0 to a maximum ΔSm, which double the ideal stimulus ΔSi. If ΔS is out of this range, it will increase the disturbance.

FIG. 39 shows the ideal stimulus $\Delta Si=((B_1+B_3)/2-B_2)T$ and the maximum stimulus $\Delta Sm=(B_1+B_3-2B_2)T$.

The stimulus ΔS on the retina realized by corrective pulses must satisfy the following if $B_2 \leqq (B_1+B_3)/2$:

$$0 \leqq \Delta S \leqq (B_1+B_3-2B_2)T \quad (3)$$

If $B_2 \geqq (B_1+B_3)/2$, the stimulus ΔS must satisfy the following:

$$0 \geqq \Delta S \geqq (B_1+B_3-2B_2)T \quad (4)$$

Although the above explanation relates to moving an image horizontally, moving an image vertically will be understood accordingly. Moving an image in an optional direction wil be explained.

Moving an image diagonally and changing intensity levels in the same direction will be explained. Pixels on a display panel are arranged in a square matrix, and the image is moved at 3 pixels per frame toward a lower left part along diagonal lines inclined at 45 degrees.

FIGS. 40A to 43 show a method of displaying such a diagonally moving halftone image according to still another embodiment of the present invention.

Figures 40A, 40B:
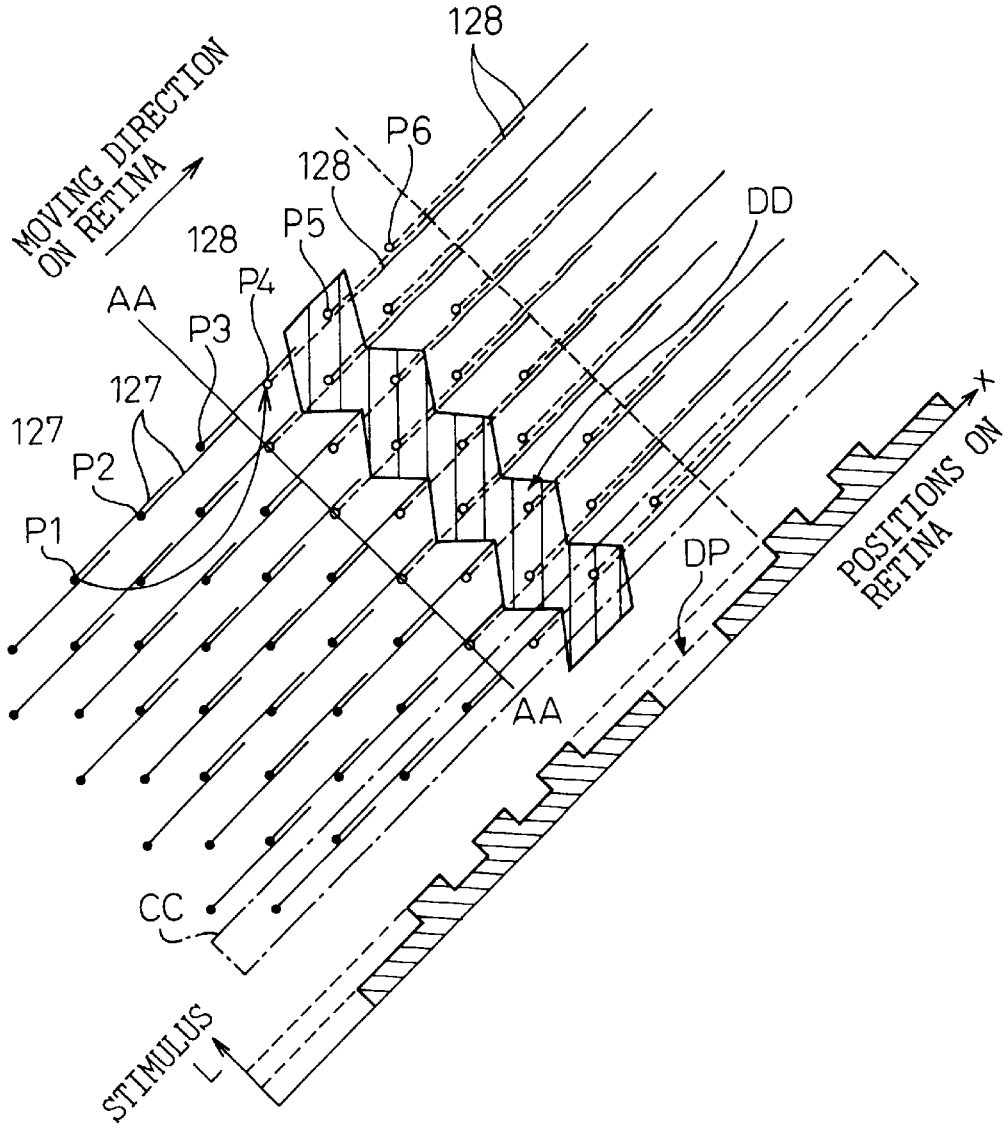
FIGS. 40A and 40B show an image that diagonally moves in an intensity level changing direction.

FIG. 40A shows two-dimensional coordinates fixed on the retina of the human eye. When the human eye follows the image, the image projected on the retina moves at 3 pixels per frame in an upper right direction along diagonal lines inclined at 45 degrees. In FIG. 40A, the left side of a straight line AA has intensity level 127 with bits b0 to b6 being ON, and the right side thereof has intensity level 128 with a bit b7 being ON. FIG. 40B shows stimulus L on the retina for a pixel line CC.

In FIG. 40A, each segment indicates light emission at each pixel in each frame. The segment corresponds to the vertically compressed light emission patterns of FIG. 31. Black and white dots in FIG. 40A represent pixel positions at time 0.

Pixels P1, P2, P3 display intensity level 127 with bits b0 to b6 being ON to turn on the subframes SF0 to SF6. In the same frame, pixels P4, P5, and P6 display intensity level 128 with a bit b7 being ON to turn on the subframe SF7. In the next frame, the pixels P4, P5, and P6 display intensity level 127. This means that, on the retina, the pixels P1 to P3 move to the positions of the pixesl P4 to P6. As a result, a dark part DD is observed as shown in FIGS. 40A and 40B.

Figure 41:
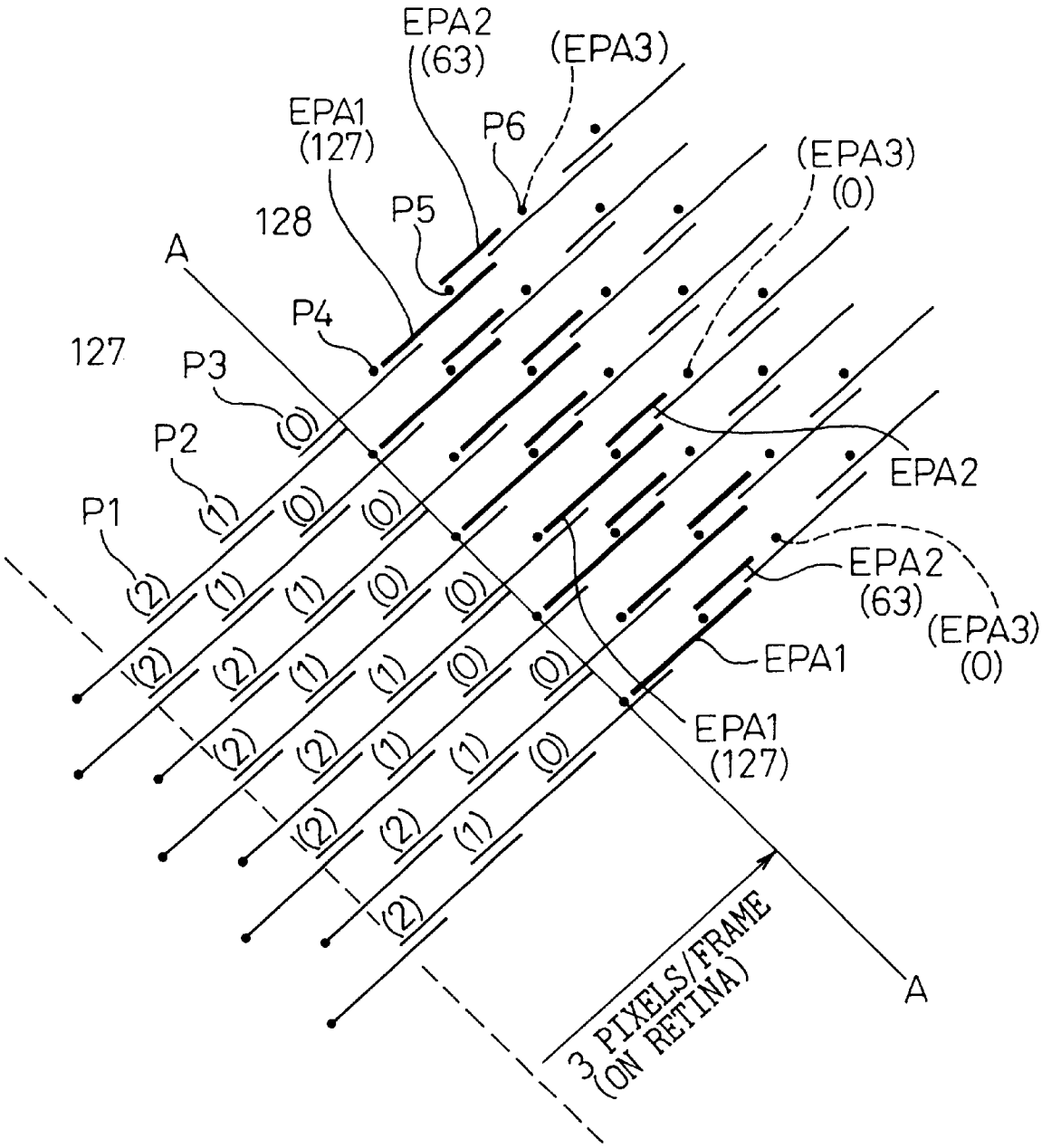
FIGS. 41 to 44 show the diagonally moving image corrected according to the present invention.

FIG. 41 shows corrective pulses applied according to the present invention. The corrective pulse EPA1 corresponding to intensity level +127, EPA2 corresponding to intensity level +63, and EPA3 corresponding to intensity level 0 are applied to the pixels P1 to P3.

Each parenthesized numeral represents a pixel to which a corrective pulse is applied. For example (2) is a pixel such as P1 to which the corrective pulse EPA1 of intensity level +127 is applied, (1) is a pixel such as P2 to which the corrective pulse EPA2 of intensity level +63 is applied, and (0) is a pixel such as P3 to which the corrective pulse EPA3 of intensity level is applied. These corrective pulses cancel the dark part DD.

Figure 42:
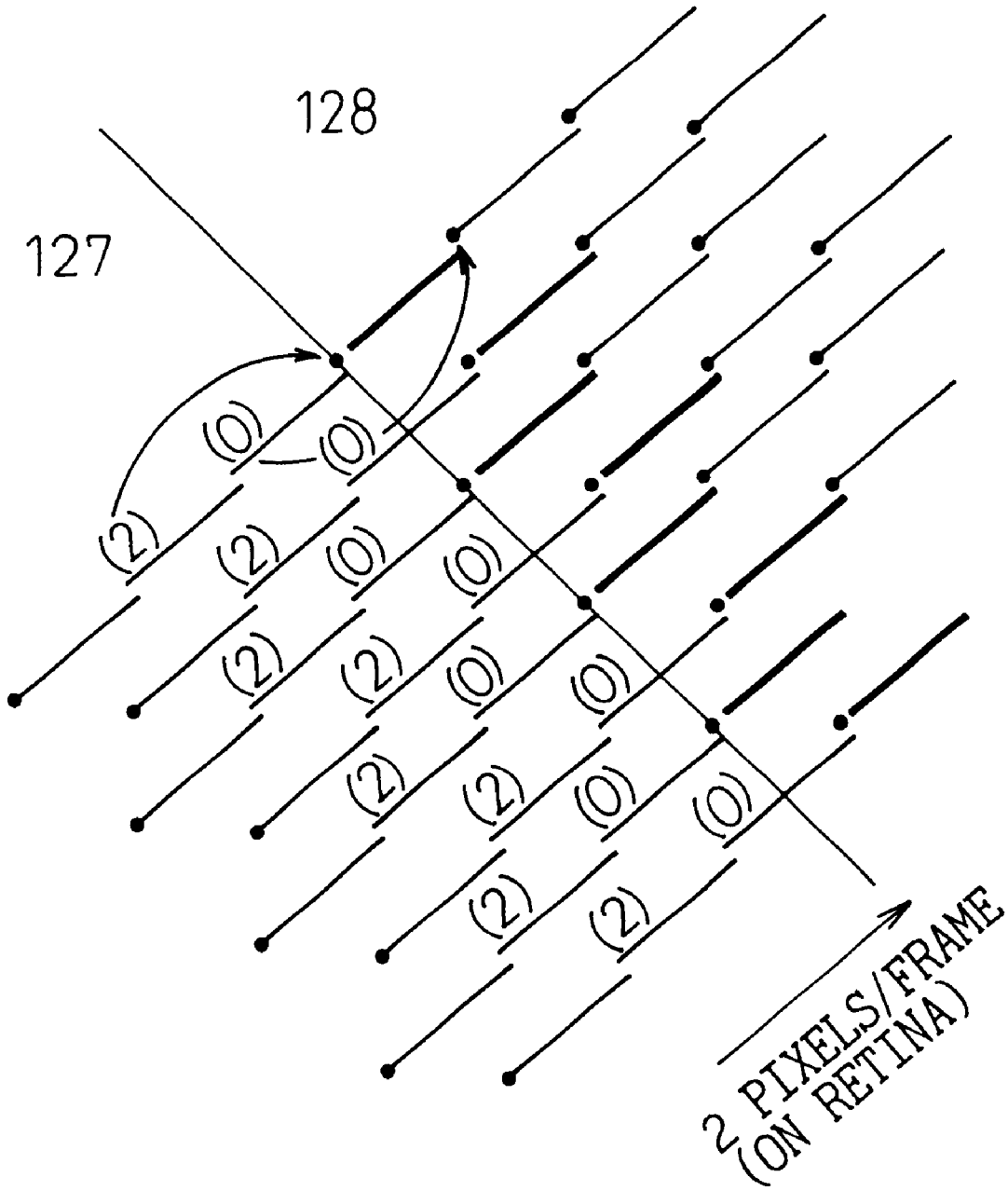

FIG. 42 shows an image diagonally moving at 2 pixels per frame. In this case, corrective pulses of intensity levels +127 and 0 are applied to corresponding pixels.

Figure 43:
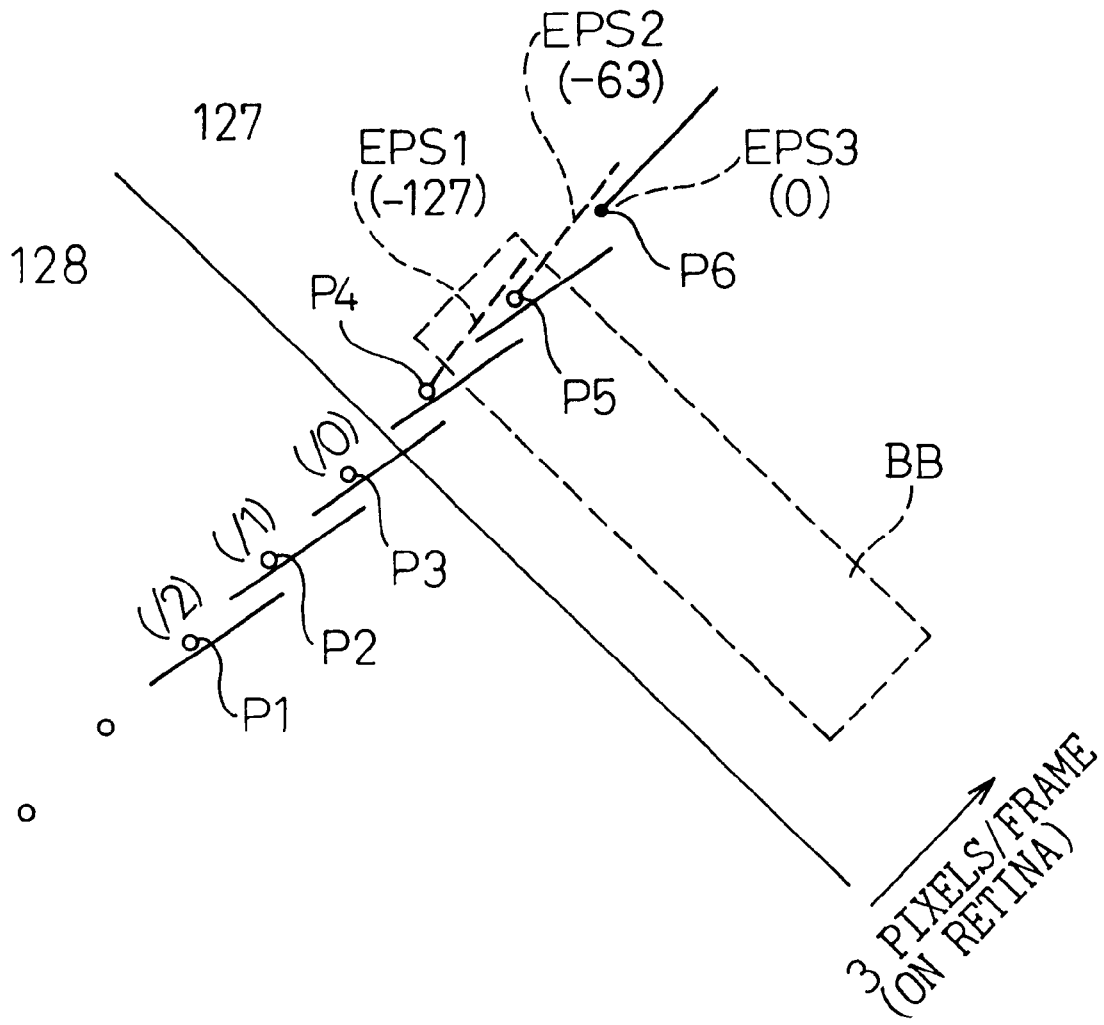

FIG. 43 shows a modification of FIG. 40A. The left side of a straight line AA has intensity level 128 and the right side thereof has intensity level 127. This modification corresponds to FIGS. 36A and 36B. Although FIG. 43 shows only a row of pixels, there are actually many rows of pixels as shown in FIG. 40A.

In FIG. 43, black and white dots represent pixel positions at time 0. Reference mark (/2) indicates a pixel such as P1 to which a corrective pulse EPS1 corresponding to intensity level −127 is applied, (/1) indicates a pixel such as P2 to which a corrective pulse EPS2 corresponding to intensity level −63 is applied, and (0) indicates a pixel such as P3 to which a corrective pulse EPS3 corresponding to intensity level 0 is applied.

When the image moves, the human eye senses the pixels P1 to P3 moving to the positions of the pixels P4 to P6. Accordingly, the corrective pulses EPS1 to EPS3 are applied to the pixels P1 to P3, respectively. The corrective pulses EPS1 and EPS2 cancel original intensity levels as indicated with dotted lines in FIG. 43, to thereby eliminate a bright part BB appearing between the intensity levels 128 and 127.

The speed and direction of an image to be displayed are unknown in advance. A method of providing weighted corrective pulses for this kind of image will be explained. The method generalizes the moving speed and direction of an image to be displayed and applies weighted corrective pulses to the image.

The number of consecutive pixels having the same ON/OFF states in the subframe bits b5, b6, and b7 is counted vertically and horizontally, and a smaller one of them is selected. Table 3 is referred to, to determine weighted corrective pulses according to the selected number, and the corrective pulses are added to original display data.

In an image moving horizontally, a moving speed expressed in pixels per frame is equal to the number of pixels that show an identical intensity change. For an image moving in an optional direction, it is necessary to count the number of pixels that show an identical intensity change in the moving direction. It is impossible, however, to count the number of such pixels in a direction other than horizontal, vertical, or diagonal direction. Accordingly, the number of pixels that show an identical intensity change is counted in vertical and horizontal directions, and a smaller one of them is selected. Then, Table 3 is locked up to determine weighted corrective pulses, which are added to original display data.

The corrective pulses of FIG. 41 for the diagonally moving image will be determined according to a technique shown in Table 4.

TABLE 4

| | |
|---|---|
| 1 | The intensity levels of pixels in a frame n and those in the next frame n + 1 are compared with each other. If the seventh bit for a given pixel is OFF in both the frames n and n + 1 to indicate intensity level 127, "a" is stored for the pixel in a RAM. If the seventh bit-for the pixel is OFF in the frame n to indicate intensity level 127 and ON in the frame n + 1 to indicate intensity level 128, "b" is stored for the pixel in the RAM. If the seventh bit for the pixel is ON in the frame n to indicate intensity level 128 and OFF in the frame n + 1 to indicate intensity level 127, "c" is stored for the pixel in the RAM. If the seventh bit for the pixel is ON in both the frames n and n + 1 to indicate intensity level 128, "d" is stored for the pixel in the RAM. |
| 2 | All pixels are checked in order of (1, 1), (1, 2), . . . , (2, 2), (2, 3), and the like to see if there is any pixel having "b" or "c" and not yet provided with a corrective pulse. If such pixel is found, its coordinates (i, j) are recorded. |
| 3 | It is checked to see if a horizontal section containing pixels of "b" or "c" follows the pixel (i, j). |
| 4 | If such a section is sandwiched between pixels of "a" and "d", or "d" and "a", the number of "b"s or "c"s in the section is counted as "Bij." |
| 5 | If the steps 3 and 4 are not applicable, "∞" is stored in "Bij." |
| 6 | It is checked to see if a vertical section containing pixels of "b" or "c" follows the pixel (i, j). |
| 7 | If such a section is sandwiched between pixels of "a" and "d", or "d" and "a", the number of "b"s or "c"s in the section is counted as "Cij." |
| 8 | If the steps 6 and 7 are not applicable, "∞" is stored in "Cij." |
| 9 | If "Bij" is equal to or smaller than "Cij", "Bij" is selected, or else "Cij" is selected. |
| 10 | If both "Bij" and "Cij" are each "∞", a corrective pulse of "0" is selected. |
| 11 | Table 3 is looked up to select weighted corrective pulses. |
| 12 | The weighted corrective pulses are allocated to the pixels having "b" or "c" in the section, respectively. |
| 13 | Return to the step 2. |
| 14 | If every pixel is checked for its seventh bit, the steps 1 to 13 are repeated to check the sixth bit of each pixel. Another bit will be checked if required. |

In FIG. 40A, there are six horizontal and vertical pixels that simultaneously change their intensity level from 127 to 128. Accordingly, "303" in Table 3 for a moving speed of 6 pixels per frame is referred to and +127, +127, +127, 0, 0, and 0, or +127, +127, +63, +63, 0, and 0 are selected for weighted corrective pulses. Any pixel provided with the corrective pulse of +127 is represented with (2), any pixel provided with the corrective pulse of +63 is represented with (1), and any pixel provided with the corrective pulse of 0 is represented with (0).

Figure 44:
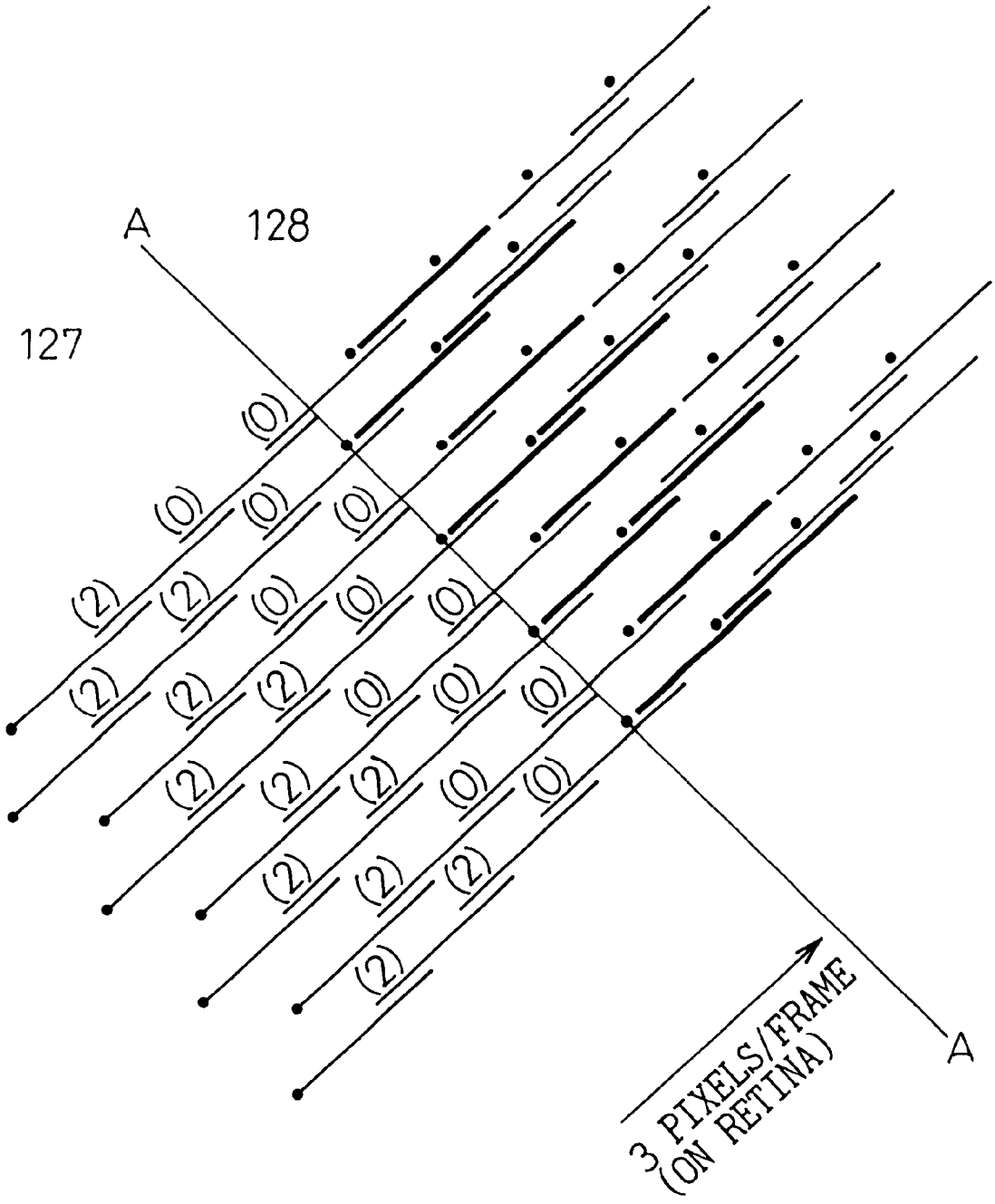

If the corrective pulses of +127, +127, +127, 0, 0, and 0 are selected, they are applied as shown in FIG. 44. Although they are slightly different from the example of FIG. 41, an average of two lines moving diagonally is equal to that of FIG. 41. If the corrective pulses of +127, +127, +63, 0, and 0 are selected, they are applied as shown in FIG. 41.

Table 4 is applicable to select weighted corrective pulses for the diagonally moving image of FIG. 42. There are four horizontal and vertical pixels that simultaneously change their intensity level from 127 to 128. Accordingly, "304" of Table 3 is referred to and +127, +127, 0, and 0, or +127, +63, +63, and 0 are selected for weighted corrective pulses. If +127, +127, 0, and 0 (2/2/0/0) are selected, they are applied as shown in FIG. 42. If +127, +63, +63, and 0 (2/1/1/0) are selected, they will slightly differ from FIG. 42. However, an average of two lines moving diagonally is the same as that of FIG. 42.

An image that moves diagonally and involves an intensity level change in a different direction will be explained.

Figure 45:
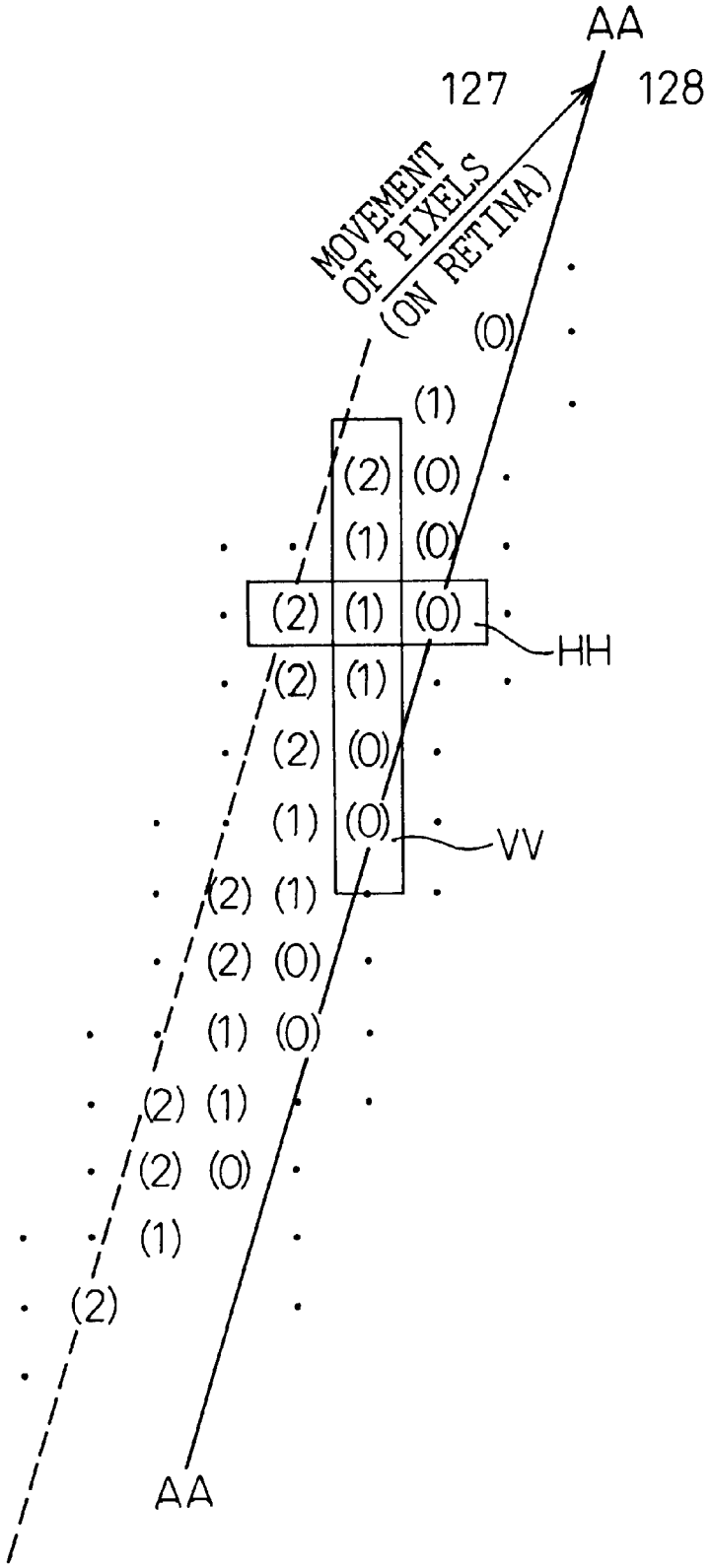
FIGS. 45 and 46 show images diagonally moving in a different direction from an intensity level changing direction and corrected according to the present invention.
Figure 46:
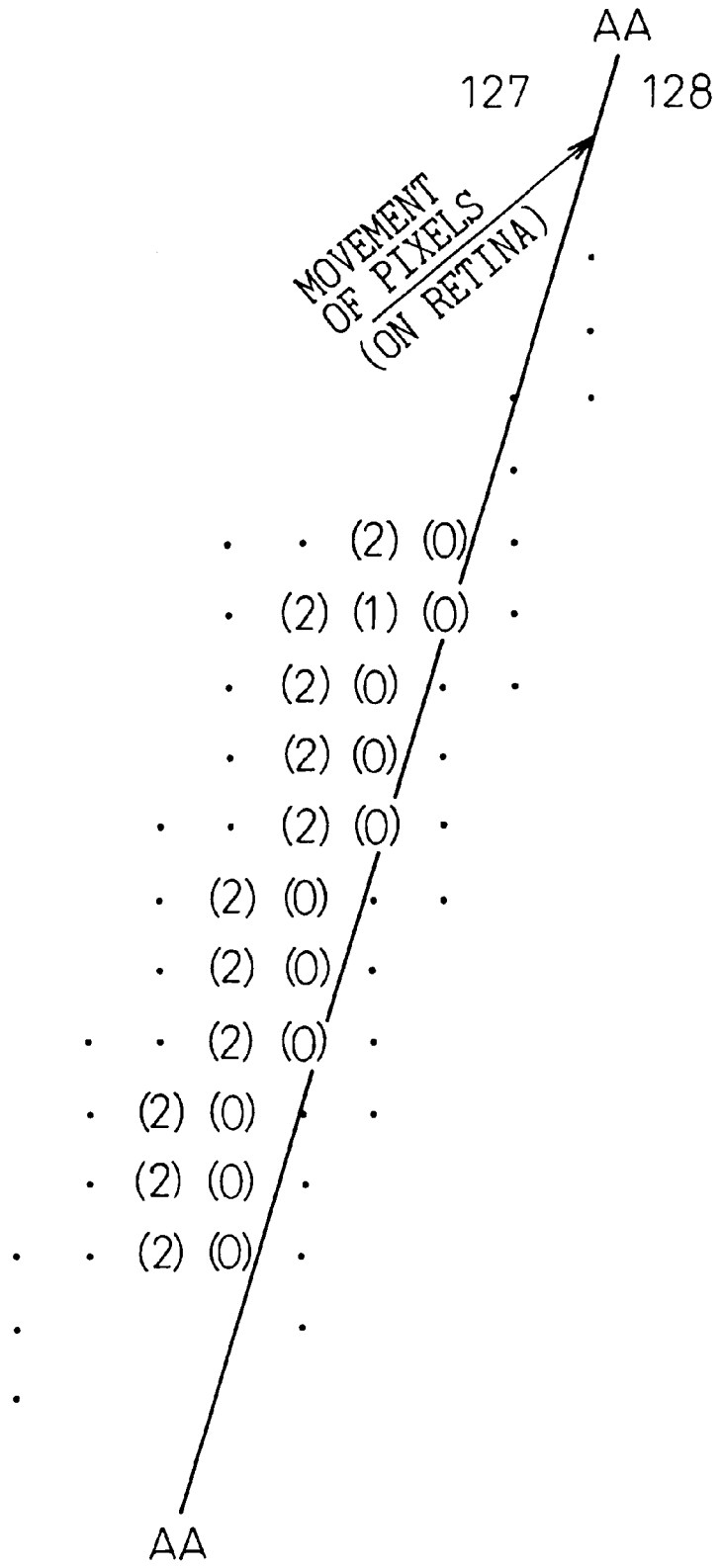

FIGS. 45 and 46 show an image moving diagonally and involving an intensity level change in a different direction. In FIG. 45, the image changes its intensity level along a straight line AA and moves toward a lower left part along a diagonal line inclined ar 45 degrees. Accordingly, each pixel moves on the retina toward an upper right part along a diagonal line of 45 degrees. In FIG. 45, (2), (1), and (0) are pixels receiving corrective pulses corresponding to intensity levels +127, +63, and 0, respectively.

To grasp the moving speed and direction of the image, the number of pixels having the same ON/OFF states in the subframe bits b7, b6, and b5 is counted in a horizontal direction HH and in a vertical direction VV. In FIG. 45, there are three pixels in the horizontal direction HH, and six pixels in the vertical direction VV. Accordingly, the smaller number "3" is selected to refer to Table 3 to select weighted corrective pulses. The reason why the subframe bits b7, b6, and b5, in particular, b7 and b6 are checked is because they greatly influence halftone disturbance.

The samller number "3" guides to "300" in Table 3, and 2/1/0 and 1.5/1.5/0 will be selected from the table. Namely, weighted corrective pulses corresponding to intensity levels 127, 63, and 0, or those corresponding to intensity levels 95, 95, and 0 will be selected. In FIG. 45, the corrective pulses of 127, 63, and 0 (2/1/0) are selected and added to original display data.

FIG. 46 shows weighted pulses selected according to Table 4 for the pixels of FIG. 45. There is a slight difference between FIGS. 45 and 46. However, averages of two lines diagonally moving of the two examples are substanially equal to each other.

The technique of Table 4 applied to FIG. 46 will be explained.

1) The intensity levels of every pixel in a frame n and those in the next frame n+1 are compared wiht each other. If the seventh bit b7 corresponding to the subframe SF7 for a given pixel is OFF in both the frames n and n+1 to indicate intensity level 127, "a" is stored for the pixel in a RAM. If the bit b7 for the pixel is OFF in the frame n to indicate intensity level 127 and ON in the frame n+1 to indicate intensity level 128, "b" is stored for the pixel in the RAM. If the bit b7 for the pixel is ON in the frame n to indicate intensity level 128 and OFF in the frame n+1 to indicate intensity level 127, "c" is stored for the pixel in the RAM. If the bit b7 for the pixel is ON in both the frames n and n+1 to indicate intensity level 128, "d" is stored for the pixel in the RAM. In Table 3, an intensity level change from 127 to 128 corresponds to "b," and that from 128 to 127 corresponds to "c."
2) All pixels are checked in order of (1, 1), (1, 2), . . . , (2, 2), (2, 3), and the like to see if there is any pixel having "b" or "c" and not yet provided with a corrective pulse. If such pixel is found, its coordinates (i, j) are recorded.
3) It is checked to see if a horizontal section containing pixels of "b" or "c" follows the pixel (i, j).
4) If such a section is sandwiched between pixels of "a" and "d", or "d" and "a", the number of "b"s or "c"s in the section is counted as "Bij."
5) If the steps 3) and 4) are not applicable, "∞ " is stored in "Bij."
6) It is checked to see if a vertical section containing pixels of "b" or "c" follows the pixel (i, j).
7) If such a section is sandwiched between pixels of "a" and "d", or "d" and "a", the number of "b"s or "c"s in the section is counted as "Cij."
8) If the steps 6) and 7) are not applicable, "∞ " is stored in "Cij."
9) If "Bij" is equal to or smaller than "Cij", "Bij" is selected, or else "Cij" is selected.
10) If both "Bij" and "Cij" are each "∞ ", a corrective pulse of "0" is selected.
11) Table 3 is looked up to select weighted corrective pulses.
12) The weighted corrective pulses are allocated to the pixels having "b" or "c" in the section, respectively.
13) Return to step 2).
14) If every pixel is checked for its bit b7, the steps 1) to 13) are repeated to check the sixth bit (b6). Another bit such as b5 will be checked if required.

FIGS. 47 to 50 show a circular image moving diagonally according to an embodiment of the present invention.

Figure 47:
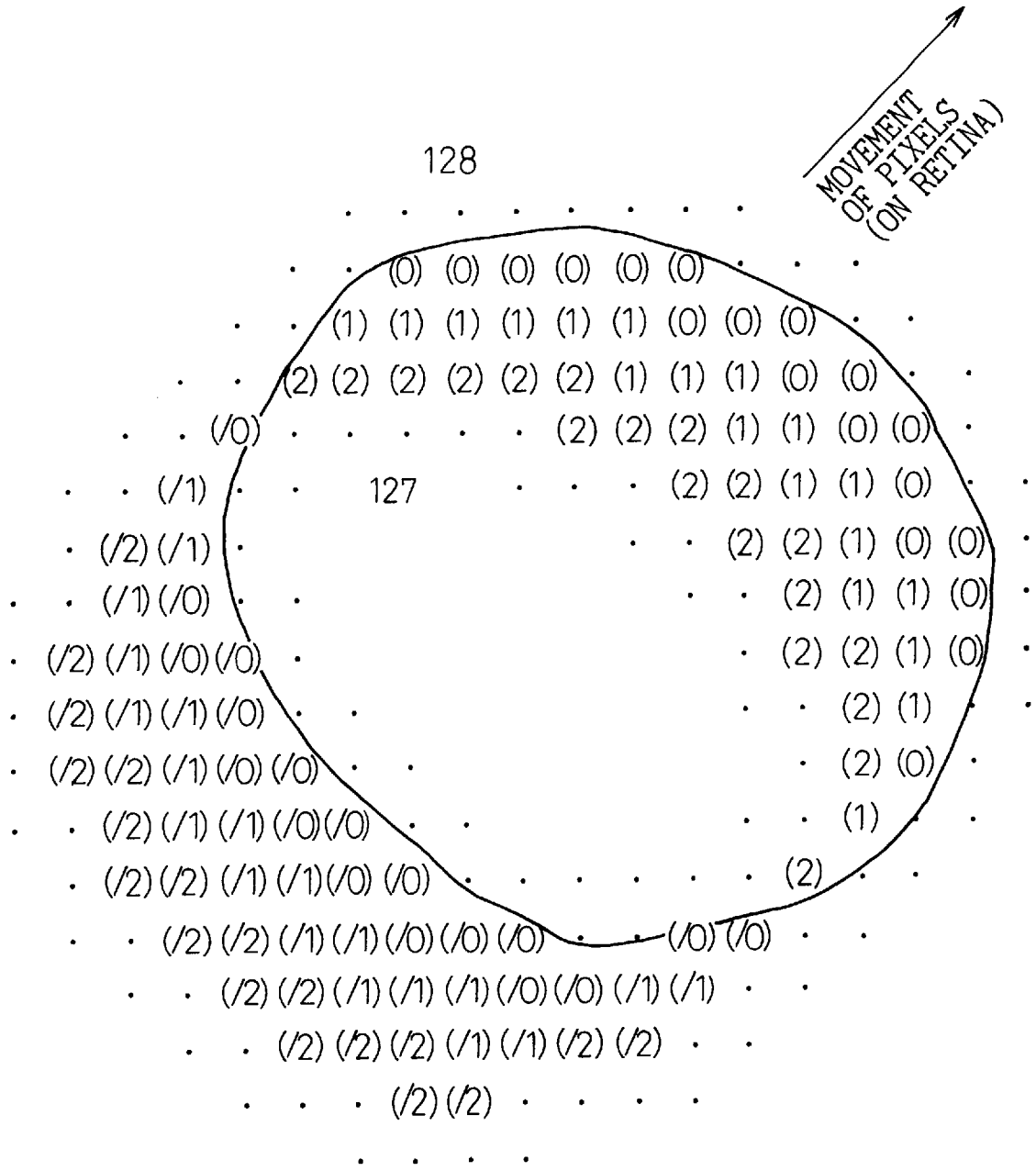
FIGS. 47 to 50 show a diagonally moving circular image corrected according to the present invention.
Figure 48:
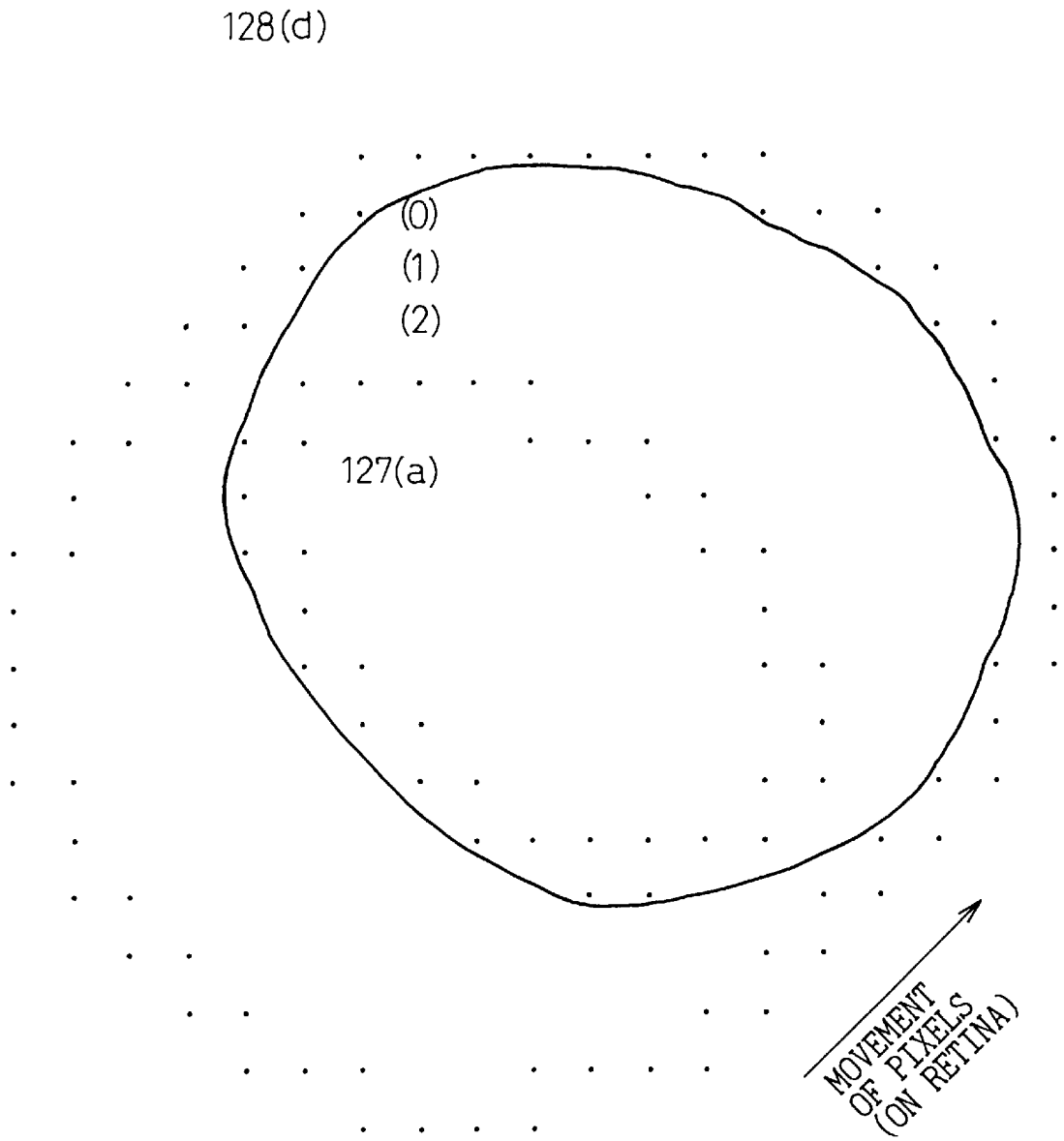

In FIG. 47, the circular image moves toward a lower left part along a diagonal line inclined at 45 degrees. The inside of the image has intensity level 127, and the outside thereof has intensity level 128. Pixels projected on the retina move toward an upper right part at an angle of 45 degrees. Reference marks (2), (1), and (0) are pixels receiving corrective pulses of intensity levels, +127, +63, and 0, respectively. FIG. 48 shows the movement of the image.

Figure 49:
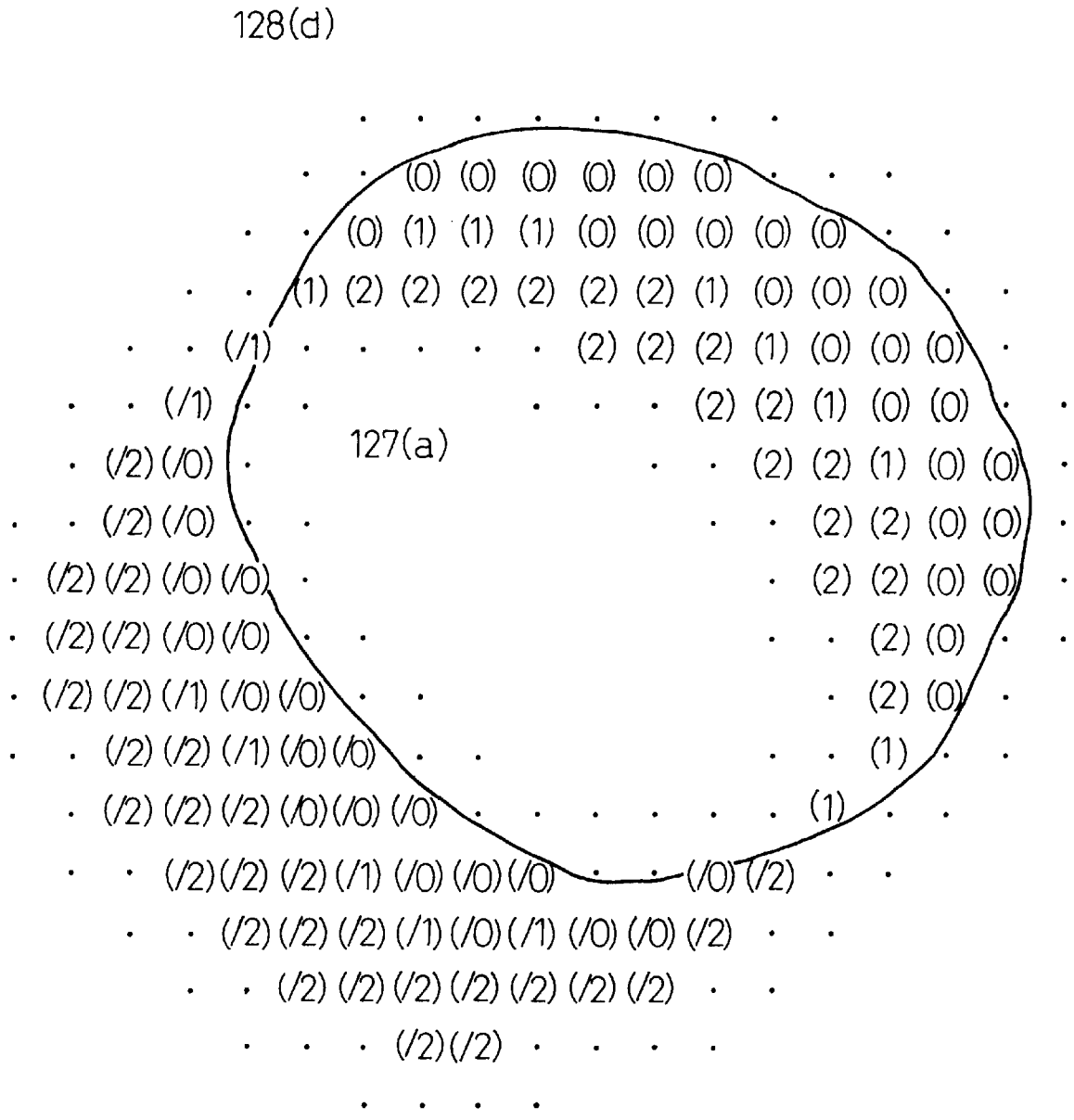
Figure 50:
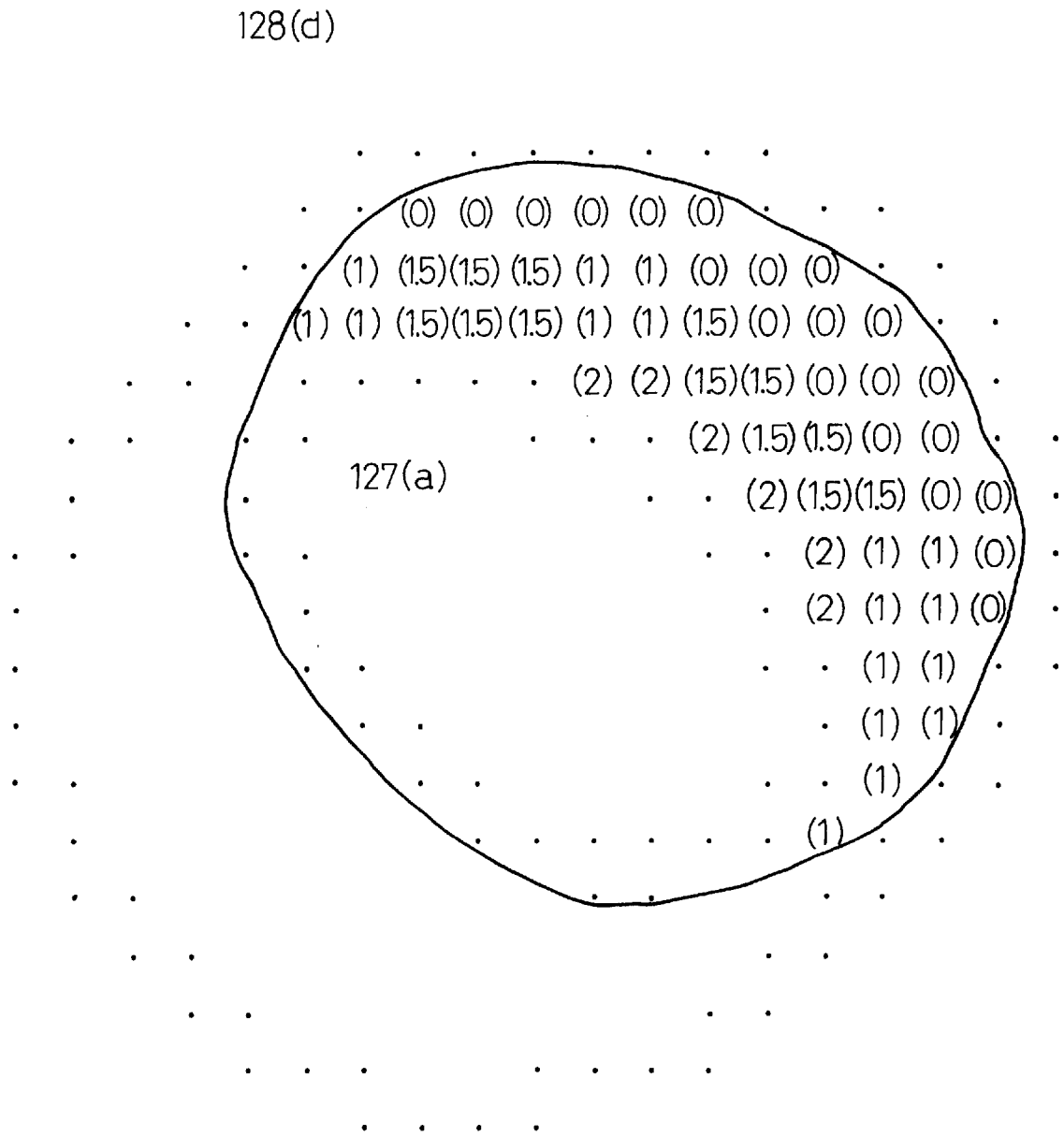

FIG. 49 shows weighted corrective pulses selected for the image of FIG. 47 from an upper row of Table 3. The corrective pulses of FIG. 49 are substantially equal to those of FIG. 47. FIG. 50 shows weighted corrective pulses selected for the image of FIG. 47 from a lower row of Table 3. They are substantially equal to those of FIG. 47.

Figure 51:
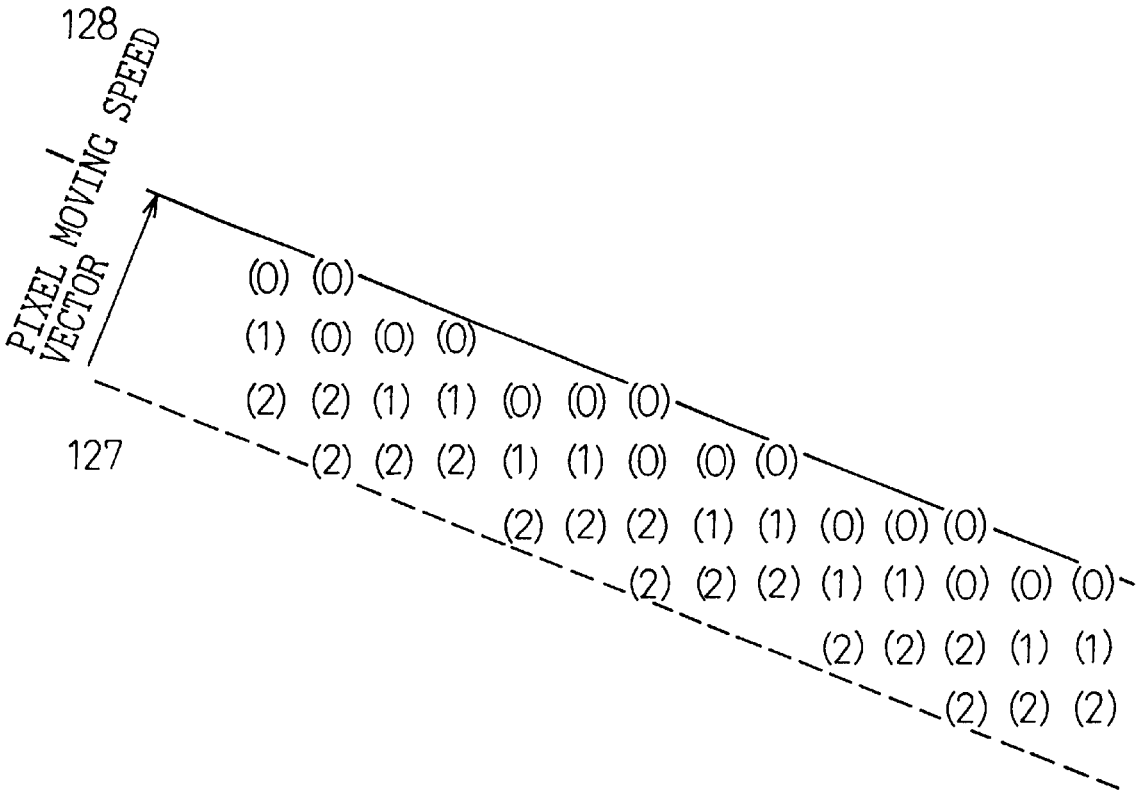
FIG. 51 shows an image moving in an optional direction and corrected according to the present invention.

FIG. 51 shows an image moving in a non-diagonal direction and involving an intensity level change in the moving direction.

Although the intensity level changing direction is equal to the image moving direction, the moving direction is not diagonal. Accordingly, an after image of a given pixel does not overlap the next pixel. Accordingly, the weighting technique applied to FIG. 41 with a diagonally moving image is not applicable to FIG. 51. Pixels of FIG. 51 are provided with weighted corrective pulses according to Table 4 of the present invention. The corrective pulses of FIG. 51 resemble those of FIG. 41.

The method of Table 4 of the present invention will be explained in detail with reference to FIGS. 52 to 60B. The method is achievable with circuits or with a program executed by a computer. The program consists of routines to be explained below with reference to flowcharts. The program is stored in a flexible disk, a hard disk, a CDROM, an MO disk, or any type of nonvolatile memory and is distributed.

Figure 52:
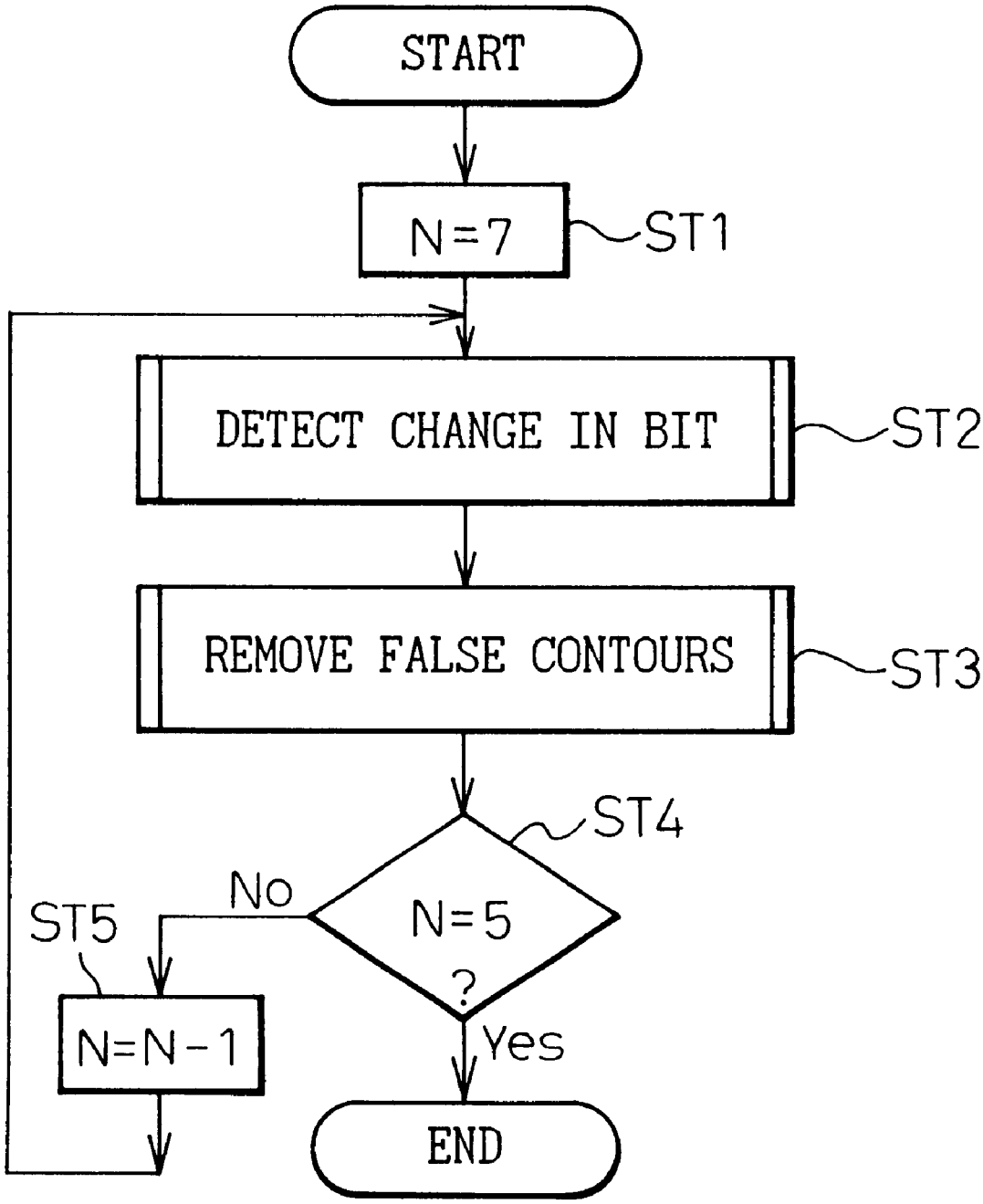
FIG. 52 is a flowchart showing the main routine of a method of displaying a halftone image according to the present invention.

FIG. 52 is a flowchart showing a main routine for carrying out the method of the present invention.

Step ST1 sets N=7. The number N specifies a bit number representing a subframe that realizes a specific intensity level. For example, N=7 specifies the most significant bit b7 representing the subframe SF7 corresponding to intensity level 128, and N=6 specifies bit b6 representing the subframe SF6 corresponding to intensity level 64.

Step ST2 carries out a routine of detecting a change in each bit b7 in frames n and n+1. Resultant data of step ST2 is stored in a memory. Step ST3 carries out a routine of correcting false contours.

Step ST4 checks to see if N=5. If N=5, the main routine ends, and if not, step ST5 sets N=N−1. Then, steps St2 to ST4 are repeated. The main routine ends if N=5 instep ST4. This means that carrying out corrections with corrective pulses or not is determined according to the statuses of the subframes SF7, SF6, and SF5 of each pixel because these subframes greatly influence the quality of an image to be displayed. The number set in step ST4 may properly be changed depending on conditions and requirements.

Figure 53:
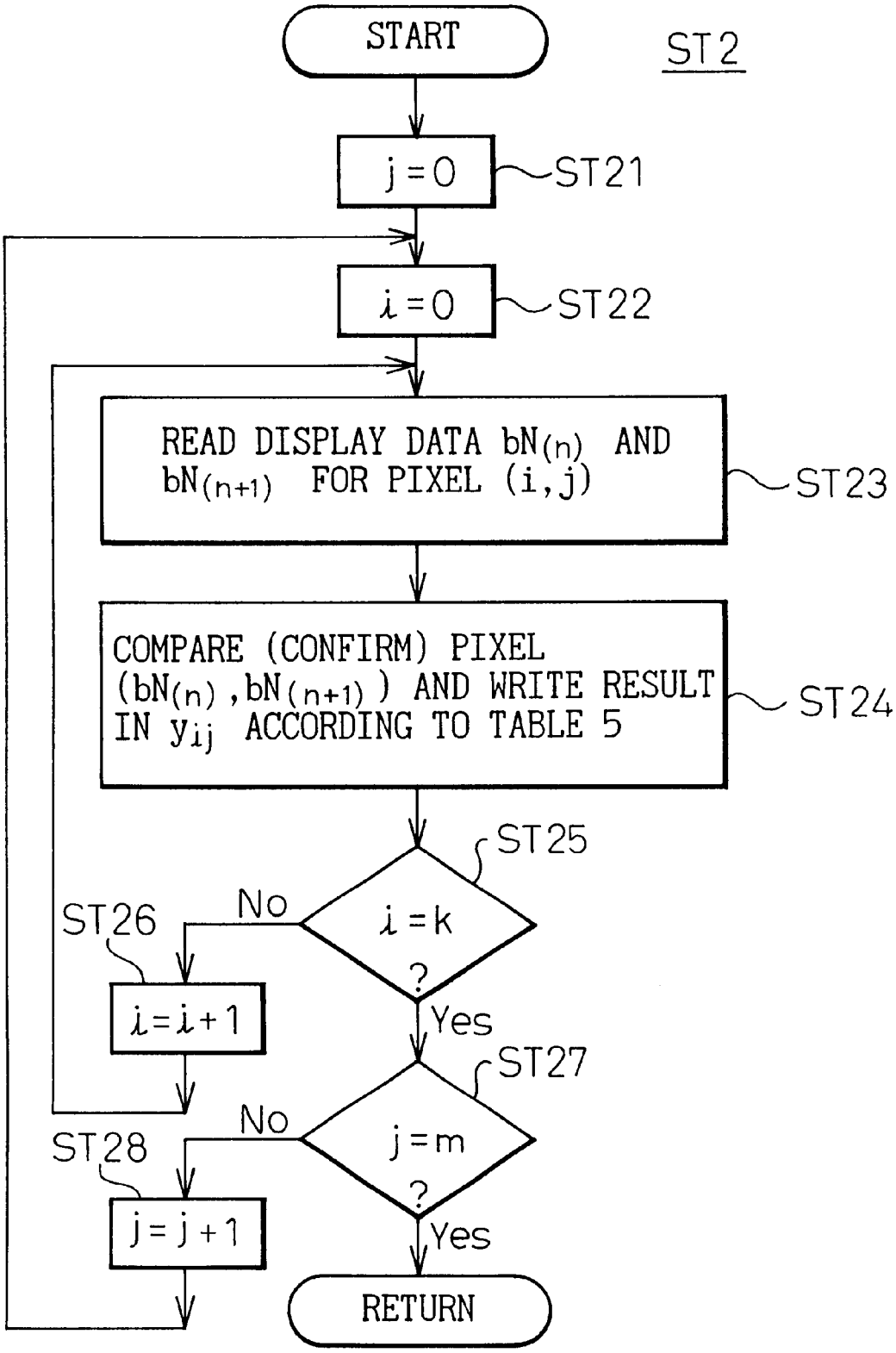
FIG. 53 is a flowchart showing a bit change detecting process of the main routine.

FIG. 53 shows the details of step ST2 of FIG. 52.

Step ST21 initializes j=0. Step ST22 initializes i=0. The variables i and j are the coordinates of a given pixel on the screen. The horizontal coordinate i ranges from 0 to k, and the vertical coordinate j ranges from 0 to m. Namely, the screen has a matrix of k+1 horizontal pixels and m+1 vertical pixels.

Step ST23 reads, for a pixel (0, 0), a bit $b7_{(n)}$ from a frame n and a bit $b7_{n+1)}$ from the next frame n+1. Step ST24 compares (confirms) the bits read in step ST23 with each other, finds a value yij from Table 5, and stores the value yij in the memory.

TABLE 5

| Item | $(b7_{(n)}, b7_{(n+1)})$ | yij | Remarks |
|---|---|---|---|
| 1 | (0, 0) | 00 (a) | No carry-up or carry-down |
| 2 | (0, 1) | 01 (b) | Carry-up |
| 3 | (1, 0) | 10 (c) | Carry-down |
| 4 | (1, 1) | 11 (d) | No carry-up or carry-down |

Step ST25 checks to see if i=k. If i<k, step ST26 sets i=i+1, and step ST23 is repeated. If i=k, step ST27 is carried out.

Step ST27 checks to see if j=m. If j<m, step ST28 sets j=j+1, and step ST22 is repeated. If j=m in step ST27, the subroutine ends, i.e., step ST2 of the main routine of FIG. 52 ends, and step ST3 of the main routine is carried out.

Figure 54:
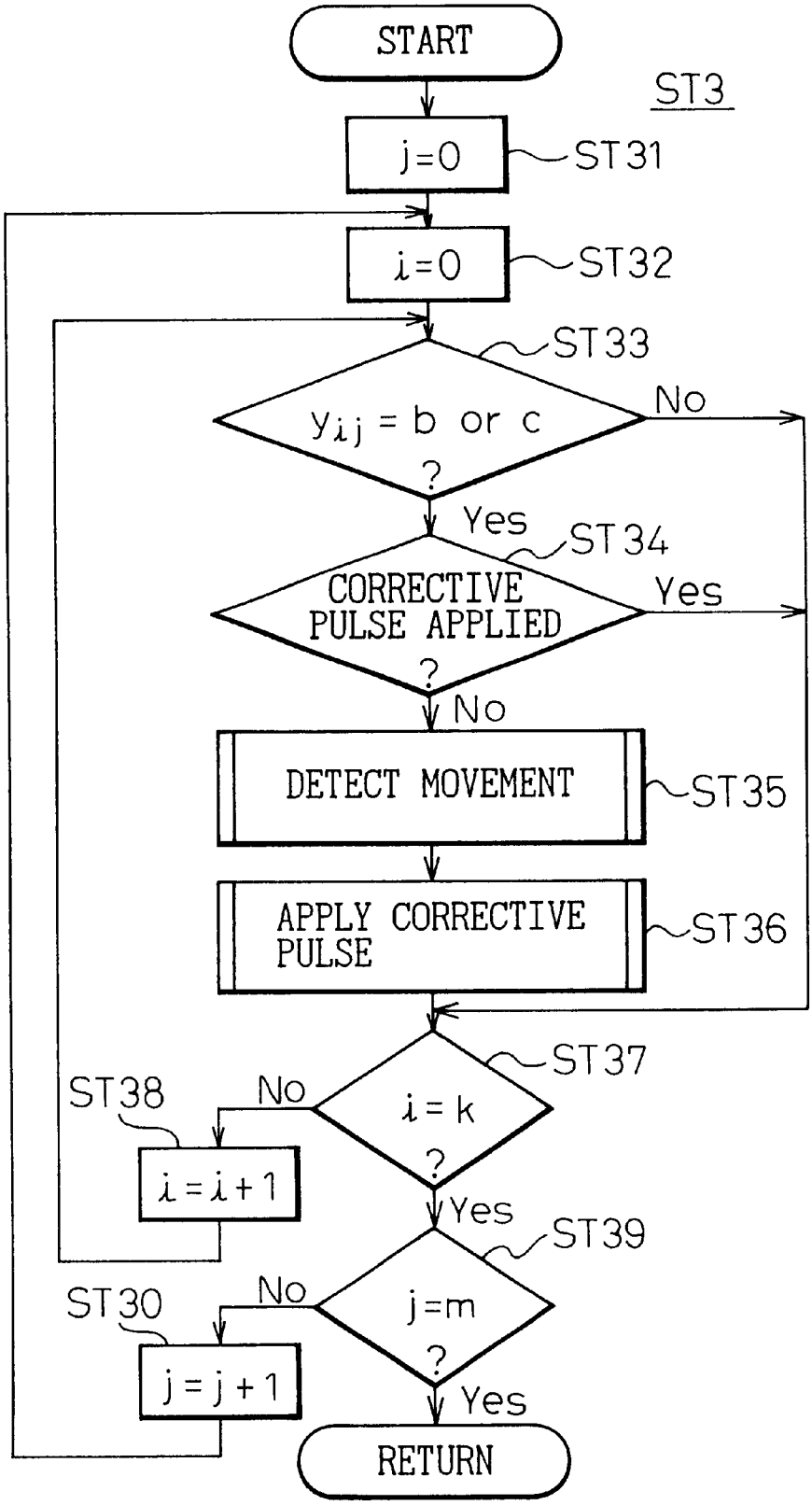
FIG. 54 is a flowchart showing a false contour removing process of the main routine.

FIG. 54 is a flowchart showing the details of step ST3 of FIG. 52. Steps ST35 and ST36 will be explained later with reference to FIGS. 55 to 57 and 58 to 60B.

Step ST31 initializes j=0, and step ST32 initializes i=0.

Step ST33 reads $y_{00}$ for a pixel (0, 0) and checks to see if $Y_{00}$ is b or c. Namely, it checks to see if $y_{00}$ specifies carry-up or carry-down. If $y_{00}$ is b or c, step ST34 is carried out, and if not, step ST37 is carried out.

Step ST34 checks the pixel (0, 0) to see if it is provided with a corrective pulse due to the processing of another pixel. If the pixel is provided with the corrective pulse, step ST37 is carried out, and if not, step ST35 detects a movement. Thereafter, step ST36 applies a corrective pulse to the pixel in question, and step ST37 is carried out.

Step ST37 checks to see if i=k. If i<k, step ST38 sets i=i+1, and step ST33 is repeated. If i=k, step ST39 is carried out.

Step ST 39 checks to see if j=m. If j<m, step ST30 sets j=j+1, and step ST32 is repeated. If j=m in step ST39, the subroutine ends, i.e., step ST3 of the main routine ST3 of FIG. 52 ends, and step ST4 of the main routine is carried out.

Figure 55:
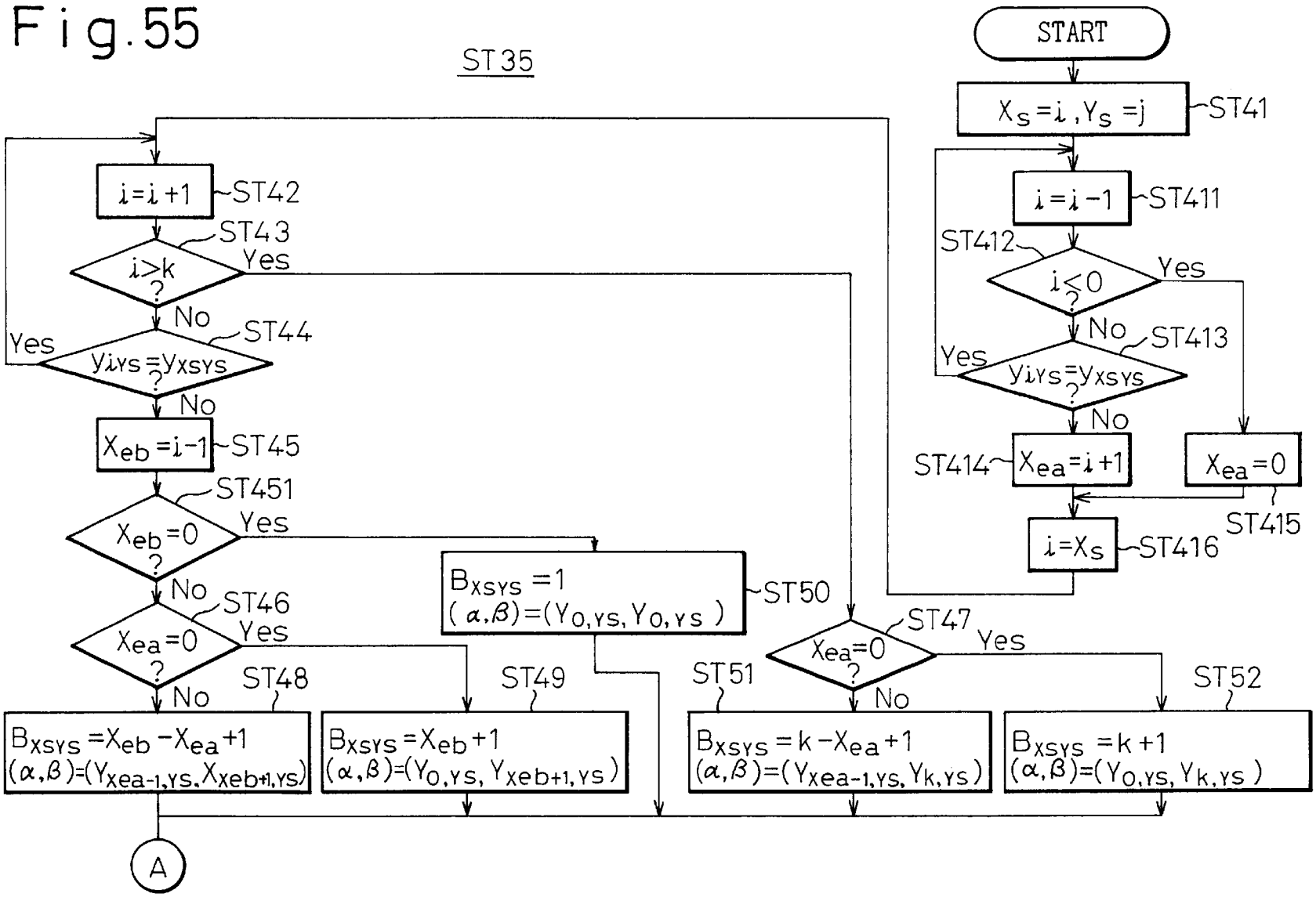
FIGS. 55 to 57 are flowcharts showing a movement detecting process included in the false contour removing process.
Figure 56:
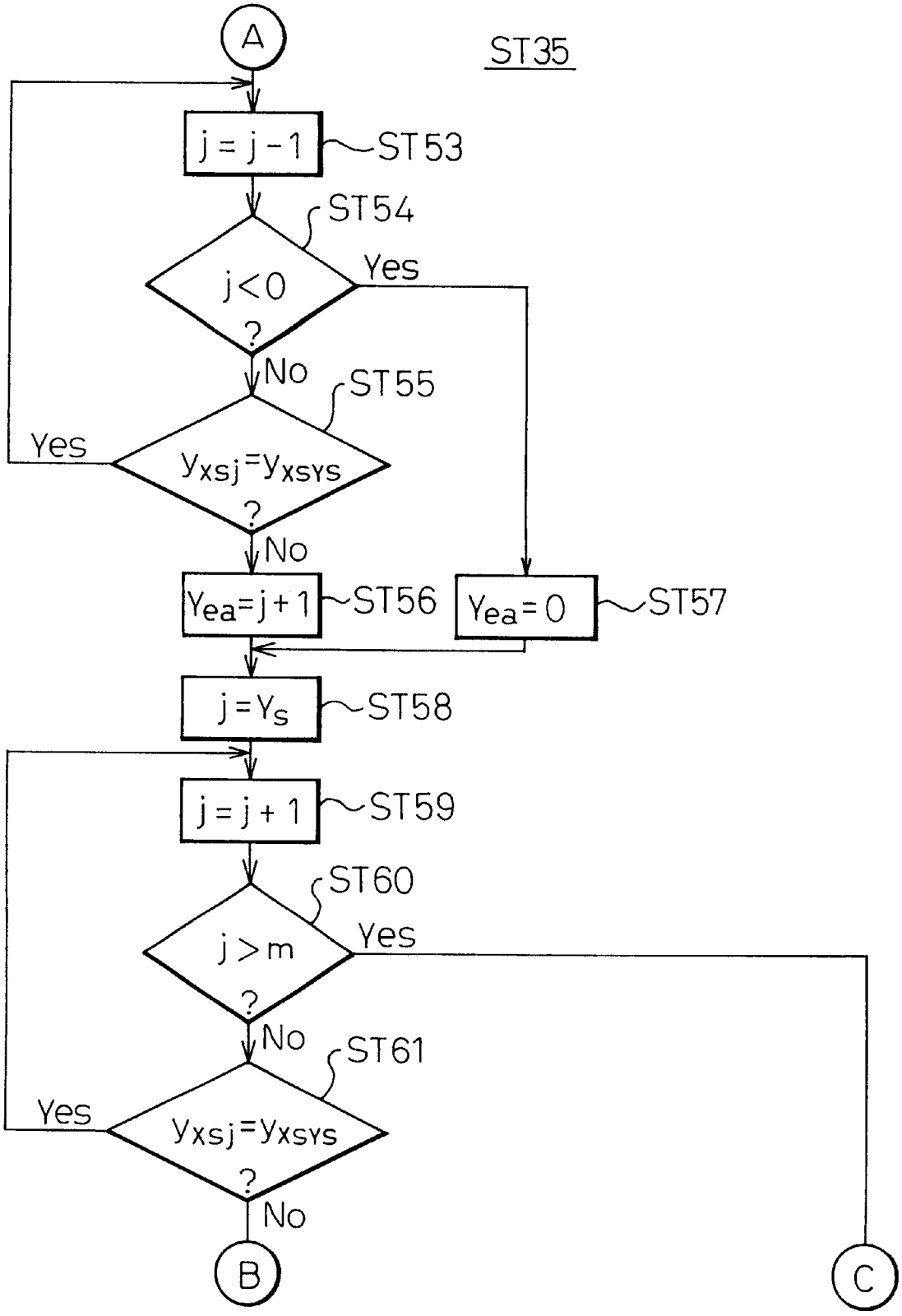
Figure 57:
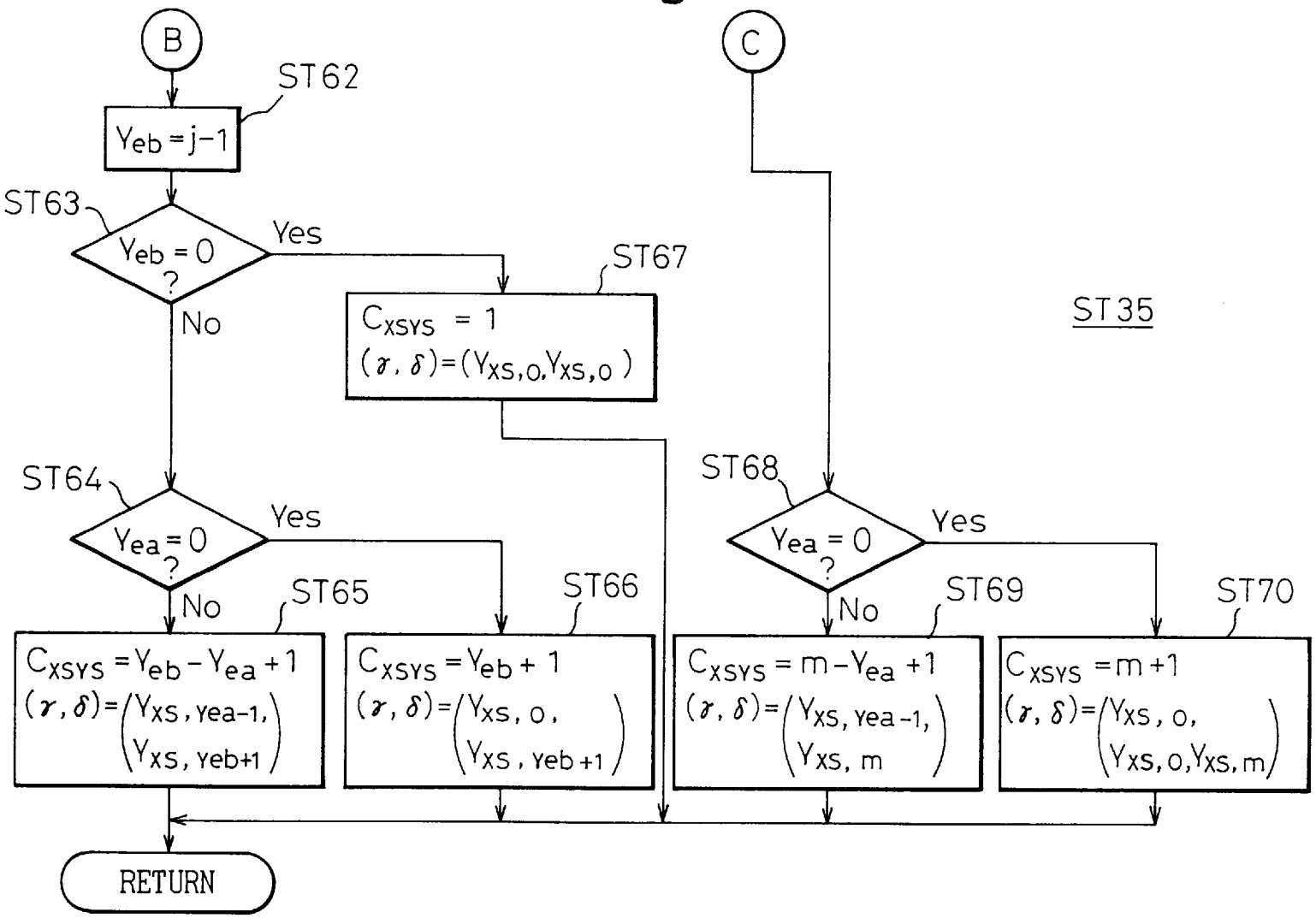

FIGS. 55 to 57 show the details of step ST35 of FIG. 54, in which FIG. 55 shows a subroutine of detecting a horizontal movement, and FIGS. 56 and 57 are subroutines of detecting a vertical movement. These subroutines take place when carry-up or carry-down is detected in a given pixel (i, j), i.e., if yij is b or c.

The subroutine of detecting a horizontal movement of FIG. 55 will be explained. Step ST41 sets the coordinates of the pixel (i, j) as (Xs, Ys), i.e., Xs=i and Ys=j.

Step ST411 sets i=i−1. Step ST412 checks to see if i<0 to determine whether or not the present pixel is out of the screen. If i<0, step ST415 is carried out, and if not, step ST413 is carried out.

Step ST413 compares the status yiYs of the present pixel with the status yXsYs of the start pixel. If the statuses are different from each other, step ST414 is carried out, and if they are equal to each other, step ST411 is repeated. These steps are repeated until a different status is found, or until an end of the screen is detected. Step ST414 calculates Xea=i+1. The position Xea is the start of the horizontal carry-on or carry-down. Step ST415 sets Xea=0 to indicate that the horizontal carry-on or carry-down has reached the end of the screen. In this way, a leftward horizontal movement is detected.

Step ST416 starts to detect a rightward horizontal movement. Namely, step ST416 sets i=Xs, and step ST42 sets i=i+1. Step ST43 checks to see if i>k to determine whether or not the present position is out of the screen boundary k. If i>k, step ST47 is carried out, and if not, step ST44 is carried out.

Step ST44 compares the status $y_{iYs}$ of the present pixel with the status $y_{XsYs}$ of the start pixel. If the statuses are equal to each other, step ST42 is repeated, and if they differ from each other, step ST45 is carried out. Step ST45 sets Xeb=i−1.

Step ST451 checks to see if Xeb=0. If Xeb=0, step ST50 is carried out, and if not, step ST46 checks to see if Xea=0. If Xea=0, step ST49 is carried out, and if not, step ST48 is carried out.

Step ST47 checks to see if Xea=0 to determine whether or not the start pixel is equal to the start of the screen. If Xea=0, step ST52 is carried out, and if not, step ST51 is carried out.

Step ST48 calculates $B_{XsYs}=X_{eb}-Xea+1$, where $B_{XsYs}$ is a horizontal movement. At the same time, step ST48 calculates $(\alpha, \beta)=(Y_{Xea-1}, Ys, Y_{Xeb+1}, Ys)$ as the statuses of pixels adjacent to end pixels. Similarly, step ST49 calculates $B_{XsYs}=Xeb+1$ and $(\alpha, \beta)=(Y_0, Ys, Y_{Xeb+1}, Ys)$, step ST50 calculates $B_{XsYs}=1$ and $(\alpha, \beta) = (Y_0, Ys, Y_0, Ys)$, step ST51 calculates $B_{XsYs}=k-Xea+1$ and $(\alpha, \beta)=(Y_{Xea-1}, Ys, Y_k, Ys)$, and step ST52 calculates $B_{XsYs=k+}1$ and $(\alpha, \beta)=(Y_0, Ys, Y_k, Ys)$. In this way, steps ST48 to ST52 calculate a horizontal movement and the statuses of two pixels that sandwich the consecutive pixels. Thereafter, step ST53 of FIG. 56 is carried out.

In FIG. 56, step ST53 sets j=j−1. At this time, the horizontal coordinate of the present pixel is Xs. Step ST54 checks to see if j<0 to determine whether or not the present pixel is out of the screen. If not j<0, step ST57 is carried out, and if j<0, step ST55 is carried out.

Step ST44 compares the status $y_{Xsj}$ of the present pixel with the status $y_{XsYs}$ of the start pixel. If they differ from each other, step ST56 is carried out, and if they are equal to each other, step ST53 is repeated. These steps are repeated until a different status is detected, or until an end of the screen is detected. Step ST56 sets Yea=j+1. The position Yea is the start of the vertical carry-on or carry-down. Step ST57 sets Yea=0 to indicate that the vertical carry-on or carry-down has reached the end of the screen. In this way, a vertical movement is detected.

Step ST58 starts to detect a downward vertical movement. Namely, step ST58 sets j=Ys, and step ST59 sets j=j+1.

Step ST60 checks to see if j>m to determine whether or not the present pixel is out of the boundary m of the screen. If j>m, step ST68 of FIG. 57 is carried out, and if not step ST61 is carried out. Step ST61 compares the status $y_{Xsj}$ of the present pixel with the status $y_{XsYs}$ of the start pixel. If they differ from each other, step ST62 of FIG. 57 is carried out, and if they are equal to each other, step ST59 is repeated. These steps are repeated until a different status is detected, or until a vertical end of the screen is detected.

In FIG. 57, step ST62 sets Yeb=j−1, where Yeb is the end of the vertical carry-on or carry-down. Step ST63 checks to see if Yeb=0. If Yeb=0, step ST67 is carried out, and if not, step ST64 is carried out.

Step ST64 checks to see if Yea=0 to determine whether or not the start of the vertical carry-on or carry-down is equal to an end of the screen. If Yea=0, step ST66 is carried out, and if not, step ST65 is carried out. Step ST68 also checks to see if Yea=0. If Yea=0, step ST70 is carried out, and if not step ST69 is carried out.

Steps ST65, ST66, ST69, and ST70 each determine a vertical movement $C_{XsYs}$ and the statuses (γ, δ) of adjacent pixels. More precisely, step ST65 calculates $C_{XsYs}$=Yeb−Yea+1 and (γ, δ)=($Y_{Xs}$, Yea−1, $Y_{Xs}$, Yeb+1), step ST66 calculates $C_{XsYs}$=Yeb+1 and (γ, δ)=($Y_{Xs}$, 0, $Y_{Xs}$, Yeb+1), step ST69 calculates $C_{XsYs}$=m−Yea+1 and (γ, δ)=($Y_{Xs}$, Yea−1, $Y_{Xs}$, m), and step ST70 calculates $C_{XsYs}$=m+1 and (γ, δ)=($Y_{Xs}$, 0, $Y_{Xs}$, m). As a result, the horizontal and vertical movements are calculated, to finish step ST35 of FIG. 54. Then, step ST36 of FIG. 54 is carried out.

FIGS. 58 to 60B show the details of step ST36 of FIG. 54 of applying a corrective pulse.

Figure 58:
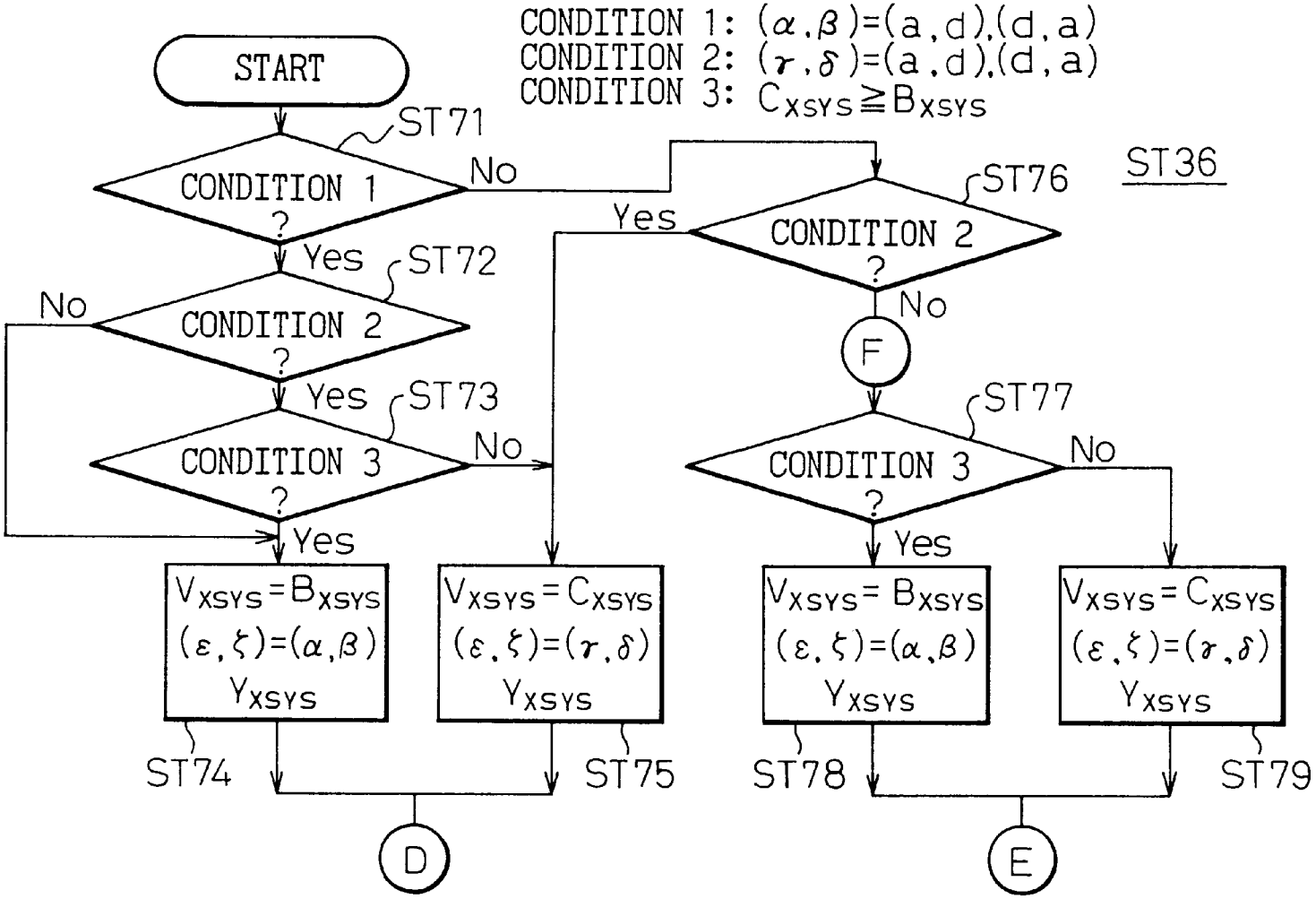
FIGS. 58 and 59 are flowcharts showing a corrective pulse applying process included in the false contour removing process.

In FIG. 58, step ST71 checks a condition 1 to determine whether or not the horizontal adjacent pixels (α, β) that sandwich the horizontal consecutive pixels are (a, d) or (d, a). If the condition 1 is satisfied, step ST72 is carried out, and if not, step ST76 is carried out.

Step ST72 checks a condition 2 to determine whether or not the vertical adjacent pixels (γ, δ) that sandwich the vertical consecutive pixels are (a, d) or (d, a). If the condition 2 is satisfied, step ST73 is carried out, and if not, step ST74 is carried out. Step ST73 checks a condition 3 to determine if $C_{XsYs} \geqq B_{XsYs}$, where $B_{XsYs}$ and $C_{XsYs}$ are horizontal and vertical movements. If $C_{XsYs} \geqq B_{XsYs}$, step ST74 is carried out, and if not, step ST75 is carried out.

Step ST76 checks the condition 2. If the condition 2 is satisfied, step ST75 is carried out, and if not, step ST77 is carried out. Step ST77 checks the condition 3. If the condition 3 is met, step ST78 is carried out, and if not, step ST79 is carried out.

Step ST74 stores a movement $V_{XSYs}=B_{XsYs}$, adjacent pixels (ϵ, ζ)=(α, β), and a start pixel $Y_{XsYs}$. Similarly, step ST75 stores $V_{XsYs}=C_{XsYs}$, (ϵ, ζ)=(γ, δ), and $Y_{XsYs}$, step ST78 stores $V_{XsYs}=B_{XsYs}$, (ϵ, ζ)=(α, β), and $Y_{XsYs}$, and step ST79 stores $V_{XsYs} = C_{XsYs}$, (ϵ, ζ) = (γ, δ), and $Y_{XsYs}$. After steps ST74 and ST75, step ST80 of FIG. 59 is carried out, and after steps ST78 and ST79, step ST84 of FIG. 59 is carried out, to apply corrective pulses.

Figure 59:
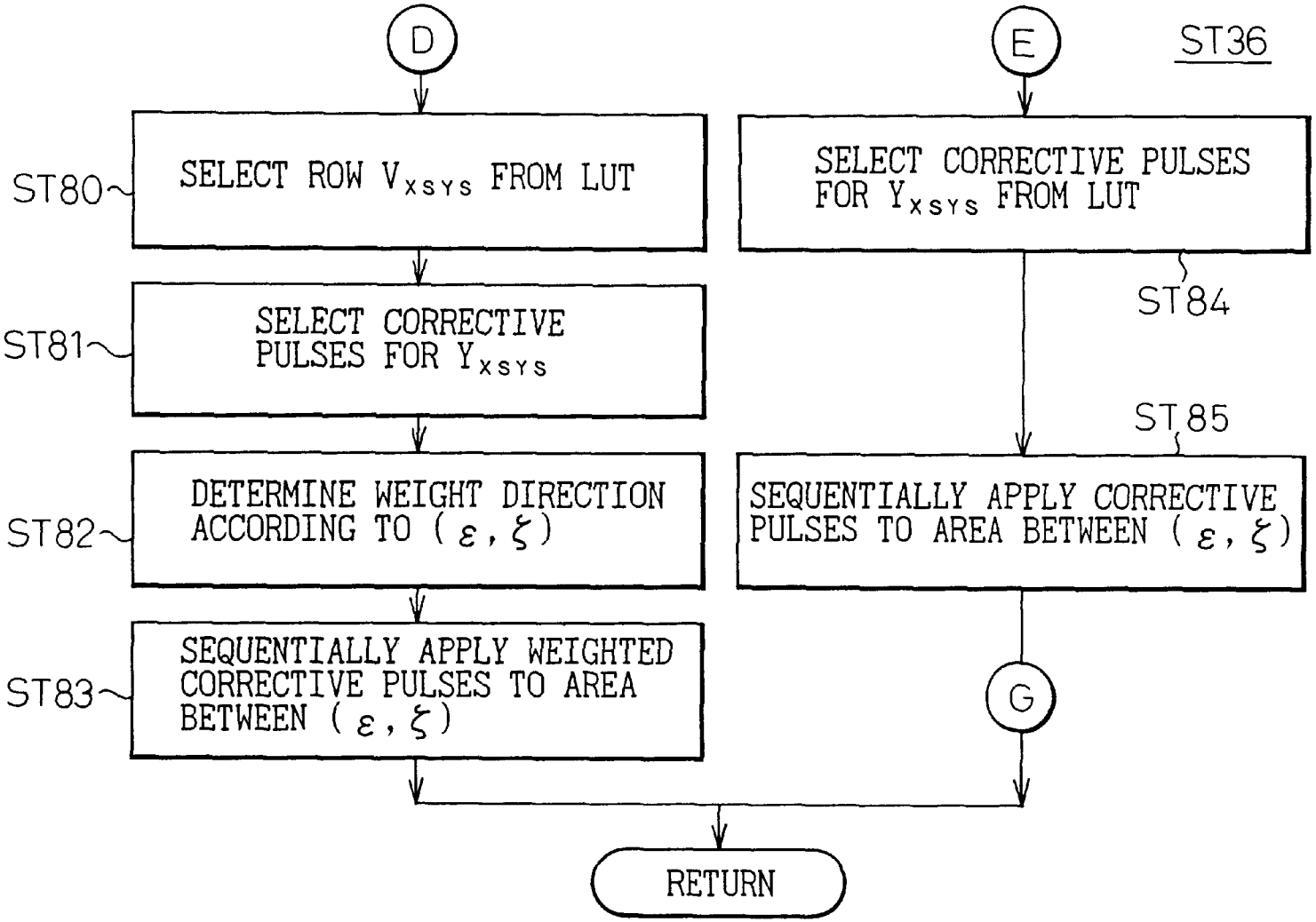

In FIG. 59, step ST80 refers to Table 3 to select a row corresponding to the movement $V_{XsYs}$. Step ST81 selected one of positive and negative corrective pulse sets according to the status of $Y_{XsYs}$. Step ST82 determines a weighting direction of the corrective pulses according to the adjacent pixels (ϵ, ζ). Step ST83 sequentially applies the corrective pulses to the section sandwiched between the adjacent pixels (ϵ, ζ). This completes step ST36 of FIG. 54, and step ST37 of FIG. 54 is carried out.

Step ST84 looks up Table 3 and selects a corrective pulse similar to the related art (FIGS. 27A, 27B, 35A, and 35B). Step ST85 sequentially applies the corrective pulse to the section (area) sandwiched between the adjacent pixels (ϵ, ζ). This completes step ST36 of FIG. 54, and step ST37 of FIG. 54 is carried out.

Figure 60A:
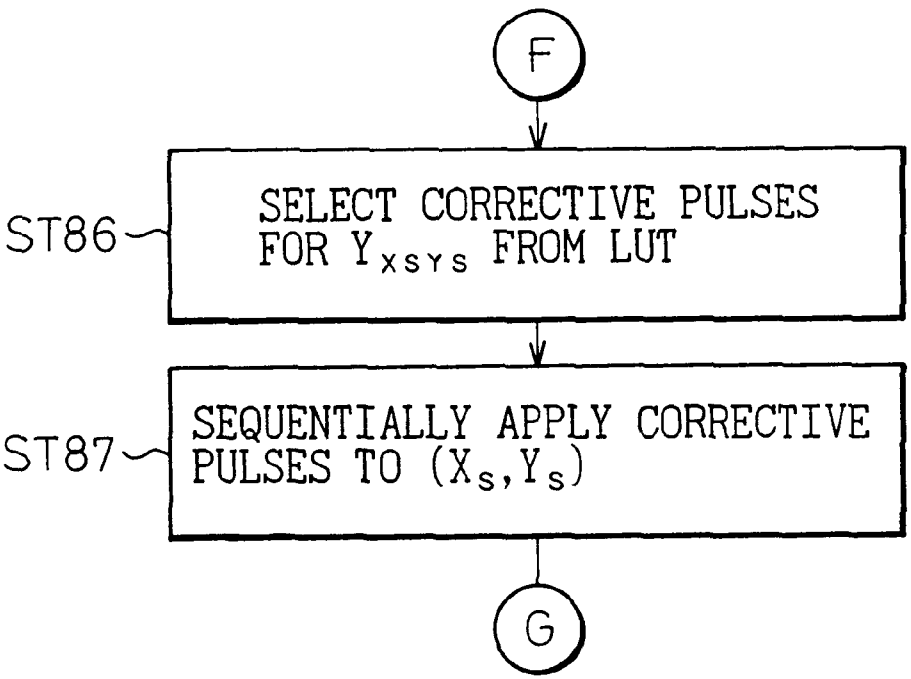
FIGS. 60A and 60B are flowcharts showing modifications of the corrective pulse applying process.
Figure 60B:
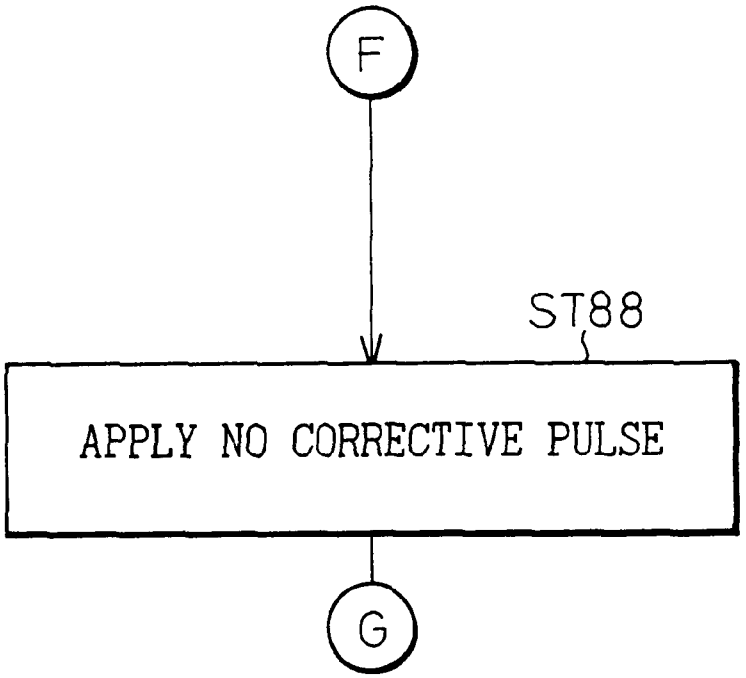

FIGS. 60A and 60B show modifications of the processes between F and G of FIGS. 58 and 59. Steps St77 to ST79, ST84, and ST85 of FIGS. 58 and 59 correspond to steps ST86 and ST87 of FIG. 60A, or step ST88 of FIG. 60B.

In FIGS. 58, 59, and 60A, if step ST76 determines that the vertical adjacent pixels (γ, δ) are not (a, d) or (d, a), step ST86 is carried out instead of step ST77. Step ST86 looks up Table 3 and selects a corrective pulse similar to the related art (FIGS. 27A, 27B, 35A, and 35B) according to the start pixel $Y_{XsYs}$. Step ST87 applies the corrective pulse only to the coordinates (Xs, Ys). This completes step ST36 of FIG. 54, and step ST37 of FIG. 54 is carried out.

In FIGS. 58, 59, and 60B, if step ST76 determines that the vertical adjacent pixels (γ, δ) are not (a, d) or (d, a), step ST88 is carried out instead of ST77. Step ST88 applies no corrective pulse. This completes step ST36 of FIG. 54, and step ST37 of FIG. 54 is carried out.

As explained with reference to FIGS. 52 to 60B, the method of the present invention is applicable to images of various moving speeds and directions. In particular, the present invention is applicable to halftone images moving at a high speed, e.g., 5 pixels per frame or faster. The present invention reduces disturbance and eliminates false contours in halftone images.

The present invention is applicable not only to gas discharge panels such as plasma display panels but also to other display panels such as DMDs and EL panels that divide a frame of an image into subframes.

As explained above, the present invention applies corrective pulses to pixels that turn on and off synchronously in consecutive frames. The present invention reduces disturbance in halftone images and eliminates false contours of the images even if the images are moving at a high speed.

Many different embodiments of the present invention may be constructed without departing from the spirit and scope of the present invention, and it should be understood that the present invention is not limited to the specific embodiments described in this specification, except as defined in the appended claims.

What is claimed is:

1. A method of displaying a dynamic halftone image on a display panel made of pixels in accordance with dividing each frame of the image into subframes and turning on/off the subframes, comprising the steps of:

finding a line of pixels that simultaneously display a specific intensity level in a frame and another specific intensity level in the next frame;

calculating the sum ΔS of stimulus on a retina to be produced with a weighted corrective pulse which will be applied to one of the n pixels, as follows:

$B_1T \lesssim B_2T+\Delta S \lesssim B_3T$, or $B_1T \gtrsim B_2T+\Delta S \gtrsim B_3T$ wherein T is a period in which the intensity level of ten pixels changes from one to another, $B_1$ is an average of stimulus on a retina due to one of the n pixels before the change, $B_2$ is an average of stimulus on the retina due to the same during the change, and $B_3$ is an average of stimulus on the retina due to the same after the change;

comparing the intensity levels with each other;

selecting the weighted corrective pulses, which turn on/off corresponding subframes thereby to enable/ disable corresponding intensity levels, respectively, according to the n pixels and a change in the intensity levels between the frames, so that the total sum of stimulus on the retina to be produced with the corrective pulses is substantially equal to $n\Delta S$; and adjusting original display signals for the n pixels according to the weighted corrective pulses respectively.

2. A method of displaying a dynamic halftone image on a display panel made of pixels in accordance with dividing each frame of the image into subframes and turning on/off the subframes, comprising the steps of:

finding a line of n pixels that simultaneously display a specific intensity level in a frame and another specific intensity level in the next frame;

calculating the sum $\Delta S$ of stimulus on the retina to be produced with a weighted corrective pulse, which will be applied to one of the n pixels, as follows:

if $B_2 \lesssim (B_1+B_3)/2$ then $0 \lesssim \Delta S \lesssim (B_1+B_3-2B_2)T$ if $B_2 \gtrsim (B_1+B_3)/2$ then $0 \gtrsim \Delta S \gtrsim (B_1+B_3-2B_2)T$ where T is a period in which the intensity level of the n pixels changes from one to another, $B_1$ is an average of stimulus on the retina due to one of the n pixels before the change, $B_2$ is an average of stimulus on the retina due to the same during the change, and $B_3$ is an average of stimulus on the retina due to the same after the change;

comparing the intensity levels with each other;

selecting the weighted corrective pulses, which turn on/off corresponding subframes thereby to enable/disable corresponding intensity levels, respectively, according to the n pixels and a change in the intensity levels between the frames, so that the total sum of stimulus on the retina to be produced with the corrective pulses is substantially equal to $n\Delta S$; and adjusting original display signals for the n pixels according to the weighted corrective pulses, respectively.

3. A method of displaying a dynamic halftone image on a display panel made of pixels in accordance with dividing each frame of the image into subframes and turning on/off the subframes, comprising:

finding a line of n pixels that simultaneously display a specific intensity level in a frame and another specific intensity level in the next frame;

calculating the sum $\Delta S$ of stimulus on the retina to be produced with a corrective pulse, which will be applied to one of the n pixels, as follows:

if $B_2 \lesssim (B_1+B_3)/2$ then $0 \lesssim \Delta S \lesssim (B_1+B_3-2B_2)T$ if $B_2 \gtrsim (B_1+B_3)/2$ then $0 \gtrsim \Delta S \gtrsim (B_1+B_3-2B_2)T$ where T is a period in which the intensity level of the n pixels changes from one to another, $B_1$ is an average of stimulus on the retina due to one of the n pixels before the change, $B_2$ is an average of stimulus on the retina due to the same during the change, and $B_3$ is an average of stimulus on the retina due to the same after the change;

selecting identical or different corrective pulses, which turn on/off corresponding subframes thereby to enable/disable corresponding intensity levels, respectively, so that the total sum of stimulus on the retina to be produced with the corrective pulses is substantially equal to $n\Delta S$; and adjusting original display signals for the n pixels according to the corrective pulses, respectively.

4. A display apparatus displaying a dynamic halftone image on a display panel made of pixels in accordance with dividing each frame of the image into subframes and turning on/off the subframes, comprising:

a finding unit finding a line of n pixels that simultaneously display a specific intensity level in a frame and another specific intensity level in the next frame;

a calculating unit calculating the sum $\Delta S$ of stimulus on a retina to be produced with a weighted corrective pulse, which will be applied to one of the n pixels, as follows:

$B_1T \lesssim B_2T+\Delta S \lesssim B_3T$, or $B_1T \gtrsim B_2T+\Delta S \gtrsim B_3T$ where T is a period in which the intensity level of the n pixels changes from one to another, $B_1$ is an average of stimulus on a retina due to one of the n pixels before the change, $B_2$ is an average of stimulus on the retina due to the same during the change, and $B_3$ is an average of stimulus on the retina due to the same after the change;

a comparing unit comparing the intensity levels with each other;

a selecting unit selecting the weighted corrective pulses, which turn on/off corresponding subframes thereby to enable/disable corresponding intensity levels, respectively, according to the n pixels and a change in the intensity levels between the frames, so that the total sum of stimulus on the retina to be produced with the corrective pulses is substantially equal to $n\Delta S$; and an adjusting unit adjusting original display signals for the n pixels according to the weighted corrective pulses, respectively.

5. The display apparatus displaying a dynamic halftone image as claimed in claim 4, wherein each of the pixels consists of three subpixels emitting three primary colors of red, green, and blue, respectively, the subpixels being combined to display a color.

6. The method of displaying a dynamic halftone image on a display panel made of pixels by dividing each frame of the image into subframes and by turning on and off the subframes, comprising the steps of:

finding, in each of at least two directions, a line of pixels that simultaneously display a specific intensity level in a frame and another specific intensity level in a next frame;

counting the number of pixels in each of the lines;

detecting the respective statuses of adjacent pixels on respective sides of each of the lines in the frames;

determining a direction of corrective pulses to be added, according to counted numbers of equally changed pixels between the frames obtained by the finding and detecting steps and according to the respective statuses of pixels on respective sides of the equally changed pixels;

selecting respective corrective pulses in the determined direction, which turn on/off corresponding subframes to enable/disable corresponding intensity levels, according to the first and second adjacent pixels on respective sides of each of the first and second lines in the frames;

a first selecting unit selecting one of the first and second lines according to the counted numbers and the statuses of the adjacent pixels;

a second selecting unit selecting corrective pulses in the determined direction, which turn on/off corresponding subframes to enable/disable corresponding intensity levels, respectively, according to the counted numbers of equally changed pixels in the first and second lines between the frames and according to the respective statuses of first and second pixels on respective sides of each of the first and second lines; and an adjusting unit adjusting original display signals for the pixels in the selected line according to the corrective pulses, respectively.

7. The method of displaying a dynamic halftone image as claimed in claim 6, wherein the selection step selects respective corrective pulses in a direction, of the at least two directions, in which the counted number is smaller than in another of the at least two directions, when the adjacent pixel on each side of each of the lines have respectively different statuses; and the original display signals are adjusted by the corrective pulses in the determined direction according to the counted number of equally changed pixels between the frames and according to the status of a pixel on each side of the equally changed pixels.

8. The method of displaying a dynamic halftone image as claimed in claim 6, wherein the selection step selects the corrective pulses in the at least two directions regardless of the counted numbers, when one of the first and second adjacent pixels on respective sides of each of the lines has respectively different status; and the original display signals are adjusted by the corrective pulses in the determined direction according to the counted numbers of equally changed pixels between the frames and according to the respective statuses of first and second pixels on respective sides of the equally changed pixels.

9. The method of displaying a dynamic halftone image as claimed in claim 6, wherein the selection step selects respective corrective pulses in a direction where the counted numbers is smaller, when both of the first and second adjacent pixels on respective sides of each of the lines have the same statuses; and at least one of the original display signals is adjusted by the corrective pulses in the determined direction according to the counted numbers of equally changed pixels between the frames and according to the respective statuses of first and second pixels on respective sides of the equally changed pixels.

10. The method of displaying a dynamic halftone image as claimed in claim 6, wherein the at least two directions are a vertical direction and a horizontal direction.

11. A display apparatus for displaying a dynamic halftone image on a display panel made of pixels in accordance with dividing each frame of the image into subframes and turning on/off the subframes, comprising:

a finding unit finding, in each of at least two directions, a line of pixels that simultaneously display a specific intensity level in a frame and another specific intensity level in a next frame;

a first counting unit counting the number of pixels in a first line of the at least two directions;

a second counting unit counting the number of pixels in a second line of the at least two directions;

a detecting unit detecting the respective statuses of two adjacent pixels on each side of each of the first and second lines in the frames;

a first selecting unit selecting one of the first and second lines according to the counted numbers and the statuses of the adjacent pixels;

a second selecting unit selecting corrective pulses, which turn on/off corresponding subframes to enable/disable corresponding intensity levels, respectively, according to the number of pixels in the selected line and the respective statuses of the two adjacent pixels of the selected line; and an adjusting unit adjusting original display signals for the pixels in the selected line according to the corrective pulses, respectively.

12. The display apparatus displaying a dynamic halftone image as claimed in claim 11, wherein the second selecting unit selects respective corrective pulses in a direction where the counted numbers is smaller, when the first and second adjacent pixels on respective sides of each of the lines have different statuses; and the adjusting unit adjusts the original display signals by the corrective pulses in the determined direction according to the counted number and pixel change between the frames.

13. The display apparatus displaying a dynamic halftone image as claimed in claim 11, wherein the second selecting unit selects the corrective pulses in the at least two directions regardless of the counted numbers, when the first and second adjacent pixels on respective sides of each of the lines have respective, different statuses; and the adjusting unit adjusts the original display signals by the corrective pulses in the determined direction according to the counter number and pixel change between the frames.

14. The display apparatus displaying a dynamic halftone image as claimed in claim 11, wherein the second selecting unit selects respective corrective pulses in a direction where the counted numbers is smaller, when the first and second adjacent pixels on respective sides of each of the lines have the same status; and the adjusting unit adjusts at least one of the original display signals by the corrective pulses in the determined direction according to the counted number and the pixel change between the frames.

15. The display apparatus for displaying a dynamic halftone image as claimed in claim 11, wherein each of the pixels consists of three subpixels emitting three primary colors of red, green, and blue, respectively, the subpixels being combined to display a color.

16. The display apparatus for displaying a dynamic halftone image as claimed in claim 11, wherein the at least two directions are a vertical direction and a horizontal direction, the first line is a horizontal line, and the second line is a vertical line.

* * * * *